US009259911B2

(12) United States Patent
Byrne et al.

(10) Patent No.: US 9,259,911 B2
(45) Date of Patent: Feb. 16, 2016

(54) CUSTOMIZABLE APPARATUS AND METHOD FOR TRANSPORTING AND DEPOSITING FLUIDS

(71) Applicant: The Procter & Gamble Company, Cincinnati, OH (US)

(72) Inventors: Thomas Timothy Byrne, West Chester, OH (US); Michael Scott Prodoehl, West Chester, OH (US); Kevin Benson McNeil, Loveland, OH (US); Gustav Andre Mellin, Amberley Village, OH (US); Haibin Chen, West Chester, OH (US); Matthew Alan Russell, South Abington Township, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/291,631

(22) Filed: May 30, 2014

(65) Prior Publication Data

US 2015/0343758 A1 Dec. 3, 2015

(51) Int. Cl.

| | |
|---|---|
| ***B41F 13/11*** | (2006.01) |
| ***B41F 7/00*** | (2006.01) |
| *B41F 7/26* | (2006.01) |
| *B41F 31/26* | (2006.01) |
| *B41F 31/22* | (2006.01) |

(52) U.S. Cl.
CPC . *B41F 7/00* (2013.01); *B41F 13/11* (2013.01); *B41F 7/265* (2013.01); *B41F 31/22* (2013.01); *B41F 31/26* (2013.01)

(58) Field of Classification Search
None
See application file for complete search history.

(56) References Cited

U.S. PATENT DOCUMENTS

| | | | | | |
|---|---|---|---|---|---|
| 916,357 | A | * | 3/1909 | McCarty | 101/367 |
| 1,858,909 | A | * | 5/1932 | Trist | 101/147 |
| 2,300,949 | A | * | 11/1942 | Luehrs | 101/367 |
| 2,319,616 | A | * | 5/1943 | Luehrs | 101/367 |
| 2,615,389 | A | * | 10/1952 | Huebner | 101/119 |

(Continued)

OTHER PUBLICATIONS

U.S. Appl. No. 14/291,588, filed May 30, 2014, Byrne, et al.

(Continued)

*Primary Examiner* — Jill Culler
(74) *Attorney, Agent, or Firm* — Roddy M. Bullock

(57) ABSTRACT

A system for depositing a fluid on a substrate is disclosed. The system can include a sleeve having a sleeve exit and an inner region and a rotating roll disposed within the inner region. A vascular network can be disposed within the rotating roll, the vascular network being configured for transporting the fluid in predetermined paths from the interior region to the exterior surface through a substantially radial path, the substantially radial path ending at an exit point of a fluid exit, wherein the exit point is associated with a sleeve exit.

15 Claims, 42 Drawing Sheets

(56) References Cited

U.S. PATENT DOCUMENTS

| | | | | | |
|---|---|---|---|---|---|
| 3,083,642 | A | * | 4/1963 | Kaufer et al. | 101/367 |
| 3,407,729 | A | * | 10/1968 | Stach | 101/347 |
| 3,738,269 | A | * | 6/1973 | Wagner | 101/367 |
| 4,416,201 | A | * | 11/1983 | Kessler | 101/348 |
| 4,483,053 | A | * | 11/1984 | Hamisch, Jr. | 29/895.21 |
| 4,526,098 | A | * | 7/1985 | Bachman | 101/115 |
| 4,534,094 | A | * | 8/1985 | Kessler | 29/895.213 |
| 4,550,681 | A | | 11/1985 | Zimmer et al. | |
| 5,638,752 | A | * | 6/1997 | Hartung et al. | 101/177 |
| 5,906,161 | A | * | 5/1999 | Kessler | 101/351.7 |
| 5,987,748 | A | * | 11/1999 | Calloway | 29/895.21 |
| 7,611,582 | B2 | | 11/2009 | McNeil et al. | |
| 8,163,132 | B2 | * | 4/2012 | Kien | 162/134 |
| 8,342,092 | B2 | * | 1/2013 | Kasper et al. | 101/367 |
| 2006/0193985 | A1 | * | 8/2006 | McNeil et al. | 427/355 |
| 2012/0222567 | A1 | * | 9/2012 | McNeil et al. | 101/151 |

OTHER PUBLICATIONS

U.S. Appl. No. 14/291,604, filed May 30, 2014, Byrne, et al.
U.S. Appl. No. 14/291,664, filed May 30, 2014, Byrne, et al.
U.S. Appl. No. 14/291,691, filed May 30, 2014, Byrne, et al.
U.S. Appl. No. 14/291,757, filed May 30, 2014, Byrne, et al.
U.S. Appl. No. 14/291,823, filed May 30, 2014, Byrne, et al.

* cited by examiner

CUSTOMIZABLE APPARATUS AND METHOD FOR TRANSPORTING AND DEPOSITING FLUIDS

FIELD OF THE INVENTION

The present invention relates to equipment and methods for depositing a fluid or a plurality of fluids onto a substrate. More particularly, the invention relates to equipment and methods for printing fluids on moving substrates.

BACKGROUND OF THE INVENTION

Manufacturers of consumer goods often apply colors or performance fluids (such as lotion, adhesives, softeners and the like) to their products. For example, paper towel, toilet tissue, and/or facial tissue products often incorporate printed patterns, softening agents and the like. Likewise, the packaging for consumer products (e.g., films, cardboards, etc.) incorporate printed patterns or performance fluids. To date, manufacturers have mostly relied on a single printing apparatus, such as roll, to apply a single fluid. Moreover, manufacturers are plagued with challenges related to their inability to precisely control fluid flow and application at high processing rates. Manufacturers may use moving rolls having primarily axial fluid flow and/or primarily circumferential fluid flow which results in uneven fluid distribution and lack of fluid reaching parts of the rolls. In addition, such designs limit the number and sizes of fluid channels that may be incorporated into the device and limit the location of the fluid orifices stemming from those channels in a way that undermines precision. Alternatively, manufacturers use printing plates and flat surfaces, which result in slower processing or imprecision when running at high rates as the printing plate may not be able to keep up with the moving substrate.

Known devices also suffer from imprecise registration, overlaying and blending of fluids. Because a single device is often used for a single fluid, registration, overlaying, and blending between multiple fluids requires the use of more than one device. The inherent imprecision in each known device results in imprecision when trying to register (etc.) their respective fluids. Indeed, because the inability to control fluid flow and application and other factors in each device, known devices often are not able to precisely register fluids with other fluids or product features such as embossments or sealing areas.

Further, manufacturers are faced with higher production costs and resources due to their inability to separately control different fluids in one printing device.

Therefore, there is a need for an apparatus for depositing more than one fluid on a substrate. Further, there is a need for a controllable and/or customizable apparatus for depositing fluid(s) that permits more precise fluid deposition. Further still, there is a need for an efficient process for, and decreased manufacturing costs associated with, depositing one or more fluids on a substrate.

SUMMARY OF THE INVENTION

A system for depositing a fluid on a substrate is disclosed. The system can include a sleeve having a sleeve exit and an inner region and a rotating roll disposed within the inner region. The rotating roll can include a central longitudinal axis, the roll rotating about the central longitudinal axis, and an exterior surface that substantially surrounds the central longitudinal axis and defines an interior region. A vascular network can be disposed within the interior region, the vascular network being configured for transporting the fluid in predetermined paths from the interior region to the exterior surface and comprising a main artery, a tree comprising a first capillary, and a fluid exit disposed on the exterior surface wherein the main artery comprises an inlet and is substantially parallel to the central longitudinal axis of the rotating roll. The fluid can enter the vascular network at the inlet. The first capillary can be associated with the main artery and can be in fluid communication with the main artery and the sleeve exit through a substantially radial path, the substantially radial path ending at an exit point of the fluid exit, wherein the exit point is associated with the sleeve exit.

DETAILED DESCRIPTION OF THE INVENTION

Definitions

Figure 1:
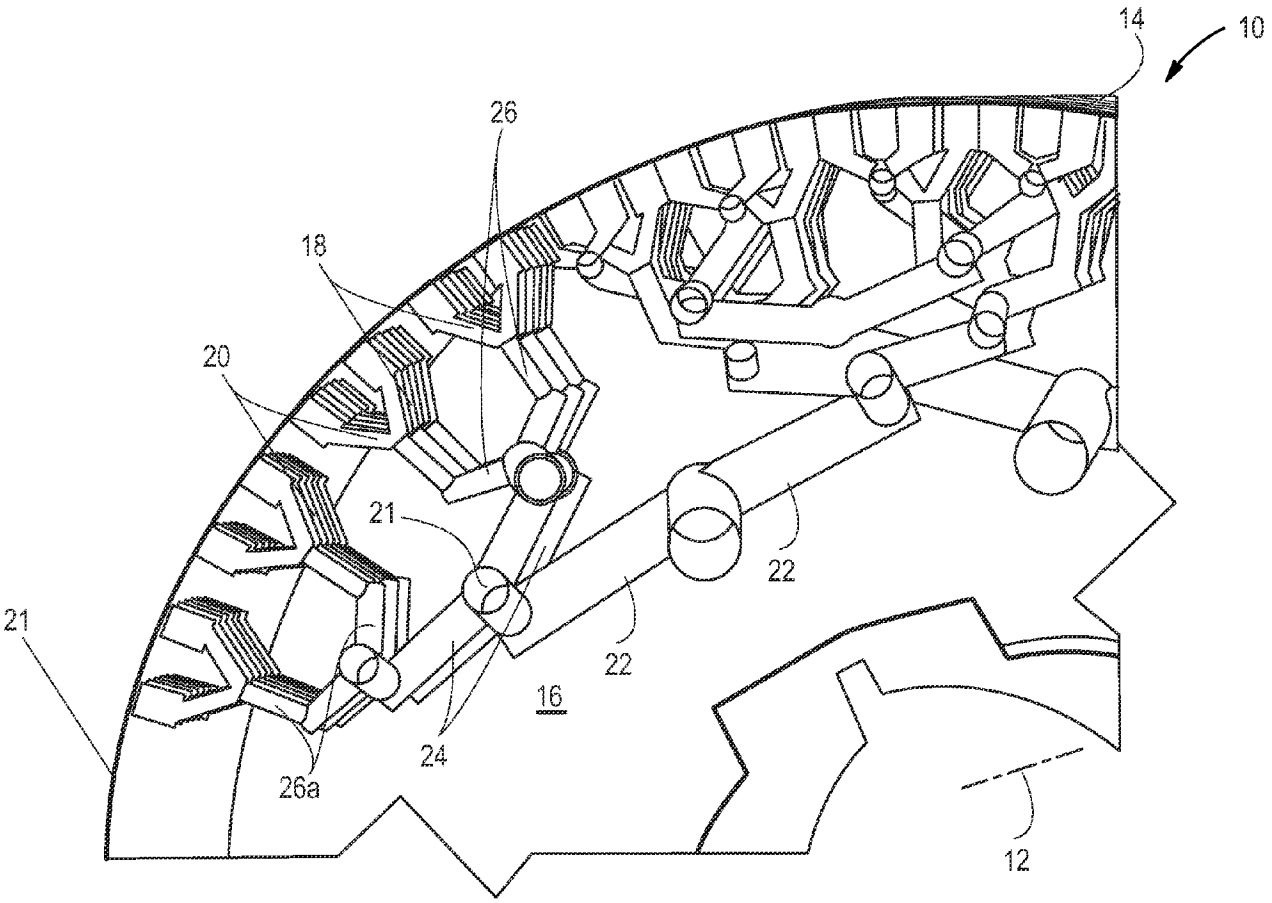
FIG. 1 is a perspective view of a rotating roll in accordance with one embodiment of the present invention.

As used herein, the "aspect ratio" of a shape is the ratio of the length of the longest dimension or diameter of the shape, in any direction, that intersects the shape's midpoint and length of the shortest dimension or diameter of the shape, in any direction, that intersects the shape's midpoint.

"Vascular network" as used herein means a network of channels that carry fluid from an entry, such as an inlet, to one or more exits. The channels include one or more main arteries, one or more capillaries, and/or one or more sub-capillaries. In the vascular network, each channel may be in fluid communication with another channel. In general, the entry may be at or near the main artery, and the main artery may be in direct fluid communication (i.e., without intermediate channels) with a capillary. Likewise, a capillary may be in direct fluid communication with a main artery, another capillary, and/or a sub-capillary, and/or a fluid exit (all of which are discussed more fully below). Capillaries may extend from a main artery and connect with a sub-capillary or divide into a series of sub-capillaries. In one embodiment, the cross-sectional area of a main artery is larger than that of a capillary to which the main artery is connected. In another embodiment, the cross-sectional area of a capillary is larger than that of a sub-capillary to which the capillary is connected. In some respects, the vascular network of the present invention is analogous to a biological vascular network. However, the vascular network of the present invention is not a biological system.

In an embodiment, one path from the entry to an exit is substantially radial. In other words, the vascular network carries a fluid in a substantially radial direction.

"Radial" or "radially" as used herein refers to the direction of radii in a circular, spherical, cylindrical or similar shaped object. In other words, if an element is described as extending radially herein, that element extends from an inner portion (including the center) of an object outward to an external portion, including the perimeter or outer boundary or surface of that object. Radial and radially as used herein are distinguished from circumferentially, wherein an element so described would extend about the center of a spherical, cylindrical or similar shaped object such that the element would mimic the circumference or perimeter of the object. Likewise, radial and radially is distinguished from axially, wherein an element so described would extend in a direction parallel or substantially parallel to the longitudinal axis of the object.

Elements described as extending "substantially radially" or being "substantially radial" may have axial or circumferential components. However, a substantially radial element as described herein means that the element has a radial vector greater than its axial or circumferential vectors. Visually, in the aggregate, a substantially radial element (which may be a tree 23 or a fluid path 48) extends in a radial direction more than it extends in an axial or circumferential manner.

"Fluid" as used herein means a substance, as a liquid or gas, that is capable of flowing and that changes its shape at a steady rate when acted upon by a force tending to change its shape. Exemplary fluids suitable for use with the present disclosure include inks; dyes; emulsions such as oil and water emulsions; softening agents; cleaning agents; dermatological solutions; wetness indicators; adhesives; botanical compounds (e.g., described in U.S. Patent Publication No. US 2006/0008514); skin benefit agents; medicinal agents; lotions; fabric care agents; dishwashing agents; carpet care agents; surface care agents; hair care agents; air care agents; actives comprising a surfactant selected from the group consisting of: anionic surfactants, cationic surfactants, nonionic surfactants, zwitterionic surfactants, and amphoteric surfactants; antioxidants; UV agents; dispersants; disintegrants; antimicrobial agents; antibacterial agents; oxidizing agents; reducing agents; handling/release agents; perfume agents; perfumes; scents; oils; waxes; emulsifiers; dissolvable films; edible dissolvable films containing drugs, pharmaceuticals and/or flavorants. Suitable drug substances can be selected from a variety of known classes of drugs including, for example, analgesics, anti-inflammatory agents, anthelmintics, antiarrhythmic agents, antibiotics (including penicillin), anticoagulants, antidepressants, antidiabetic agents, antipileptics, antihistamines, antihypertensive agents, antimuscarinic agents, antimycobacterial agents, antineoplastic agents, immunosuppressants, antithyroid agents, antiviral agents, anxiolytic sedatives (hypnotics and neuroleptics), astringents, beta-adrenoceptor blocking agents, blood products and substitutes, cardiac inotropic agents, corticosteroids, cough suppressants (expectorants and mucolytics), diagnostic agents, diuretics, dopaminergics (antiparkinsonian agents), haemostatics, immunological agents, lipid regulating agents, muscle relaxants, parasympathomimetics, parathyroid calcitonin and biphosphonates, prostaglandins, radiopharmaceutical, sex hormones (including steroids), anti-allergic agents, stimulants and anorexics, sympathomimetics, thyroid agents, PDE IV inhibitors, NK3 inhibitors, CSBP/RK/p38 inhibitors, antipsychotics, vasodilators and xanthines; and combinations thereof.

"Register" as used herein means to spatially align an article, including but not limited to a fluid, with another article, such as another fluid, or with a particular area or feature of a substrate.

"Overlay" as used herein means to place a fluid on top of another fluid. For example, a blue fluid may overlay a yellow fluid, producing a green image.

"Blend" as used herein means to place fluids, such as inks of different shades, close to one another, such that the fluids visually appear to mix (creating a different shade or hue in the case of inks).

"Operative relationship" as used herein in reference to fluid transmission between two articles (e.g., a roll and a substrate) means that the articles are disposed such that the fluid is transmitted through actual contact between the articles, close proximity of the articles and/or other suitable means for the fluid to be deposited.

"Paper product," as used herein, refers to any formed, fibrous structure product, traditionally, but not necessarily, comprising cellulose fibers. In one embodiment, the paper products of the present invention include sanitary tissue products. A paper product may be made by a process comprising the steps of forming an aqueous papermaking furnish, depositing this furnish on a foraminous surface, such as a Fourdrinier wire, and removing the water from the furnish (e.g., by gravity or vacuum-assisted drainage), forming an embryonic web, transferring the embryonic web from the forming surface to a transfer surface traveling at a lower speed than the forming surface. The web is then transferred to a fabric upon which it is dried to a final dryness after which it is wound upon a reel. Paper products may be through-air-dried.

"Product feature" as used herein means structural or design features that are applied to or formed on a substrate prior to or after use of the apparatuses or methods described herein. Product features may include, for example, embossments, wet-formed textures, addition of fibers such as by flocking, apertures, perforations, printing, registration marks and/or other fluid deposits.

"Micro-reservoir" as used herein means a structure having a void volume capable of collecting and/or holding less than about 1000 $mm^3$, or less than 512 $mm^3$, or less than 125 $mm^3$, or less than 75 $mm^3$, or less than 64 $mm^3$, or less than 50 $mm^3$ of one or more fluids and supplying the fluids to one or more exits. In one nonlimiting example, the micro-reservoir operates as a reverse funnel, being smaller in the area where fluid enters the micro-reservoir than the area where the fluid leaves the micro-reservoir. The micro-reservoir can serve as a single fluid supply region for one or more fluid exits or sleeve exits (both types of exits described in more detail below), minimizing the number of channels required to supply a given number of exits. In addition, the micro-reservoir may be disposed under an exterior surface or a sleeve.

"Sanitary tissue product" as used herein means one or more fibrous structures, converted or not, that is useful as a wiping implement for post-urinary and post-bowel movement cleaning (bath tissue), for otorhinolaryngological discharges (facial tissue and/or disposable handkerchiefs), and multi-functional absorbent and cleaning uses (absorbent towels and/or wipes). Sanitary tissue products used in the present invention may be single or multi-ply.

"Substrate" as used herein includes products or materials on which indicia or fluids may be deposited, imprinted and/or substantially affixed. Substrates suitable for use and within the intended scope of this disclosure include single or multi-ply fibrous structures, such as paper products like sanitary tissue products. Other materials are also intended to be within the scope of the present invention as long as they do not interfere or counteract any advantage presented by the instant invention. Suitable substrates may include films, foils, polymer sheets, cloth, wovens or nonwovens, paper, cellulose fiber sheets, co-extrusions, laminates, high internal phase emulsion foam materials, and combinations thereof. The properties of a selected material can include, though are not restricted to, combinations or degrees of being: porous, non-porous, microporous, gas or liquid permeable, non-permeable, hydrophilic, hydrophobic, hydroscopic, oleophilic, oleophobic, high critical surface tension, low critical surface tension, surface pre-textured, elastically yieldable, plastically yieldable, electrically conductive, and electrically non-conductive. Such materials can be homogeneous or composition combinations. Additionally, absorbent articles (e.g., diapers and catamenial devices) may serve as suitable substrates. In the context of absorbent articles in the form of diapers, printed web materials may be used to produce components such as backsheets, topsheets, landing zones, fasteners, ears, side panels, absorbent cores, and acquisition layers. Descriptions of absorbent articles and components thereof can be found in U.S. Pat. Nos. 5,569,234; 5,702,551; 5,643,588; 5,674,216; 5,897,545; and 6,120,489; and U.S. Patent Publication Nos. 2010/0300309 and 2010/0089264.

Substrates suitable for the present invention also include products suitable for use as packaging materials. This may include, but not be limited to, polyethylene films, polypropylene films, liner board, paperboard, carton materials, and the like.

Overview

Figure 2:
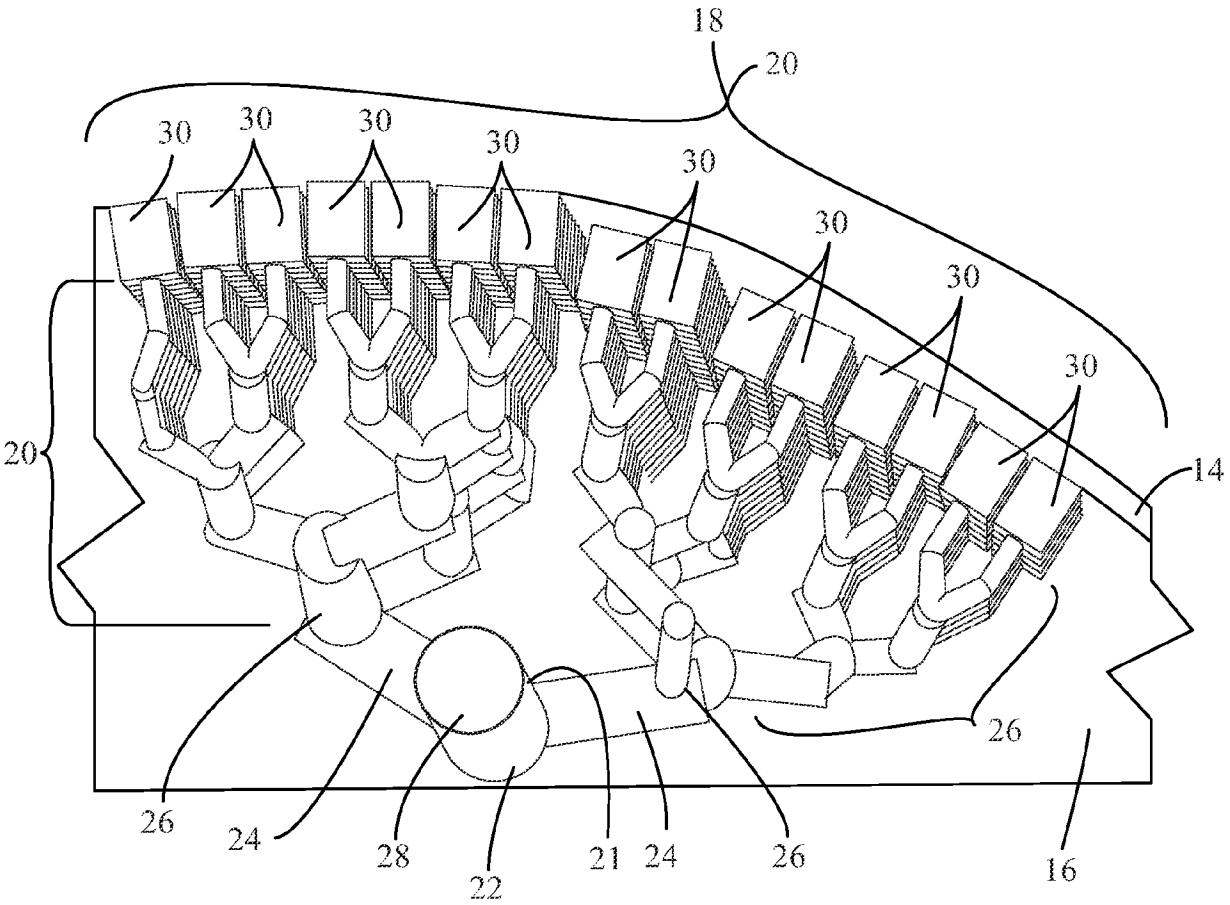
FIG. 2 is a partial perspective view of a rotating roll and vascular network in accordance with one embodiment of the present invention.

FIG. 1 depicts a rotating roll 10 in accordance with one embodiment of the present invention. The rotating roll 10 may have a central longitudinal axis 12, about which the roll 10 may rotate, an exterior surface 14 and an interior region 16 defined and bounded by the exterior surface 14. The rotating roll 10 may further comprise a vascular network 18 of channels 20 for transmitting fluids from the interior region 16 of the roll 10 to the exterior surface 14. Turning to FIG. 2, the channels 20 may comprise a main artery 22, capillaries 24 and sub-capillaries 26. The main artery 22 may be associated with one or more capillaries 24 which extend from the main artery 22 at a junction 21. Each capillary 24 may be associated with one or more sub-capillaries 26. In one embodiment, a capillary 24 may divide into a series of sub-capillaries 26. The channels 20 may each be enclosed substantially cylindrical elements having generally uniform cross-sections along their respective lengths.

The channels 20 may be associated by any suitable means, such as gluing, welding or similar attachment operation or may be integrally formed with one another, or combinations thereof. Further, each point of association between channels 20 may comprise a junction 21. The junction 21 may be formed to provide a smooth transition from one channel 20 to another in order to prevent turbulence. A smooth transition may be achieved for example by rounding the edges of the junction 21 or associating the channels 20 such that they are not aligned end-to-end creating a sharp edge, such as a 90 degree angle. In other words, the channels 20 may be associated away from one or both of their ends. If turbulence is desired, the junction 21 may be provided with more jagged edges. One of skill in the art will recognize how to design the junction 21 to achieve the desired fluid flow.

Figure 2A:
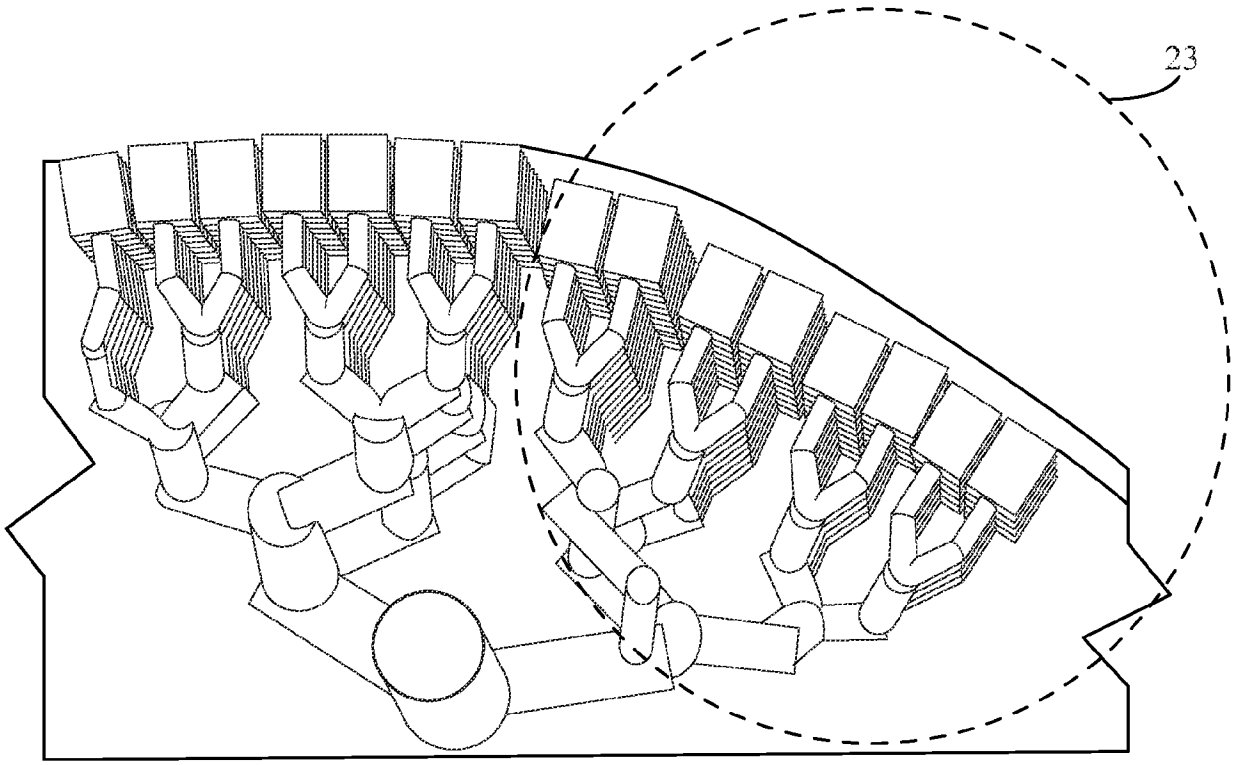
FIG. 2A is a partial perspective view of a rotating roll and vascular network in accordance with one embodiment of the present invention with a nonlimiting example of a tree encircled.

Still referring to FIG. 2, the vascular network 18 may begin at an inlet 28 in the main artery 22 and terminate in a plurality of fluid exits 30 on the exterior surface 14. Fluid may flow through the vascular network 18, entering at an inlet 28, traveling from the main artery 22 to the capillaries 24 and sub-capillaries 26 (if any) to a fluid exit 30. In other words, the channels 20 may be in fluid communication with one another. The main artery 22 may be in fluid communication with one or more capillaries 24, and each capillary 24 may be in fluid communication with one or more fluid exits 30. In one nonlimiting example, each capillary 24 is in fluid communication with at least two fluid exits 30. In another nonlimiting example, each capillary 24 is in fluid communication with one or more sub-capillaries 26, and each sub-capillary 26 is in fluid communication with one or more exits 30. The vascular network 18 essentially has one or more trees, 23 as depicted in FIG. 2A. Each tree 23 begins with a capillary 24 and may extend—directly or through one or more sub-capillaries 26—in a substantially radial manner to the exterior surface 14 and/or a fluid exit 30.

Figure 3:
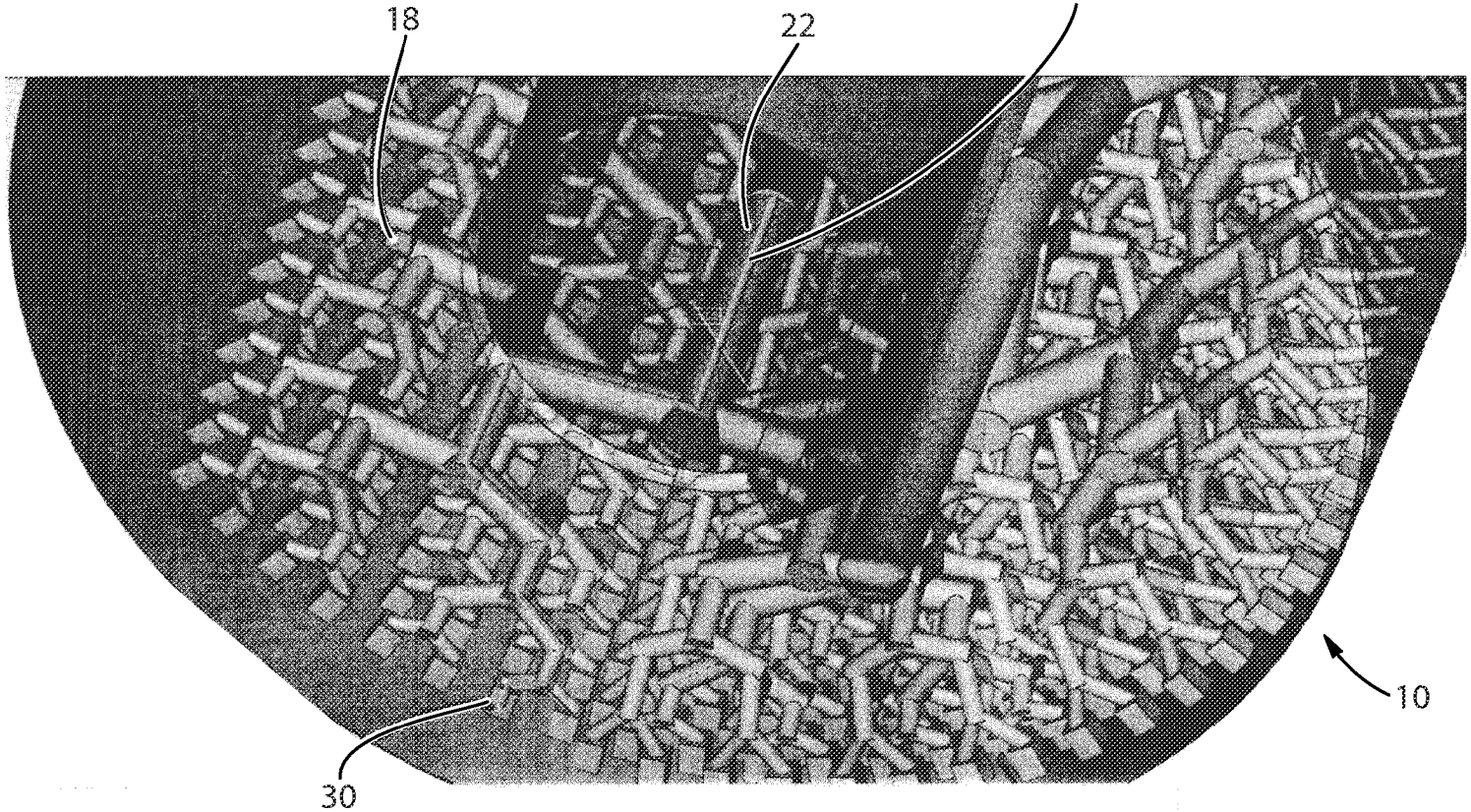
FIG. 3 is a partial perspective view of a rotating roll and vascular network in accordance with one embodiment of the present invention.

Importantly, as shown in FIG. 3, the vascular network 18 is designed to transport fluid in one or more predetermined paths 48 from the interior region 16 to a specified location on the exterior surface 14. Moreover, the predetermined paths 48 are substantially radial. Multiple substantially radial paths may be designed into the vascular network 18. The paths will be similar in that all are substantially radial. However, the substantially radial paths will differ in that they will have different starting or ending points.

The Vascular Network & Predetermined Path

As noted above, the vascular network 18 may be disposed within the interior region 16 of the rotating roll 10 and comprise a plurality of channels 20 (i.e., main artery 22, capillaries 24 and/or sub-capillaries 26). The vascular network 18 may comprise a main artery 22. The main artery 22 may comprise an inlet 28, where fluid enters the network 18. The inlet 28 may be disposed at any location suitable for permitting fluid to enter the vascular network 18.

Figure 4:
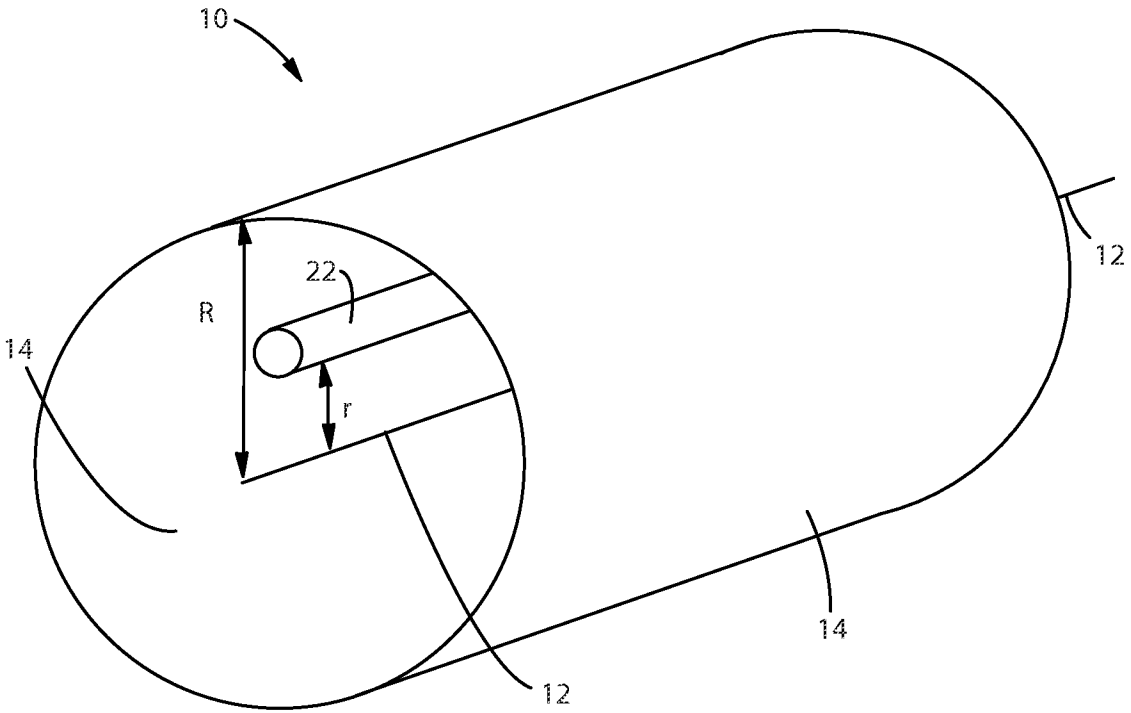
FIG. 4 is a schematic view of a rotating roll and main artery in accordance with one embodiment of the present invention.

As shown in FIG. 3, which shows one exemplary pathway of fluid flow 25, the main artery 22 may be positioned coincident with the central longitudinal axis 12 that runs through the rotating roll 10. Alternatively, the main artery 22 may be substantially parallel to the central longitudinal axis 12 though not coincident. In one nonlimiting example depicted in FIG. 4, the main artery 22 is substantially parallel to the central longitudinal axis 12 and positioned a radial distance, r, from the central longitudinal axis 12. In such nonlimiting example, the radial distance, r, is greater than 0, which permits higher rotational speeds. Radial distance, r, may be measured from the longitudinal axis 12 outward to the closest point on the outer surface of the main artery 22, as shown in FIG. 4. The radial distance, r, is less than the radius of the roll, R, as measured in the same direction.

Figure 5:
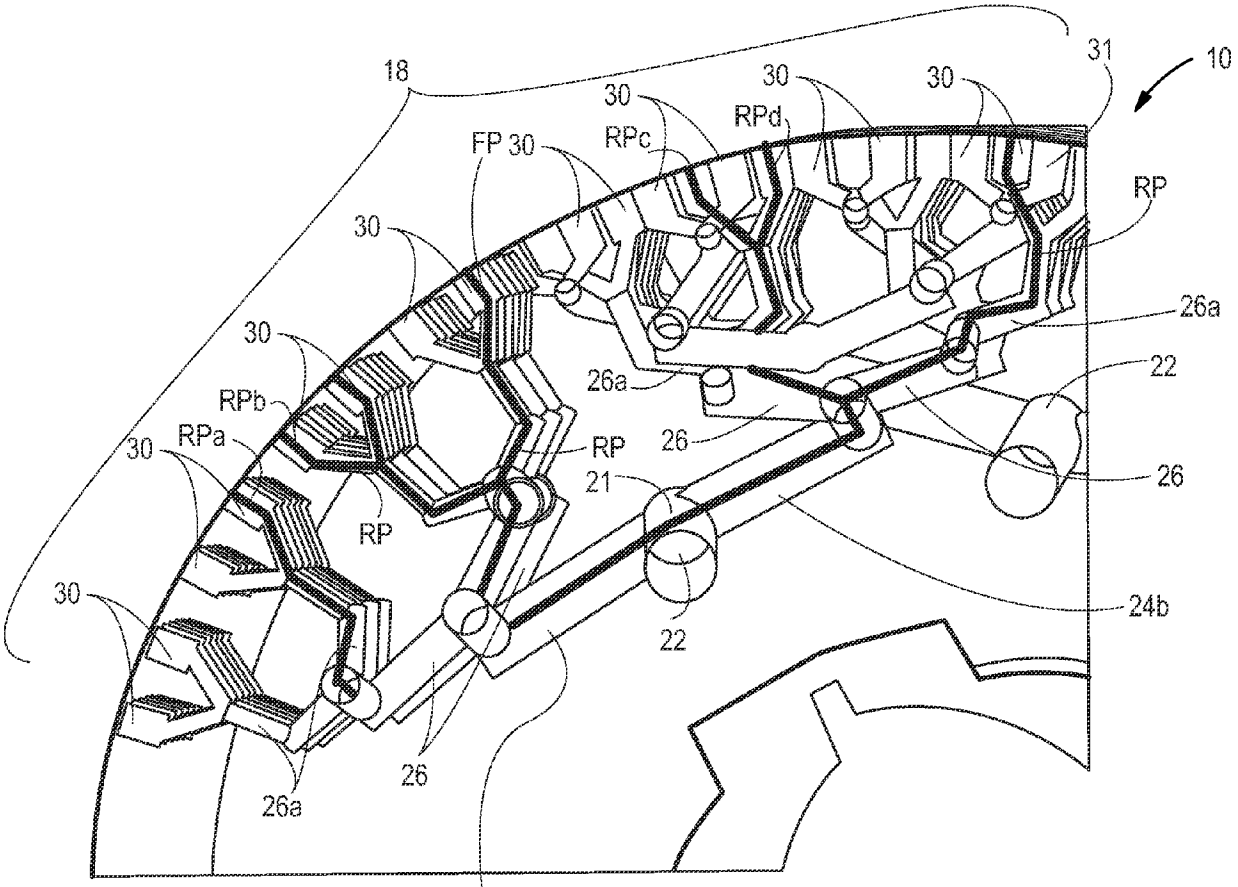
FIG. 5 is a partial perspective view of a rotating roll and vascular network in accordance with one embodiment of the present invention.

Turning to FIG. 5, the vascular network 18 may comprise a first capillary 24*a* which is associated with the main artery 22 at a junction 21. The first capillary 24*a* may be associated with the main artery 22 as discussed above. In one embodiment, the first capillary 24*a* is in fluid communication with the main artery 22 and a fluid exit 30 through a substantially radial path, RPa. In one nonlimiting example, the first capillary 24*a* in fluid communication with the main artery 22 and at least two fluid exits 30 through separate substantially radial paths, RPa and RPb.

Still referring to FIG. 5, the vascular network 18 may also comprise a second capillary 24*b*. The second capillary 24*b* may also be associated with the main artery 22. The second capillary 24*b* may be in fluid communication with the main artery 22 and one or more fluid exits 30 through one or more substantially radial paths. In one nonlimiting example, the second capillary 24*b* is in fluid communication with the main artery 22 and at least two fluid exits 30 through substantially radial paths, RPc and RPd.

Figure 6:
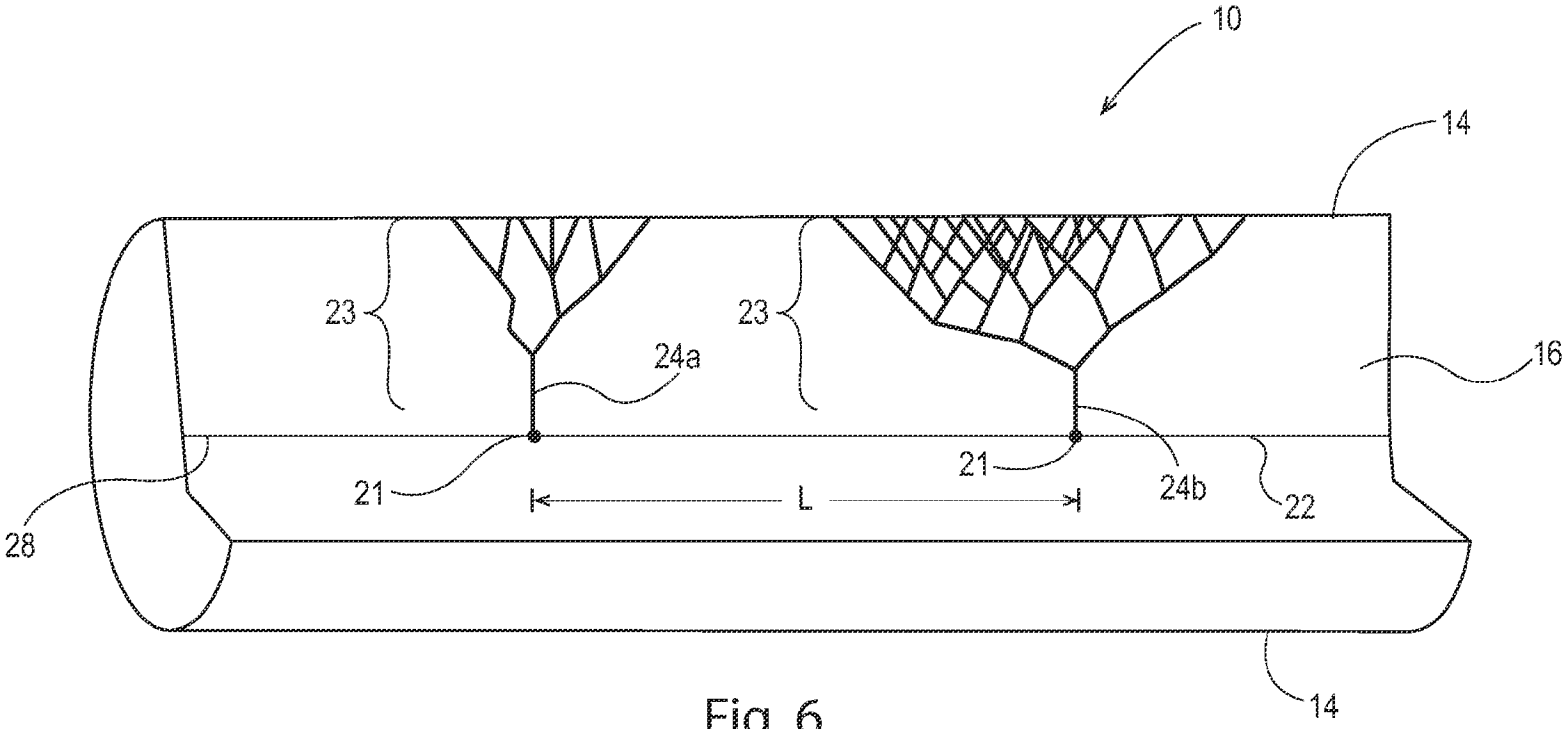
FIG. 6 is a schematic representation of the interior region of a rotating roll in accordance with one embodiment of the present invention.

Both the first capillary 24*a* and the second capillary 24*b* may be associated with the main artery 22 at a single junction 21 as shown in FIG. 5. Alternatively, the second capillary 24*b* may be spaced a longitudinal distance, L, from the first capillary 24*a* along the length of the main artery 22 as shown in FIG. 6. In such nonlimiting example, the first capillary 24*a* and the second capillary 24*b* are associated with the main artery 22 through separate junctions 21.

In one embodiment, the first capillary 24*a* is substantially symmetrical to the second capillary 24*b* with respect to the main artery 22. In one nonlimiting example, the main artery 22 has a cross-sectional area greater than a cross-sectional area of the first capillary 24*a*. In another nonlimiting example, the main artery 22 has a cross-sectional area greater than the cross-sectional area of the second capillary 24*b*. In yet another nonlimiting example, the main artery 22 has a cross-sectional area that is greater than the cross-sectional area of both the first capillary 24*a* and the second capillary 24*b*. The cross-sectional areas of the first capillary 24*a* and the second capillary 24*b* may be the same or may be different.

The vascular network 18 may also include a plurality of fluid exits 30 which may be disposed on the exterior surface 14 of the rotating roll 10. The first capillary 24*a* and the second capillary 24*b* may each be in fluid communication with one or more fluid exits 30. In an embodiment, one or both of the first and second capillaries 24*a*, 24*b* may be in fluid communication with the fluid exits 30 through a series of sub-capillaries 26 disposed on one or more branching levels of their respective trees 23. A capillary 24*a*, 24*b* may be associated with a sub-capillary 26 or may be associated with a plurality of sub-capillaries 26. Each sub-capillary 26 may associate with another sub-capillary 26*a* of a subsequent level or may associate with a plurality of sub-capillaries 26*a* on a subsequent level. In one nonlimiting example, a sub-capillary 26 has a cross-sectional area that is less than the cross-sectional area of a capillary 24 with which the sub-capillary 26 is associated. Likewise, a sub-capillary 26*a* in the subsequent level may have a cross-sectional area less than that of the sub-capillary 26 from which it extends.

Figure 7:
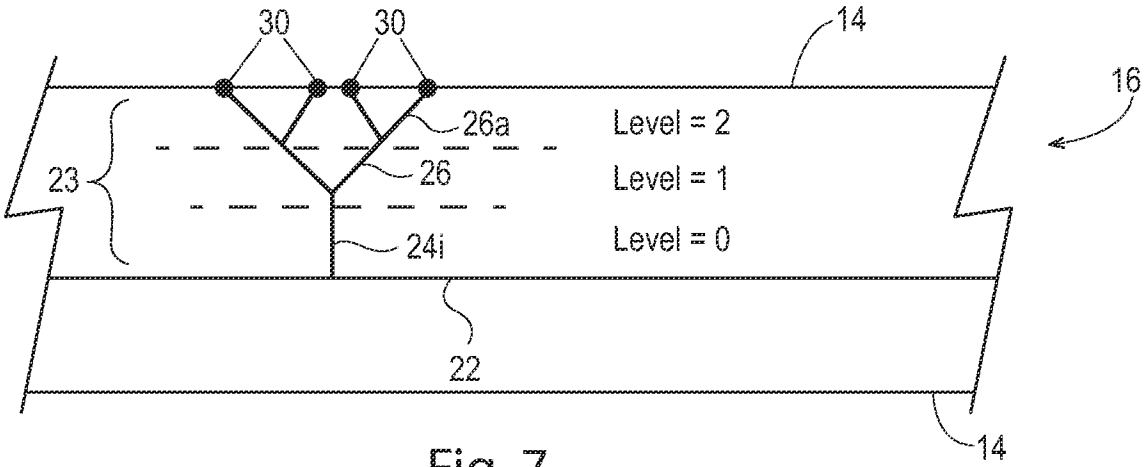
FIG. 7 is a schematic representation of an exemplary tree in a vascular network in accordance with one embodiment of the present invention.
Figure 7A:
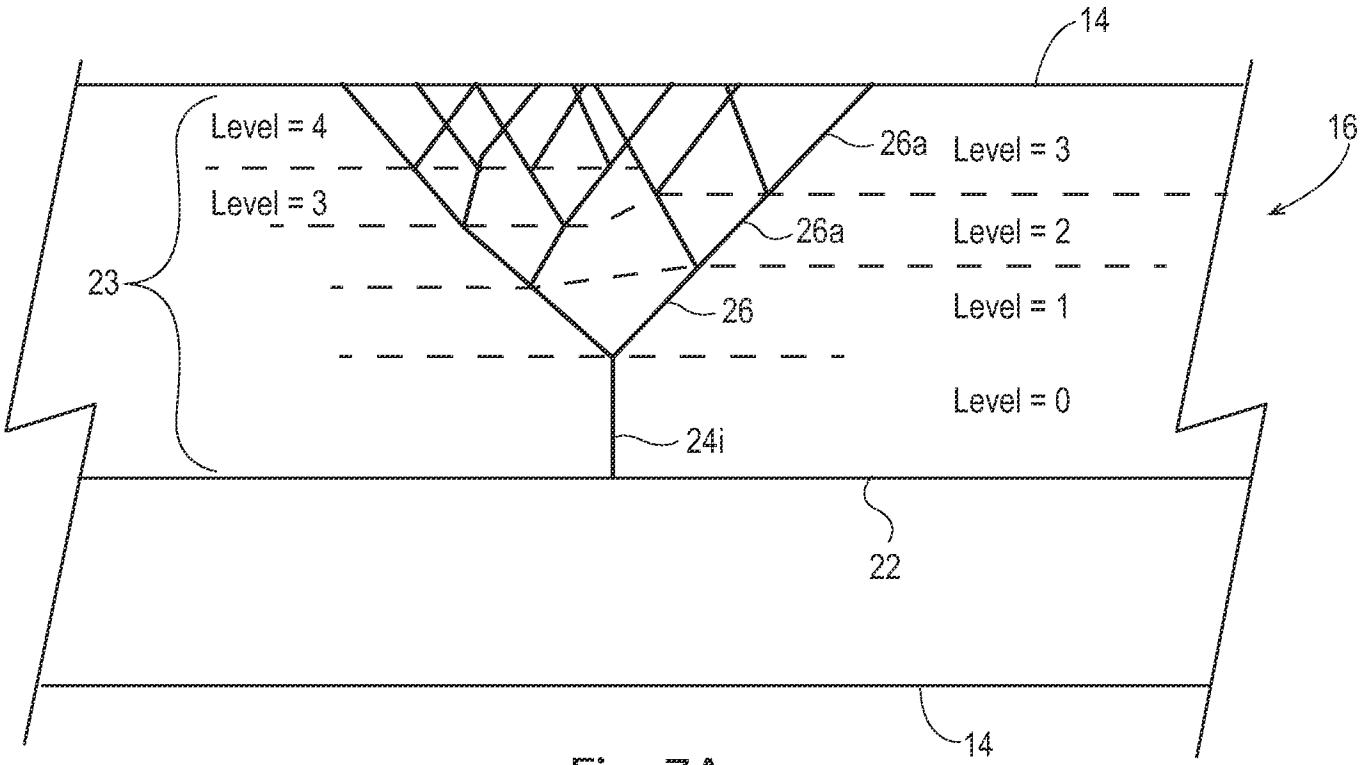
FIG. 7A is a schematic representation of another exemplary tree in a vascular network in accordance with one embodiment of the present invention.

Essentially (as shown in FIG. 7), the vascular network 18 may continue to divide, such that a given tree 23 has n levels of branching, where n is an integer and the starting level, level 0, occurs when an initial capillary $\mathbf{24}_i$ associates with the main artery 22. For example, as illustrated in FIG. 7, n=2. In another nonlimiting example, the tree 23 branches such that the number of fluid exits 30 ultimately in fluid communication with the main artery 22 and the initial capillary $\mathbf{24}_i$ of the tree 23 is equal to $2^n$. In another nonlimiting example, the vascular network 18 divides in accordance to constructal theory and/or vascular scaling laws, such as those disclosed in Kassab, Ghassan S., "Scaling Laws of Vascular Trees: of Form and Function", *Am. J. Physiol Heart Cir. Physiol,* 290: H894-H903, 2006. Trees 23 in the vascular network 18 may have the same number or different number of levels of branching. Moreover, within one tree 23 there may be different levels, as illustrated in FIG. 7A where n=4 on one branch and n=3 on another branch in one nonlimiting example.

In one embodiment, each capillary 24 or sub-capillary 26 on a given level has substantially the same length, diameter, volume and/or area. For example, the first capillary 24*a* and the second capillary 24*b* will both reside on the starting level and may have substantially the same length, diameter, volume and/or area. Alternatively, the capillaries 24 or sub-capillaries 26 on a given level may vary in length, volume and/or area.

In an embodiment, the channels 20 in the network 18 may be larger closer to the inlet 28 and may become smaller closer to the fluid exits 30. Said differently still, the main artery 22 may be larger in area and/or volume than the capillaries 24 extending from the main artery 22, and those capillaries 24 may be larger in area and/or volume than the sub-capillaries 26 extending therefrom. Reducing the area and/or volume at each level can facilitate the movement of fluid to the exits 30 while maintaining a desired flow rate and/or pressure.

Figure 8:
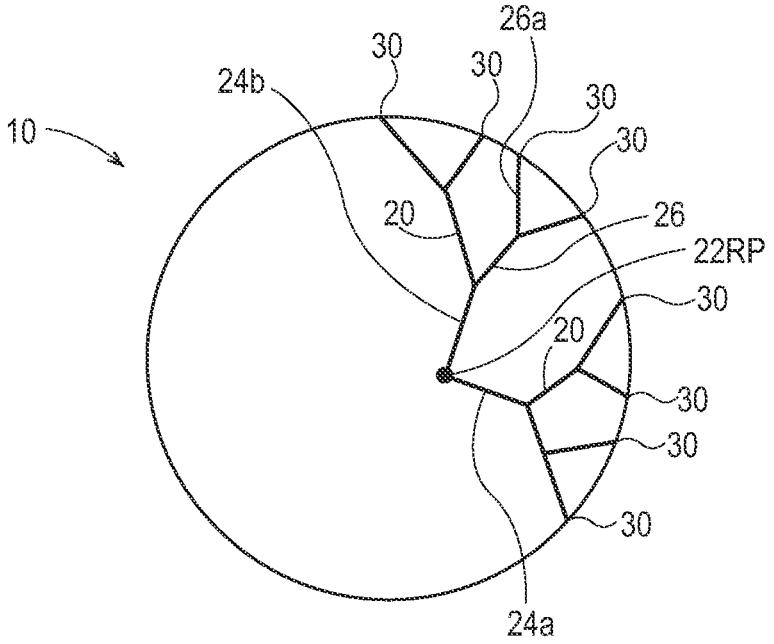
FIG. 8 is a schematic representation of a rotating roll and vascular network in accordance with one embodiment of the present invention.

In a further embodiment, as for example in depicted schematically in FIG. 8, the capillaries 24, 24*a*, 24*b* and/or sub-capillaries 26, 26*a* of a tree 23, in the aggregate, extend to the fluid exits 30 in a substantially radial direction. In one nonlimiting example, the capillaries 24, 24*a*, 24*b* extend radially or substantially from the main artery 22. In another nonlimiting example, at least half of the sub-capillaries 26, regardless of what level in which they reside, extend substantially radially with respect to the main artery 22. "Extend substantially radially with respect to the main artery 22" means that although a sub-capillary 26 is not in direct connection with the main artery 22, the sub-capillary 26 visually extends in a substantially radial manner from a reference point on the main artery 22RP. Although FIG. 8 is necessarily limited to a depiction of two-dimensions, the principle applies in three-dimensions. In yet another nonlimiting example, the sub-capillaries 26 on the $n^{th}$ level extend substantially radially with respect to the main artery 22 to fluid exits 30 on the exterior surface 14. In still another nonlimiting example, the sub-capillaries 26 on the nth level extend substantially radially from a sub-capillary 26 or capillary 24 on the (n−1) level to fluid exits 30 on the exterior surface 14. In another nonlimiting example, the capillaries 24 and series of sub-capillaries 26 in the aggregate may extend substantially radially from the capillary 24 and/or with respect to the main artery 22. Said differently, the majority of capillaries 24 and sub-capillaries 26 extend in a substantially radial direction.

The fluid exits 30 may be openings of any size or shape suitable to permit fluid to exit the vascular network 18 in a controlled manner as dictated by the particular fluid being deposited, the substrate on which it is being deposited, and the amount and placement of the fluid on the substrate, all of which can be predetermined by the skilled person. In an embodiment, an even number of fluid exits 30 are disposed on the exterior surface 14. In one nonlimiting example, the fluid exits 30 have an aspect ratio of at least 10. The aspect ratio is typically the ratio between the depth of the exit 30 (in the z-direction) and a dimension or diameter located in the x-y plane of the exit 30 on the surface 14. In another nonlimiting example, the diameter or the longest dimension of the fluid exit 30 on the exterior surface 14 is less than about 500 microns or less than about 250 microns or less than about 100 microns or less than about 10 microns. By limiting the area of the fluid exits 30, the flow of fluid and/or the fluid deposition may be controlled more precisely.

Figure 9A:
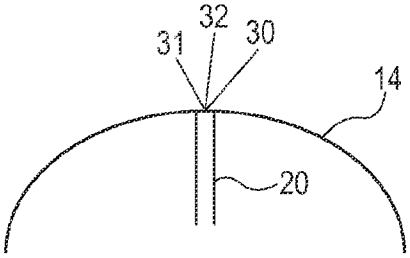
FIGS. 9A-9E are schematic representations of fluid exits and channels in accordance with nonlimiting examples of the present invention.
Figure 9B:
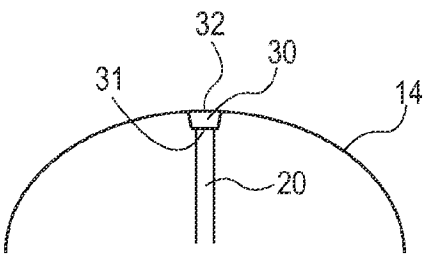
Figure 9C:
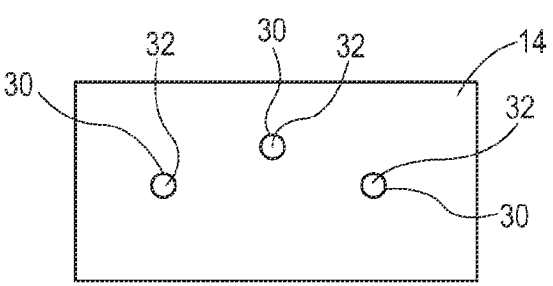
Figure 9D:
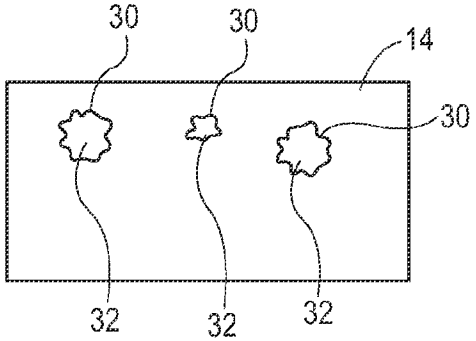
Figure 9E:
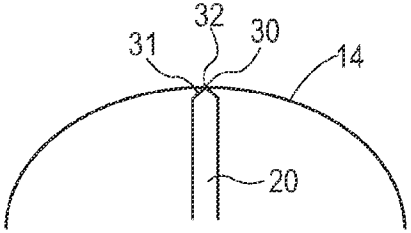

Each fluid exit 30 may comprise an entry point 31 and an exit point 32. In one nonlimiting example, the entry point 31 and the exit point 32 are conterminous, that is, the respective capillary 24 or sub-capillary 26 simply ends at an opening on the exterior surface 14 (as shown in FIG. 9A). In another embodiment, the entry point 31 and exit point 32 are not conterminous, that is, the respective capillary 24 or sub-capillary 26 ends at the entry point 31 and the fluid exit 30 has a shape and volume that includes the exit point 32 (e.g., FIG. 9B). The entry point 31 and the exit point 32 may be of any shape suitable to permit the flow of fluid. Non-limiting examples include circular, elliptical and like shapes. In one nonlimiting example, the longest dimension of the exit point 32 on the surface 14 may be less than 500 microns or less than 250 microns or less than 100 microns or less than 10 microns. Each of the entry point 31 and the exit point 32 may have a relatively uniform cross sectional areas (as shown in FIG. 9C) or may have cross-sectional areas that taper from one end to the other or change in any other desired way as shown in FIG. 9D. In addition, the channel 20 attached to the fluid exit 30 may be sloped, tapered (as shown in FIG. 9E) or otherwise designed to control fluid flow and/or enhance resolution and/or strength of the fluid exits 30.

Figure 10A:
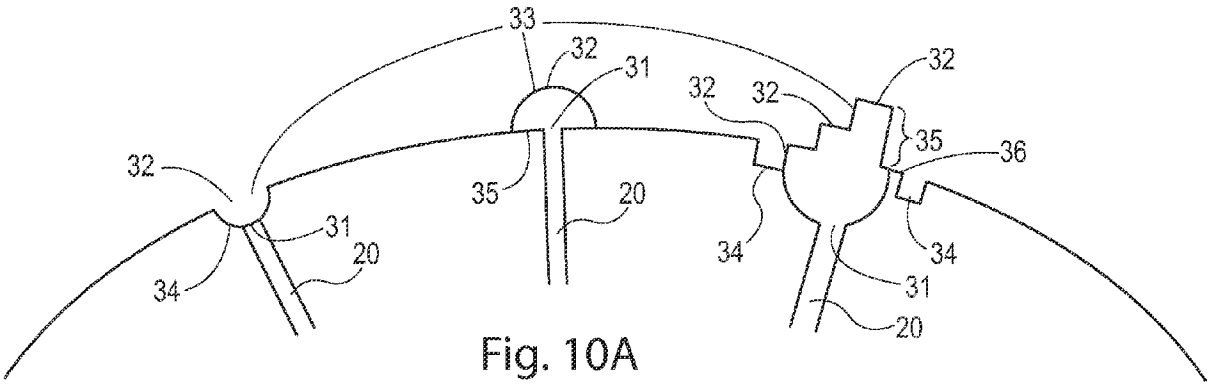
FIGS. 10A-10C are schematic representations of fluid exits in accordance with nonlimiting examples of the present invention.
Figure 10C:
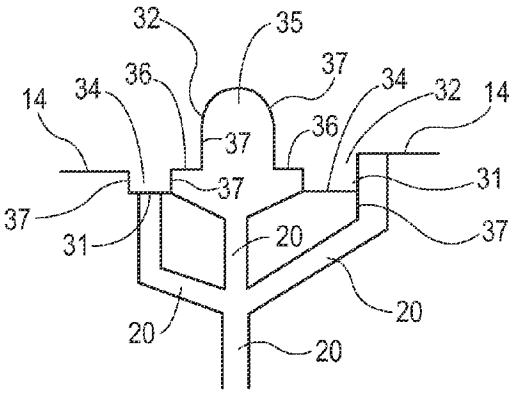
Figure 10B:
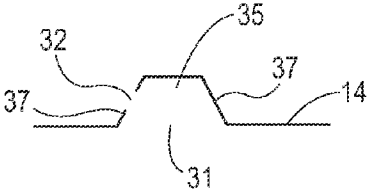

FIG. 10A depicts another embodiment, wherein the exterior surface 14 may comprise a differently radiused portion 33 such as a relieved portion 34 and/or a raised portion 35. The fluid exit 30 may be shaped to form or be otherwise associated with a differently radiused portion 33. In one nonlimiting example, a channel 20 is associated with a relieved portion 34 and the relieved portion 34 operates as a fluid exit 30. In one such example, the entry point 31 may comprise a cross-sectional area smaller than the cross-sectional area of the exit point 32 such that a pool of fluid may be provided in the relieved portion 34 and transferred to a substrate 50. One of skill in the art will recognize that the "pool" of fluid remains a small amount of fluid but may be a higher volume than fluid provided in other arrangements of the entry and exit points 31, 32. In another nonlimiting example, the fluid exit 30 may be shaped to form or otherwise associate with a raised portion 35. In one such example, the raised portion 35 extends in the z-direction such that it is higher than adjacent regions of the surface 14. Further, the differently radiused portion 33 may comprise both a relieved portion 34 and a raised portion 35. The fluid exit 30 can comprise three or more radial surfaces including a base 36 (substantially flush with the majority of the adjacent exterior surface 14), a raised portion 35, and a relieved portion 34. As shown in FIGS. 10B and 10C, the differently radiused portions 33 comprise a plurality of sides 37. One or more of the sides 37 may comprise an exit point 31. In other words, the exit point 32 may be disposed on the side 37 of a differently radiused portion 33. Likewise, if desired, the entry point 31 may be disposed on a side 37 of a differently radiused portion 33 as shown in FIG. 10C. Any combination of arrangements of fluid exit 30 designs may be provided. In addition, one or more channels 20 may be associated with a differently radiused portion 33.

Figure 11B:
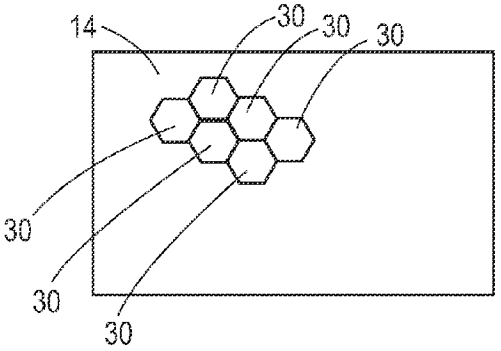
FIGS. 11A-11D are schematic representations of fluid exits in accordance with nonlimiting examples of the present invention.
Figure 11D:
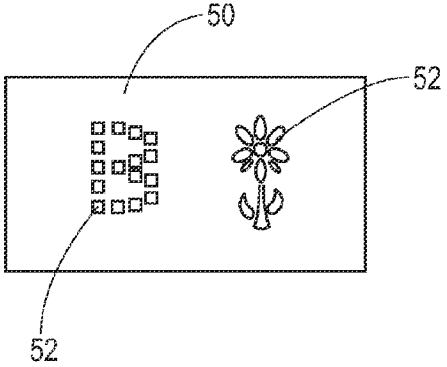
Figure 11A:
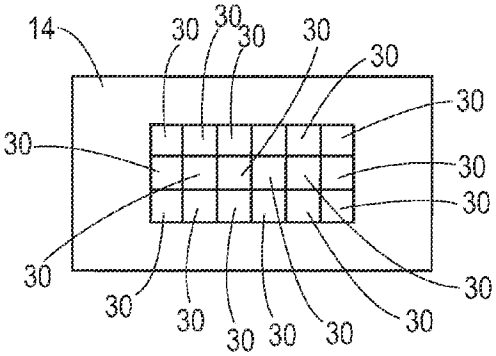
Figure 11C:
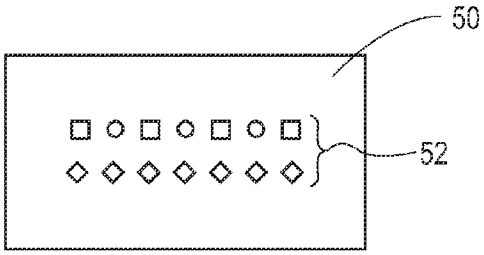

The fluid exits 30 may be arranged in any desired manner, with the only constraint being the physical space. If desired, fluid exits 30 may be placed as close as the physical space allows as shown in FIGS. 11A and 11B. In an alternative embodiment, the fluid exits 30 collectively may form a pattern 52 to be deposited on a substrate 50, such as the pattern 52 depicted on FIGS. 11C and 11D. In one nonlimiting example (shown in FIG. 11C), the fluid exits 30 are arranged such the pattern 52 is a line or plurality of lines. In another nonlimiting example (shown in FIG. 11D), the fluid exits 30 are arranged such that the pattern 52 is letter and/or aesthetic design and the fluid may comprise one or more inks.

Figure 12:
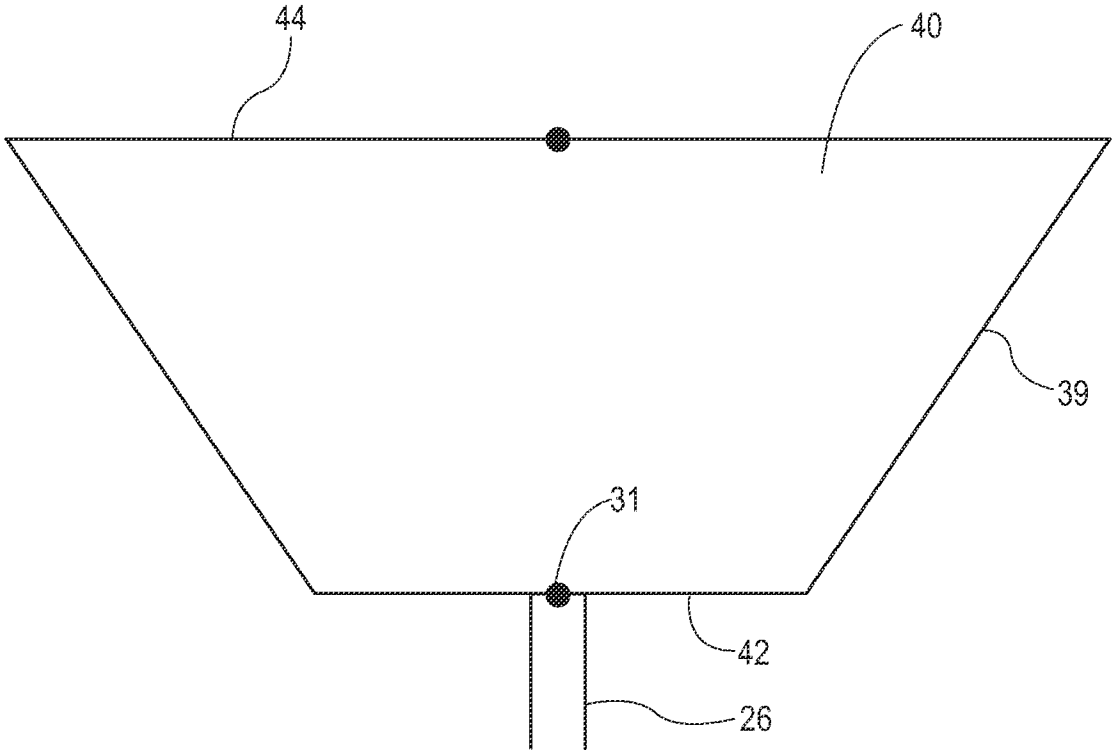
FIG. 12 is a schematic representation of one nonlimiting example of a micro-reservoir in accordance with the present invention.

In another nonlimiting example, one or more of the fluid exits 30 comprise a micro-reservoir 39. Fluid may collect within an inner portion 40 of the micro-reservoir 39, hold fluid until eventual deposition on a substrate, and/or supply fluid to one or more fluid exits 30 (or sleeve exits 120 as discussed in more detail below). The micro-reservoir 39 may be in any shape suitable for the collection and/supply of fluid to one or more exits 30, 120. Nonlimiting examples of suitable shapes include cubic, polygonal, prismatic, round or elliptical. In another nonlimiting example, the micro-reservoir 39 is in the shape of an isosceles trapezoid as shown in FIG. 12, which shape permits finer print resolution (when the fluid used is ink or the like) as well as contributes to roll 10 strength. The micro-reservoir 39 may have a volume from about 8 $mm^3$ to about 1000 $mm^3$ and every integer value therebetween.

Figure 13B:
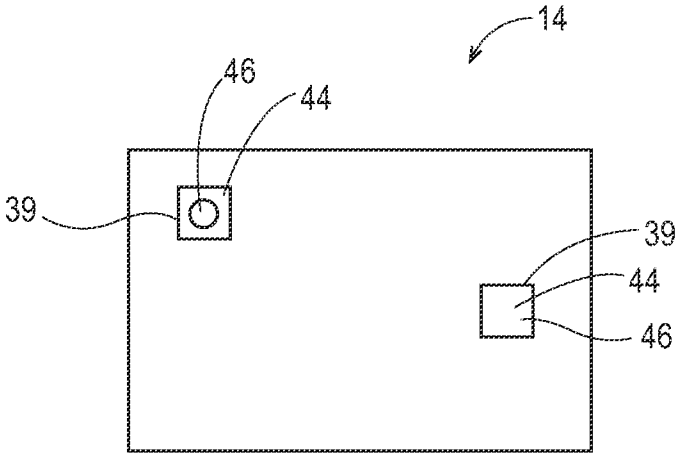
FIGS. 13A-13C are schematic representations of micro-reservoirs in accordance with nonlimiting examples of the present invention.
Figure 13A:
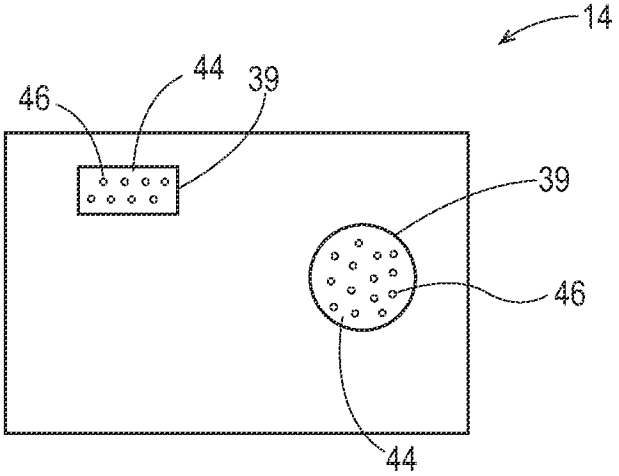
Figure 13C:
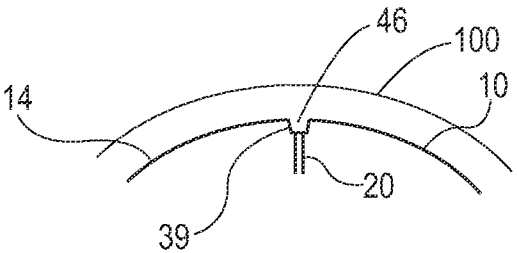

As depicted in FIG. 12, the micro-reservoir 39 may have a first side 42 and a second side 44 substantially opposite the first side 42. The first side 42 may be associated with a capillary 24 or sub-capillary 26. The first side 42 may further comprise a single entry point 31 through which fluid enters. The second side 44 may be associated with or integral with the exterior surface 14 as shown in FIGS. 13A-13C. In one embodiment, shown in FIG. 13A, the second side 44 comprises a plurality of discrete openings 46 which serve as exit points 32. In other words, the inner portion 40 may be at least partially hollow and the second side 44 may be partially solid such that openings 46 may be formed therein. In one nonlimiting example, the openings 40 may be drilled into the exterior surface 14. In yet another nonlimiting example, there may be about 2 to about 1000 openings 46 per micro-reservoir 39. Still in a further nonlimiting example, the micro-reservoir 39 could comprise more than 1000 openings 46 depending on the micro-reservoir 39 size and the lines per inch (lpi) desired. In an alternative embodiment, depicted in FIGS. 13B and 13C, the second side 44 comprises one opening 46. In such case, the single opening 46 may span or substantially span the entire length and/or width of the micro-reservoir 39. The opening(s) 46 may be a slot, hole, groove, aperture or any other means to permit the flow of fluid from the micro-reservoir 39 to the exterior or the roll 10. An opening 46 may comprise a relieved portion 34 and/or a raised portion 35 as detailed above with respect to fluid exits 30. Further, one or more openings 46 may be associated with a sleeve 100 as discussed more fully below. Any combination of micro-reservoir 39 designs may be provided on the roll 10. Likewise, the roll 10 may incorporate micro-reservoirs 39 at certain fluid exits 30 while other fluid exits 30 are void of micro-reservoirs.

The individual fluid exits 30 and/or micro-reservoirs 39 may be designed to comprise different shapes, volumes, widths, depths and/or aspect ratios. In one nonlimiting example, some fluid exits 30 and/or micro-reservoirs 39 may comprise differently radiused portions 33 (such as relieved portions 34 and/or raised portions 35), while others are formed without differently radiused portions 33.

Figure 14:
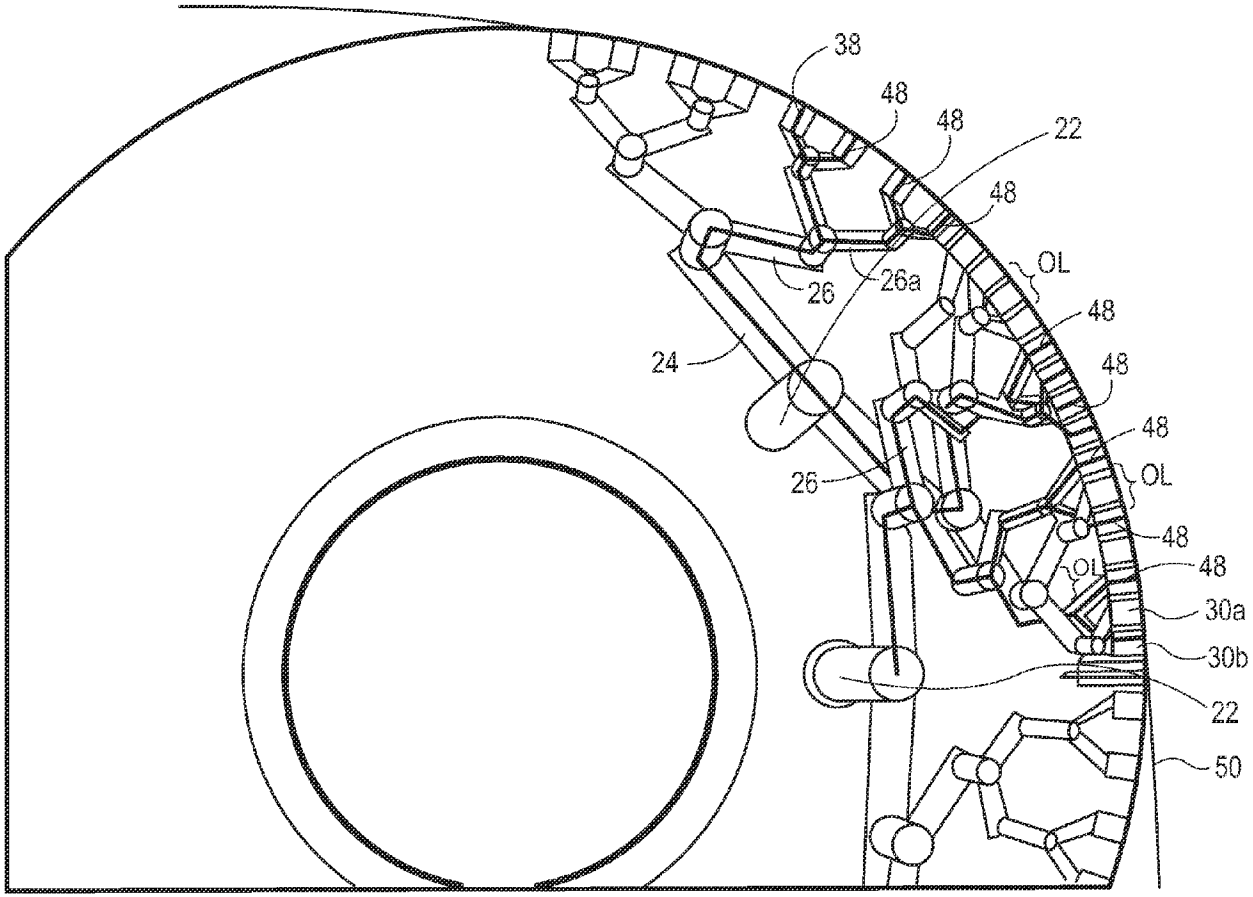
FIG. 14 is a partial, front elevational view of a rotating roll and vascular network in accordance with one nonlimiting embodiment of the present invention.

In yet another embodiment, the vascular network 18 may comprise a plurality of main arteries 22 (as shown, for example, in FIG. 14). Use of multiple main arteries 22 allows for multiple fluids to be transported through the vascular network 18, from the interior region 16 through multiple fluid paths 48 to the exterior surface 14, and deposited on a substrate 50. In addition, each main artery 22 and fluid path 48 may be independently controlled by one or more of pressure, length, velocity, or viscosity, among other features. Formulas and teachings below with respect to networks 18 having one main artery 22 equally pertain to networks 18 comprising more than one main artery 22.

Figure 15:
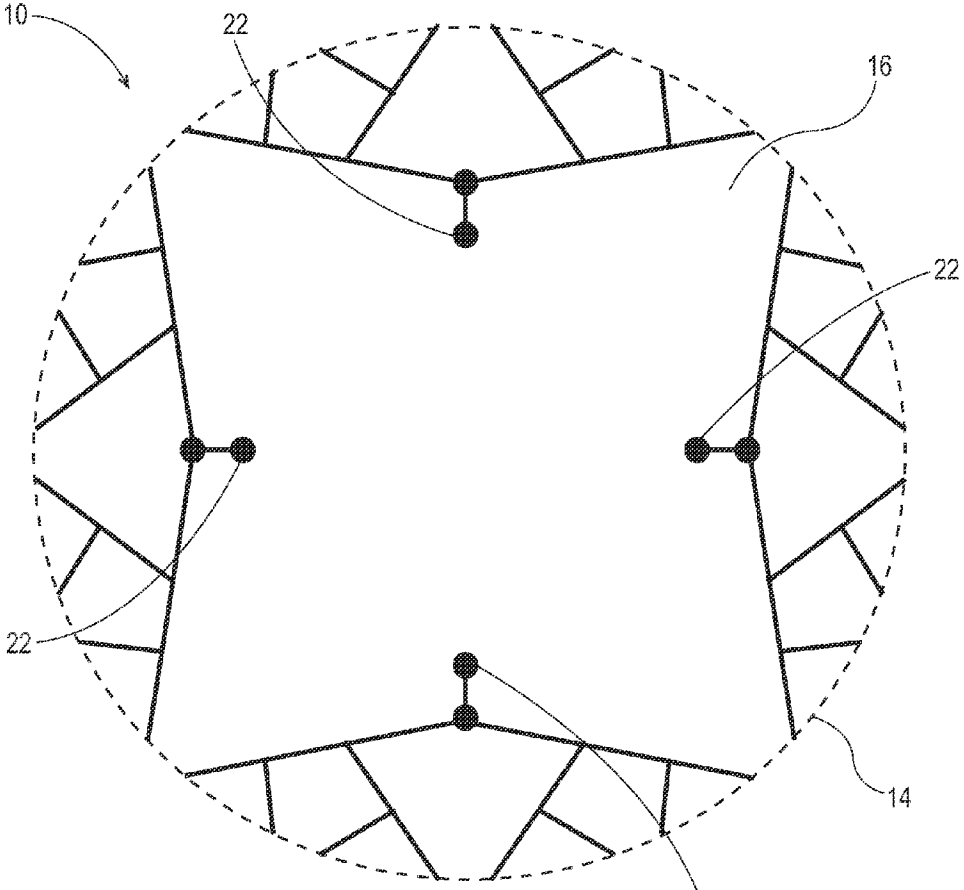
FIG. 15 is a schematic representation of a rotating roll and vascular network in accordance with one embodiment of the present invention.

In the case of multiple main arteries 22, the vascular network 18 may be viewed in sections, each section having one main artery 22. Each section may branch in the same manner (e.g., having the same number of trees 23 with the same levels) or each may branch in a different manner. In one nonlimiting example shown in FIG. 15, the vascular network 18 comprises four main arteries 22 and thus four sections. In one such example, each main artery 22 is in a different quadrant of the rotating roll 10.

Returning to FIG. 14, capillaries 24 and/or sub-capillaries 26 of one section may overlap capillaries 24 and/or sub-capillaries 26 of another section as indicated by the area of overlap, OL. In one embodiment, a fluid exit 30*a* in fluid communication with a capillary 24 and/or sub-capillary 26 from one section may be placed next to a fluid exit 30*b* in fluid communication with a capillary 24 and/or sub-capillary 26 from another section. In addition, the fluid in a capillary 24 and/or sub-capillary 26 from one section may be combined with the fluid in a capillary 24 and/or sub-capillary 26 from another section. These fluids may be combined at the fluid exit 30, in the micro-reservoir 39, in a relieved portion 35, or by other suitable means. In one nonlimiting example, combining the fluids can be facilitated with the use of static mixers which may be located within the vascular network 18. Likewise, channels 20 in any one tree 23 (regardless of the main artery 22 from which they extend or the section where they are located) can operate in the same way with channels 20 from another tree 23 (e.g., overlap, mix fluids, be arranged in close proximity to another tree's 23 fluid exits 30).

The vascular network 18 may comprise as many main arteries 22, capillaries 24, sub-capillaries 26 and fluid paths 48 as can fit within the interior region 14. A circumferential or axial design would result in less available space within the roll 10 for channels 20. Thus, in circumferential or axial designed networks, it is more difficult to include a plurality of main arteries 22, capillaries 24 and fluid exits 30. Likewise, the constraints on physical space make it difficult to overlap channels 20 of different sections and thereby put different fluids close to one another on the exterior surface 14.

The Rotating Roll

As noted above, the rotating roll 10 comprises an exterior surface 14 that substantially surrounds its central longitudinal axis 12. In an embodiment, the rotating roll 10 rotates about the central longitudinal axis 12. The rotating speed of the roll 10 can be any speed suitable for the processing being performed. In one nonlimiting example, the roll 10 rotates at a surface speed of 10 ft/minute, or from about 10 ft/minute to about 5000 ft/minute, or at about 500 ft/minute to 3000 ft/minute. The rotating roll 10 may also have an outside diameter suitable for processing needs. In a nonlimiting example, the rotating roll may have an outside diameter about 25 mm or greater, or from about 25 mm to about 900 mm, 150 mm to 510 mm.

It has been found that providing a fluid network as described herein can be effective at maintaining desired flow rates and pressures throughout the entirety of the fluid network, even with relatively small diameter rolls operating at relatively high surface speeds. In one nonlimiting example, a rotating roll 10 with an outer diameter (i.e., two times the radial distance from the central axis 12 to the exterior surface 14) of 150 mm can operate with a surface speed of at least 1000 ft/minute while maintaining uniform flow at all points on the roll surface. In previous tests with a rotating roll having an outer diameter of 150 mm at a speed of 1000 ft/minute and containing an annular fluid micro-reservoir extending at least half the length of the roll, the fluid flow exhibited significant non-uniformity in both axial and circumferential directions. The fluid network 18 of the instant invention overcomes these prior limitations and enables the application of uniform fluid patterns with a wide range of fluids while using a wide range of roll sizes and operating over a wide range of speeds. Moreover, the roll 10 and network 18 of the present invention are capable of depositing fluids in a variety of sizes, including very large and very small patterns, despite the size of the roll 10.

The exterior surface 14 of the roll 10 substantially surrounds the vascular network 18 which is disposed in the interior region 16 of the roll 10. In one embodiment, the roll 10 is in the shape of a cylinder. However, one of skill in the art will readily recognize that the roll 10 may comprise any shape suitable for enclosing the vascular network 18 and rotating as required for the deposition of fluid in accordance with the present disclosure.

Figure 16:
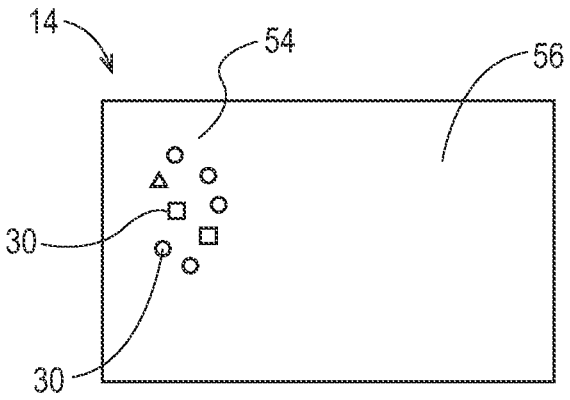
FIG. 16 is a schematic representation of fluid exits in accordance with one embodiment of the present invention.
Figure 17:
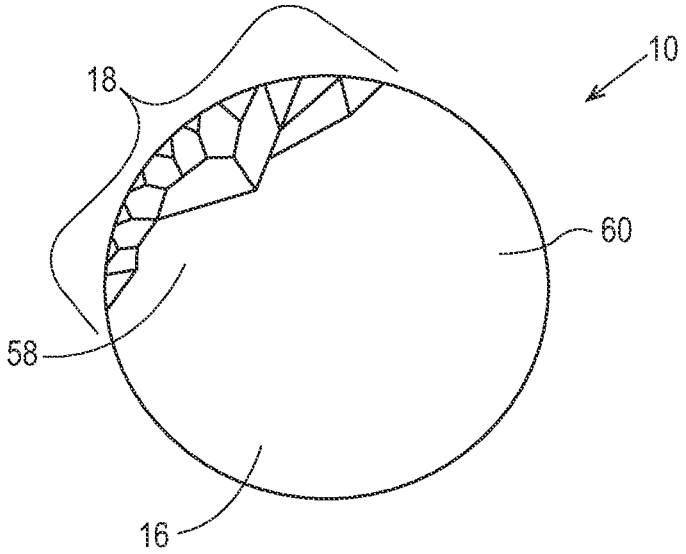
FIG. 17 is a schematic representation of an interior region of a rotating roll in accordance with one embodiment of the present invention.

The exterior surface 14 comprises one or more fluid exits 30. In addition, the exterior surface 14 may comprise one or more regions. FIG. 16 depicts an embodiment where the exterior surface 14 comprises a first exterior region 54 and a second exterior region 56. The fluid exits 30 of the vascular network 18 may be disposed in the first region 54. The second region 56 may be void of fluid exits 30. Likewise, as shown for example in FIG. 17, the interior region 16 may comprise a first interior region 58 and a second interior region 60. The vascular network 18 may be disposed within the first interior region 58, and the second interior region 60 may be void of the vascular network 18. Importantly, by building the vascular network 18 such that it only feeds the region of the roll 10 where fluid is to be deposited from, hygiene issues (such as bacterial growth from stagnant and/or built up fluid) can be avoided.

In one embodiment, the exterior surface 14 of the roll 10 can be multi-radiused (i.e., comprise different elevations at different points). In a nonlimiting example, the fluid exits 30 and/or micro-reservoirs 39 may be designed such that they comprise different depths, widths and/or aspect ratios, causing the surface 14 to be multi-radiused.

Figure 18:
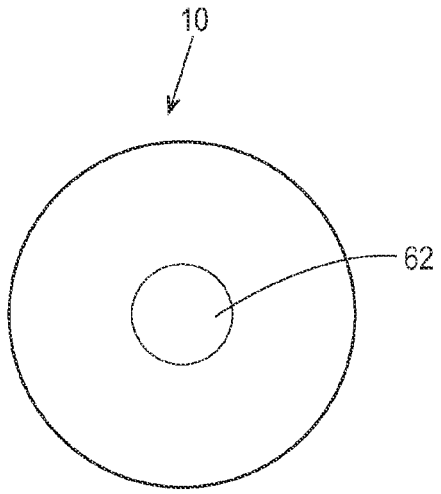
FIG. 18 is a schematic representation of a rotating roll in accordance with one embodiment of the present invention.
Figure 19:
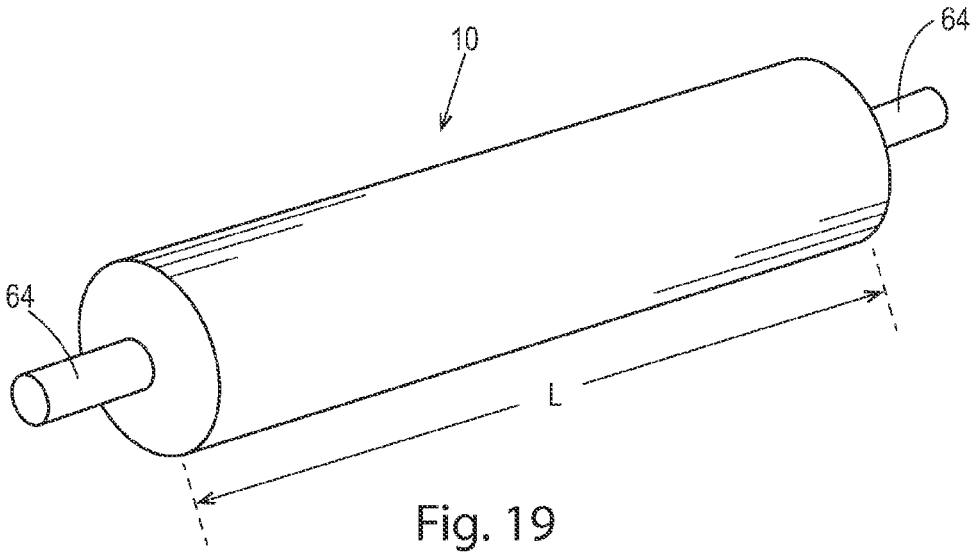
FIG. 19 is a schematic representation of a rotating roll in accordance with one embodiment of the present invention.

In a further embodiment, as shown for example in FIG. 18, the rotating roll 10 includes a hole 62, slot, groove, aperture or any other similar void space to lighten the weight of the roll 10. The roll 10 may comprise a shaft 64 through its center to provide structural stability as shown in FIG. 19. Alternatively, a tube, inner support ring or other common structures, such as lattice networks, known to those of skill in the art could be used to provide structural stability as well. In one nonlimiting example (also shown in FIG. 19), the roll 10 has a length, L, of about 100 inches or greater.

The roll 10 may also be temperature-controlled using, for example, heated oils, chilled glycol, mechanical heaters or other technologies known in the art. In one nonlimiting example, sections of the roll 10 are provided at different temperatures. In another nonlimiting example, one or more channels are temperature-controlled. In an embodiment, the roll 10 or the network 18 is controlled so that one or more of fluids may be provide at a temperature between 0° F. and 500° F.

Figure 20:
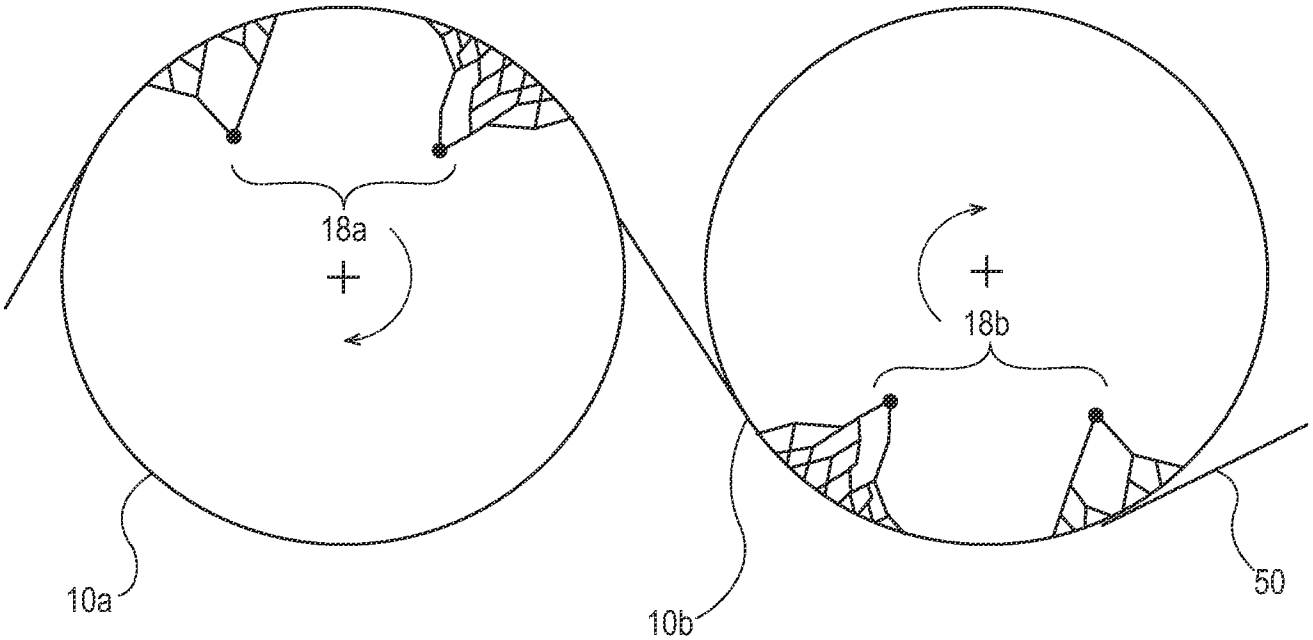
FIG. 20 is a schematic representation of a plurality of rotating rolls in accordance with one embodiment of the present invention.
Figure 21:
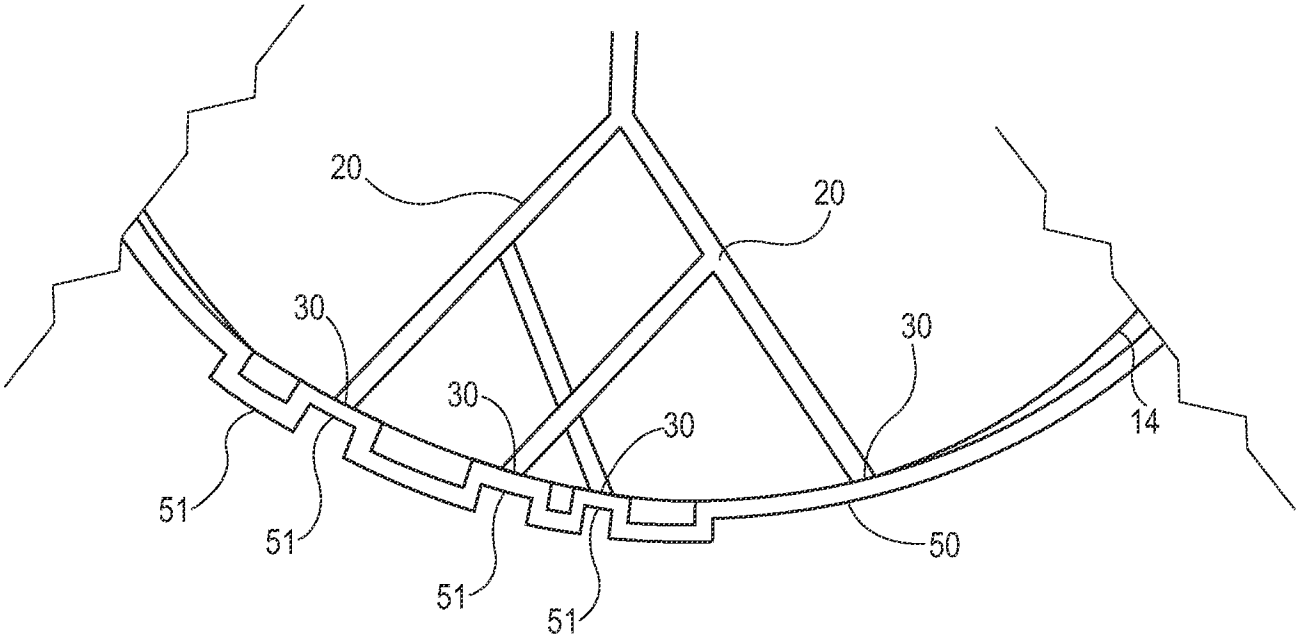
FIG. 21 is a schematic representation of a rotating roll and substrate in accordance with one embodiment of the present invention.

As shown in FIG. 20, a plurality of rotating rolls (10*a*, 10*b*), each having its own vascular network (18*a*, 18*b*), may be employed. The plurality of rotating rolls 10*a*, 10*b* may be positioned around a backing surface 200 as discussed below. Each roll 10 may be provided with one or more fluids, which may be the same or different. In addition, one or more fluids within one roll 10*a* may be the same or different from the one or more fluids in the other roll 10*b*. A fluid deposited onto a substrate 50 from a roll 10*a* may be registered with a fluid deposited onto the substrate 50 from another roll 10*b* or another source, or may be registered with product features 51, including but not limited to embossments, perforations, apertures, and printed indicia. For example, a fluid exit 30 may be disposed such that it aligns a product feature 51 on the substrate 50 with the exiting fluid as shown in FIG. 21. In an alternative embodiment, a fluid deposited onto a substrate 50 from a roll 10*a* may overlay a fluid deposited onto the substrate 50 from another roll 10*b* or deposited from another source. In yet another embodiment, a fluid deposited onto a substrate 50 from a roll 10*a* may blend with a fluid deposited from another roll 10*b* or from another source.

The use of a plurality of rolls 10 enhances printing capabilities. As discussed in more detail below, the vascular network 18 of the present invention permits more precise fluid deposition as well as better registration of fluids. Thus, the use of multiple rolls 10*a*, 10*b* with multiple fluids can create more precise mixing, overlaying and/or registration of fluids, creating more visually appealing consumer products in the context of ink and color printing. Further, because multiple fluids can be deposited from one roll 10, a single roll 10 can produce more highly registered colors and patterns than known apparatuses (as the fluids are perfectly registered by the placement of fluid exits 30, including the ability to closely place fluid exits 30) and the combination of a plurality of rolls 10 permits a wide variety of color combinations to be produced from a limited number of rolls 10. In one embodiment, a print system 70 for printing X colors comprises fewer than X printing apparatuses. In a nonlimiting example, a print system 70 for printing 7 or more inks on a substrate comprises 6 or less rotating rolls 10 of the present invention. In a further nonlimiting example depicted in FIG. 22, three rolls 10CYM, 10RGB, 10K, may be placed in operative relationship with a substrate 50, such as a sanitary tissue product. By operative relationship, it is meant that the roll 10 and substrate 50 are positioned such that fluid from the roll 10 will be deposited on the substrate 50, whether by direct contact or proximity or other suitable means. The rolls 10CYM, 10 RGB, 10K may be in sequential order. For example, the first roll 10 CYM may be positioned upstream of the second roll 10RGB and/or upstream of the third roll 10K. In another nonlimiting example, the second roll 10RGB can be positioned downstream of the first roll 10CYM and upstream of the third roll 10K. Any order of the rolls 10CYM, 10RGB, 10K is within the scope of the present invention. The first roll 10CYM may comprise a vascular network 18CYM transporting three inks cyan, yellow and magenta. Each ink may be feed through separate main arteries 22C, 22M, 22Y and one or more individual trees 23C, 23Y, 23M stemming from each main artery 22C, 22M, 22Y; the trees 23C, 23Y, 23M may overlap. A second roll 10RGB may comprise a vascular network 18RGB transporting three inks—red, green and blue. Similar to the first roll 10CYM, each ink in the second roll 18 RGB may be feed through separate main arteries 22R, 22G, 22B and one or more individual trees 23R, 23G, 23B stemming from each main artery 22R, 22G, 22B; the trees 23R, 23G, 23B may overlap. Additional, the third roll 10K may comprise a vascular network 18K transporting one ink—black. The black ink may be feed through a main artery 22K and a tree 23K stemming from the main artery 22K. The inks in one roll 10CYM, 10RGB, 10K may overlay or register to the inks of any of the other rolls 10CYM, 10RGB, 10K. For example, one or more of the fluid exits 30 on the first roll 10CYM may be disposed such that they align with one or more fluid exits 30 on the second roll 10RGB and/or on the third roll 10K. As such, the rolls 10*a*, 10*b*, 10*c*, may be used in conjunction with each other to produce tens of thousands of colors. Colors created using this combination of rolls are important for the tissue/towel industry (i.e., consumers of sanitary tissue products desire colors within the pallete available through this particular arrangement of rolls). Further, the inks from the fluid exits 30 of any of the rolls 10CYM, 10RGB, 10K may be registered with one or more product features 51 of a substrate.

Figure 23:
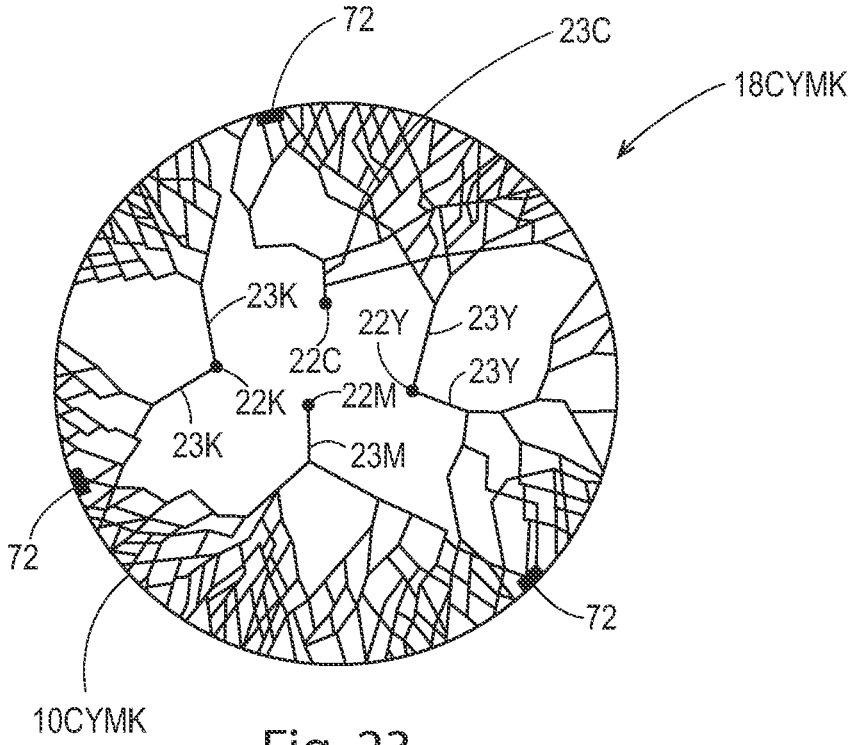
FIG. 23 is a schematic representation of a print system in accordance with another embodiment of the present invention.

In another embodiment, the number of inks in each roll 10 may be changed. For example, one roll 10 may have 8 inks, another roll 10 may have 4 inks, and another roll 10 may have 3 inks. Three rolls 10 are used for illustration purposes herein, but one of skill in the art will recognize that any number of rolls 10, any number of inks within a roll 10, and any combination and/or order of inks and other fluids may be used to create desired fluid applications. In nonlimiting example, the print system 70 comprises at least one rotating roll 10CYMK having four inks—cyan, yellow, magenta and black. The inks may be feed through separate main arteries 22C, 22Y, 22M, 22K within the same roll 10CYMK and one or more individual trees 23C, 23Y, 23M, 23K stemming from the main arteries 22C, 22Y, 22M, 22K as shown in FIG. 23. An internal mixer 72 may be used to combine inks within the roll 10CYMK. Further, any of the inks may be registered with one or more product features 51 of a substrate.

Figure 24:
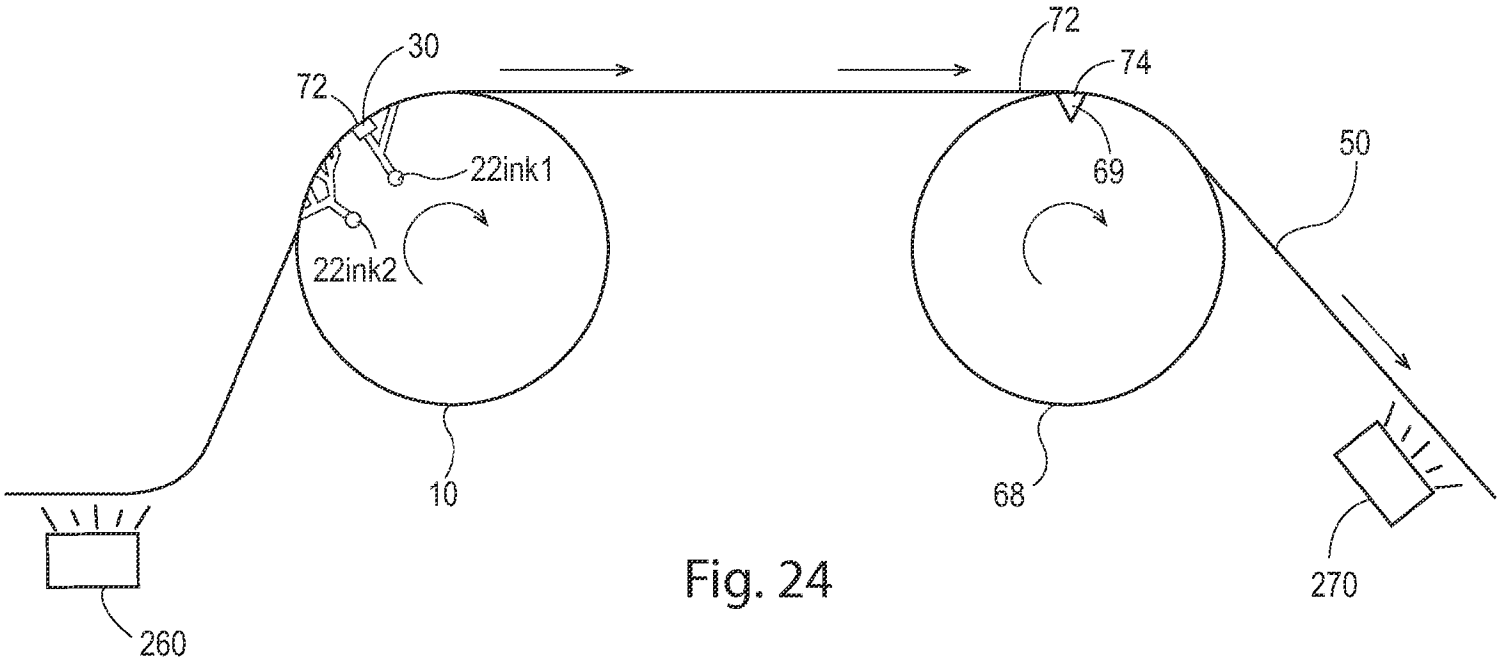
FIG. 24 is a schematic representation of a print system in accordance with yet another embodiment of the present invention.

In another embodiment shown in FIG. 24, the print system 70 comprises at least one rotating roll 10 and one or more conventional printing apparatus 68, wherein the sum of the rotating rolls 10 and conventional printing apparatuses 68 are less than X (where X is the number of inks to be printed). Conventional printing apparatuses 68 include but are not limited to gravure rolls, printing plates, flexographic rolls, lithographic printing, inkjet printers, rotary screen printing, and the like. When used together, the rotating roll 10 can be placed upstream or downstream of the conventional apparatus 68. In one nonlimiting example, more than three inks can be printed on a substrate. In one such example, the rotating roll may comprise a plurality of main arteries 22, where at least two of the main arteries $22_{Ink1}$, $22_{Ink2}$ comprise an ink. The inks in each of the main arteries $22_{Ink1}$, $22^{Ink2}$ may be different colors. The conventional printing apparatus 68 comprises a deposit orifice 69 from which fluid, such as ink, is released from the apparatus 68 and deposited on the substrate 50. In one nonlimiting example, two inks are disposed within the roll 10 and the remaining inks disposed in the conventional printing apparatus 68. In an embodiment, an ink leaving the deposit orifice 69 is registered with an ink exiting one or more of the fluid exits of the roll 10. For example, the roll 10 can deposit one ink through a fluid exit 30 at a first deposit location 72 on the substrate and the conventional printing apparatus 68 deposits an ink through the deposit orifice 69 at a second deposition location 74 on the substrate deposit orifice 69 and the first deposition location 72 can be aligned with the second deposition location. Likewise, the first deposition location 72 and the second deposition location 74 may be in the same location, allowing the fluid from the conventional apparatus 68 to overlay the fluid from the roll 10. The deposition locations 72, 74 may also be proximate enough to allow for blending of the separate fluids. The print system 70 may be used in conjunction with a sleeve 100 and/or any other ancillary parts discussed below, including but not limited to a backing roll 200, pretreat station 260 and/or overcoat station 270. In one nonlimiting example, a pretreat station 260 (e.g., for treating a substrate with a chemical, such as calcium chloride, to enhance color intensity) is positioned upstream of at least one of the rotating rolls 10. In another nonlimiting example, an overcoat station 270 (e.g., for placing varnish over the ink and substrate) is positioned downstream of at least one of the rolls 10. In addition, internal mixers 72 may also be used within a given rotating roll 10 to produce combinations of the inks within said roll 10.

The Sleeve

Figure 25:
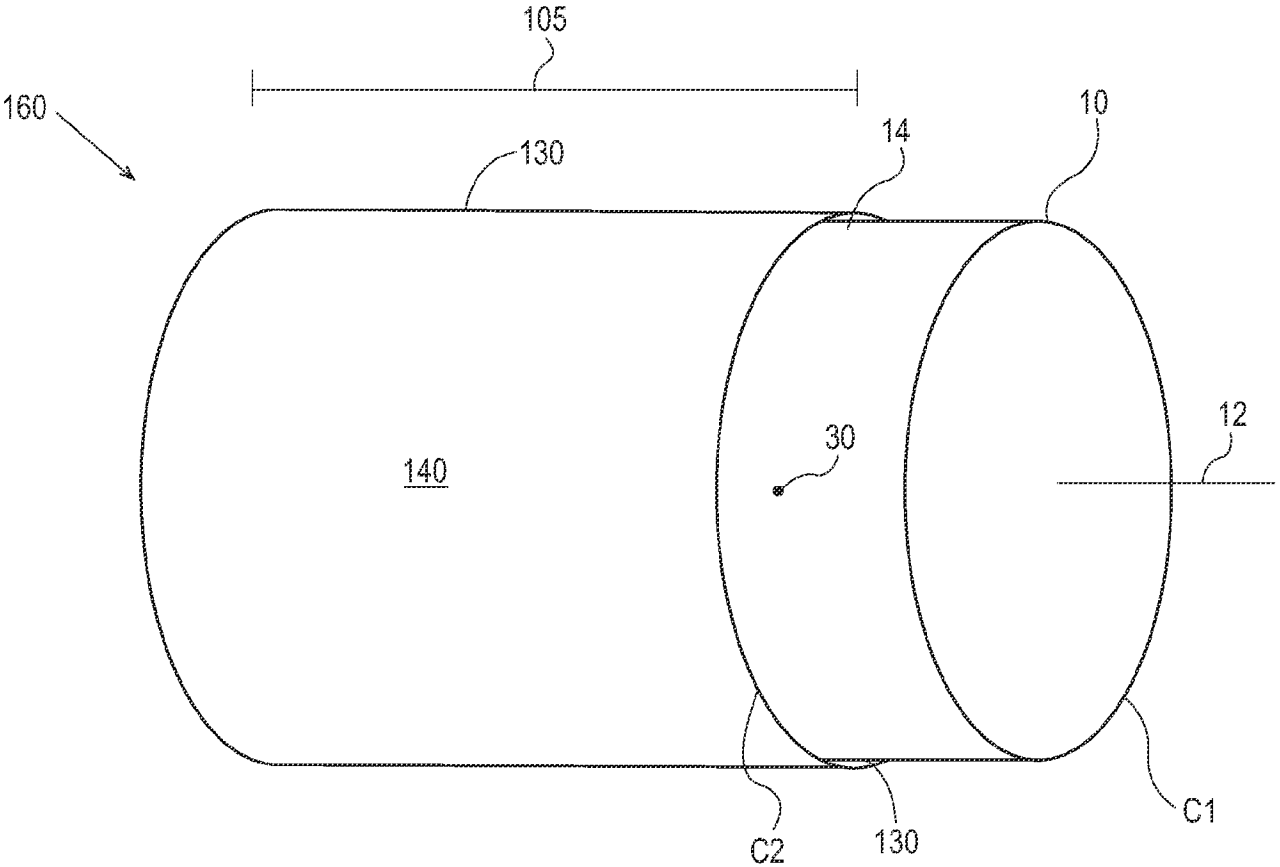
FIG. 25 is a perspective view of a rotating roll and sleeve in accordance with one embodiment of the present invention.
Figure 26:
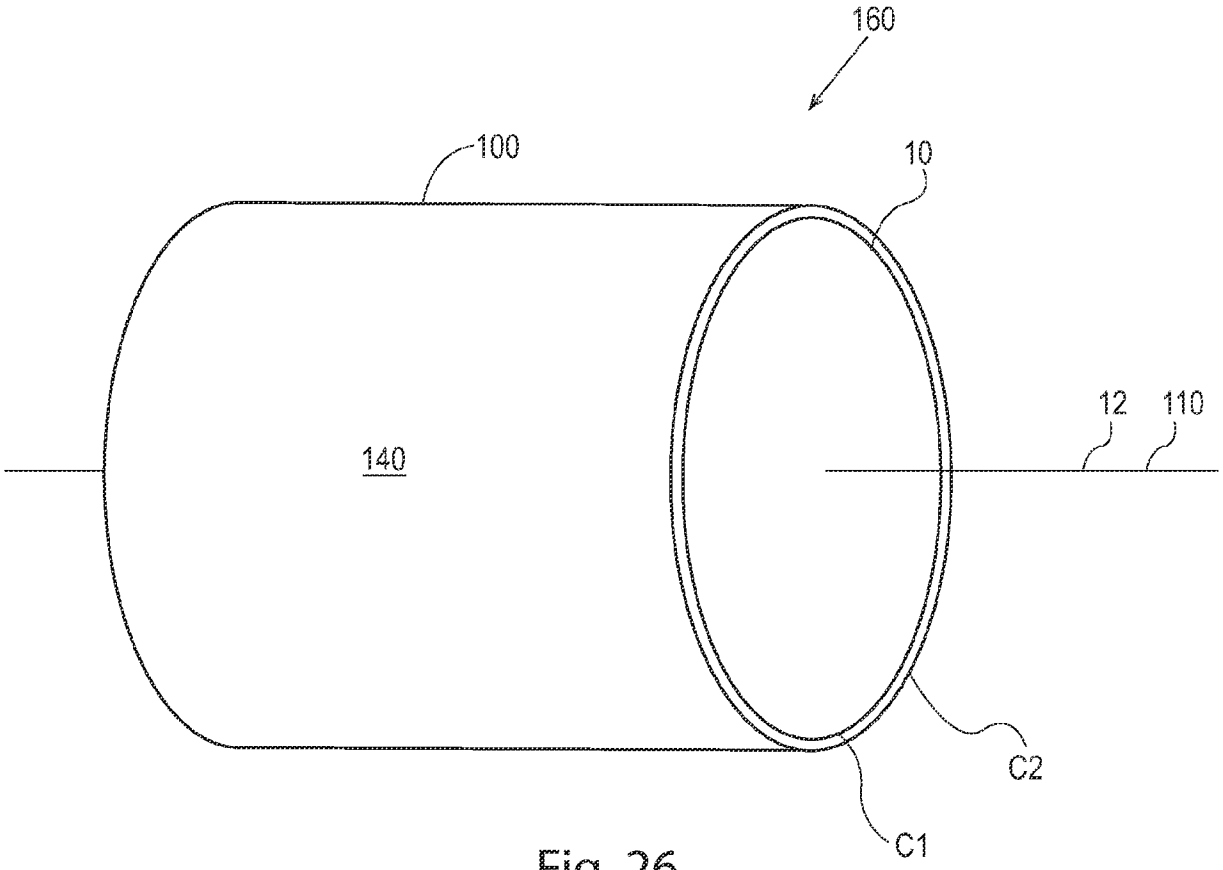
FIG. 26 is a perspective view of a rotating roll and sleeve in accordance with one embodiment of the present invention.

Turning to FIGS. 25 and 26, a sleeve 100 may be disposed on the exterior surface 14 of the roll 10 or, said differently, the roll 10 may be disposed within an inner region 130 of the sleeve 100. The sleeve 100 and roll 10 may comprise a sleeve and roll system 160 incorporating any of their respective components as described herein.

In one nonlimiting example, the sleeve 100 is disposed on the entire exterior surface 14 such that it substantially surrounds the rotating roll 10. Alternatively, the sleeve 100 may be disposed in a surrounding relationship about a portion of the rotating roll 10 to form a sleeve coverage area 105. In such case, one fluid exit 30 may be in operative relationship with the substrate without the fluid passing through the sleeve 100, while another fluid exit 30 can be registered or aligned with a sleeve exit 120. In other words, one of the fluid exits may be outside of the sleeve coverage area 105. In another nonlimiting example, the sleeve 100 is substantially cylindrical. In one embodiment, the sleeve 100 is removable from the roll 10. The sleeve 100 may comprise a central axis 110 and an inner region 130 substantially surrounding the central axis 110. The inner region 130 may comprise a first circumference, $C_1$. The rotating roll 10 may have a second circumference, $C_2$, defined by its exterior surface 14. The first circumference $C_1$ may be slightly smaller than the second circumference $C_2$. As one of skill in the art would understand, the sleeve 100 could then be assembled with the roll 10 using a shrink fit for example. In one example, the roll 10 could be cooled so that its circumference C1 is smaller than the sleeve 100 circumference C2 which would allow the sleeve 100 to be placed over the roll 10 exterior which has a circumference C1. Alternatively, the sleeve 100 could be heated to expand such that its circumference C2 would be larger than the roll 10 circumference C1 so that again the shell could be assembled over the roll 10 exterior which has a circumference C1. In yet another embodiment heating and cooling the sleeve 100 and roll 10 respectively can be used to allow the assembly of the sleeve 100 to the roll 10 as is known in the art. The amount of shrink fit or compression between the roll 10 and the sleeve 100 can be selected to get the desired fit that can be achieved depending on the material of the roll 10 and sleeve 100. In a non-limiting example, one could make the sleeve 100 out of stainless steel and the roll 10 out of a plastic resin as might be used in stereolithography. The sleeve 100 and the roll 10 could be manufactured to be relatively concentric. For example they could be made so that they are toleranced within 0.020" or 0.010", or 0.005" or 0.003", or about 0.001" concentricity. In an example where the sleeve 100 and roll 10 are concentric within 0.001" a compression fit of 0.025" or 0.020", or 0.010" or about 0.005" could be used to create a roll assembly that keeps the stainless steel sleeve 100 tight on the plastic resin roll 10 so that they don't come apart or slip, and can even take advantage of the deformability of the plastic resin roll 10 to create a water tight seal between the sleeve 100 and the roll 10. Further, the sleeve 100 can be registered in absolute circumferential position relative to the roll 10 using a pin to locate the sleeve 100 relative to the roll 10 circumferentially as would be known by those in the art. In an embodiment depicted in FIG. 26, the sleeve 100 may be disposed around the rotating roll 10 such that its central axis 110 and the central longitudinal axis 12 of the roll 10 are substantially coincident. The sleeve 100 may comprise a metal material. The metal material can have a Rockwell hardness value of about B79. In one nonlimiting example, the metal material is stainless steel. In another nonlimiting example, the outer surface 140 of the sleeve 100 can have a taber abrasion testing factor greater than the taber abrasion testing factor of the exterior surface 14 of the roll 10. Having a greater taber abrasion factor than the exterior surface 14 of the roll 10 and/or having a hardness value of about B79 can protect the roll 10 from exposure to substances that could change its properties, such as UV rays. Further, the hardness and/or taber abrasion of the outer surface 140 allows for harder or sharper items, such as doctor blades to come in contact with the sleeve 100—which may, for example, aid in cleaning. Further still, the sleeve 100 can enhance hygiene. For example, the outer surface 140 may be made of a material that is less likely to attract or retain contaminants (i.e., the outer surface 140 may have a lower surface energy relative to the exterior surface 14 of the roll 10 or may be coated to repel contaminants etc.).

The outer surface 140 of the sleeve 100 may comprise differently radiused portions 33 in the same manner as the roll 10 may comprise differently radiused portions 33. By altering the radius of the outer surface, the sleeve 100 can be customized to provide a wide variety of textural properties such as elasticity or hardness. In one embodiment, the sleeve 100 may have a hardness value up to 60 on the Rockwell C scale. In another embodiment, the sleeve 100 may comprise a relatively deformable surface and have a value of at least 150 on the Pusey & Jones Hardness Tester (P&J Plastometer). The sleeve may comprise a hardness value between 60 on the Rockwell C scale and 150 on the P&J Plastometer.

Figure 27:
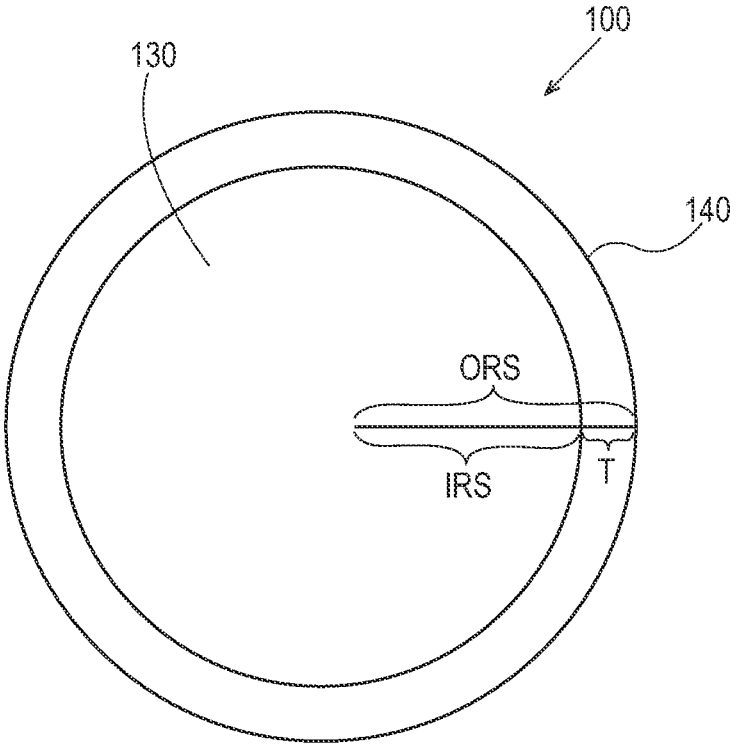
FIG. 27 is a schematic representation of a sleeve in accordance with one embodiment of the present invention.

In a further embodiment, the sleeve may have a thickness, T, of greater than 1 mm or greater than 1.5 mm. In yet another embodiment, the sleeve 100 comprises a mesh or screen material. The screen may comprise a thickness, T, of less than about 1.5 mm or less than about 0.5 mm. Such screens are commercially available from the Stork Screen Company. As illustrated in FIG. 27, thickness, T, is the difference between the outer radius, ORS, of the sleeve 100 (i.e., the distance from the central axis 110 to the exterior surface 140) and the inner radius, IRS, of the sleeve 100 (i.e., the distance from the central axis 110 to the outmost point of the inner region 130). Where the sleeve 100 comprises differently radiused portions or the thickness, T, otherwise varies, the thickness, T, can be determined by the greatest distance between the outer radius, ORS, and the inner radius, IRS as shown in FIG. 27. In a further nonlimiting example, the sleeve 100 may be coated with one or more materials that would allow a change in surface tension and/or other properties beneficial for the invention disclosed herein. The sleeve 100 may be made from one unitary body of material or from more than one segments of material.

Figure 28:
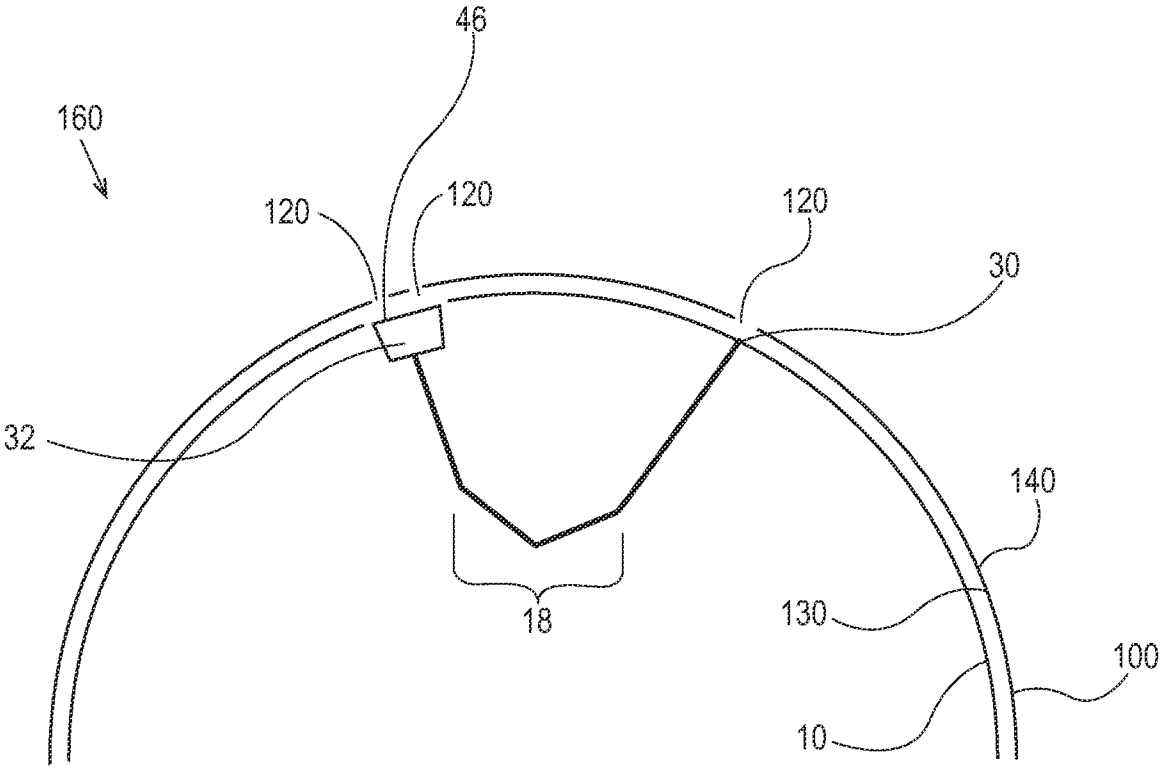
FIG. 28 is a schematic representation of a rotating roll and sleeve in accordance with an embodiment of the present invention.

As shown in FIG. 28, the sleeve 100 may comprise a sleeve exit 120. The sleeve exit 120 may be registered or otherwise associated with a fluid exit 30. In a further embodiment, the sleeve exit 120 may be registered or otherwise associated with the opening 46 of a micro-reservoir 39. In still another embodiment, the sleeve 100 may comprise a plurality of sleeve exits 120. One or more sleeve exits 120 may be registered or otherwise associated with a fluid exit 30 and/or the opening 46 of a micro-reservoir 39. In one nonlimiting example, there may be from about 1 to about 1000 sleeve exits 120 registered or associated with an opening 46 of a micro-reservoir 39. In another nonlimiting example, the opening 46 of a micro-reservoir 39 is less than about 16 $mm^2$, or less than about 9 $mm^2$ or less than about 4 $mm^2$ or 0.1 $mm^2$.

Figure 29:
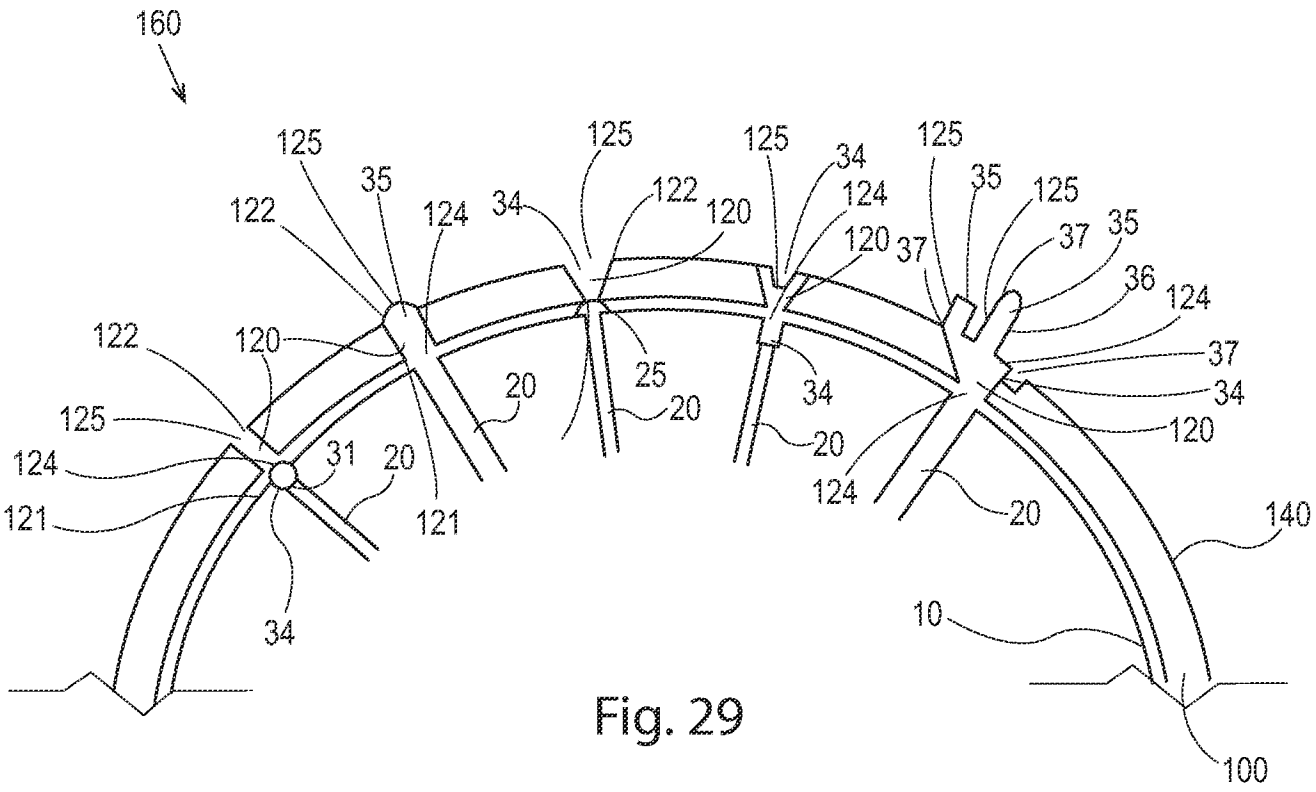
FIG. 29 is a schematic representation of a rotating roll, a sleeve and sleeve exits in accordance with nonlimiting examples of the present invention.

As shown in FIG. 29, a sleeve exit 120 may comprise a meeting point 124 where fluid enters the sleeve 100 and a release point 125 where fluid leaves the sleeve 100 to contact the substrate 50. In addition, the sleeve exit 120 may comprise a first side 121 and a second side 122 substantially opposite the first side 121 and coterminous with the outmost part of the outer surface 140. The sleeve exit may be registered or associated with the exit point 32 of a fluid exit 30 and/or reservoir opening 46 at the meeting point 124. The meeting point 124 may be located on the first side 121. The release point 125 may be located on the second side 122. In one nonlimiting example, the meeting point 124 and release point 125 have substantially the same cross-sectional area, as shown in FIG. 28. In another nonlimiting example, the meeting point 124 and the release point 125 have different cross-sectional areas.

A sleeve exit 120 may have an aspect ratio of at least 10, or at least 25. The sleeve exit 120 may be created in the sleeve 100 by any suitable means. In one nonlimiting example, the sleeve exit 120 is laser drilled into the sleeve 100. A number of shapes may be achieved. In another nonlimiting example, the sleeve exit 120 may be shaped to form a differently radiused portion 33, such as a relieved portion 34 and/or a raised portion 35. In an example of the relieved portion 34, the meeting point 124 can comprise a cross-sectional area smaller than the cross-sectional area of the second side 122, such that a pool of fluid may be provided in the relieved portion 35 and transferred to a substrate 50. One of skill in the art will recognize that the "pool" of fluid may remain a small amount of fluid but may be a higher volume than fluid provided in other configurations of the sleeve exit 120. Any combination of arrangements of sleeve exit 120 designs may be provided. As with the differently radiused portions 33 of the roll 10, one differently radiused portion 33 may comprise both a raised portion 35 and a relieved portion 34. Moreover, the differently radiused portion 33 may comprise one or more sides 37, and the meeting point 124 and/or the release point 125 may be located on a side 37. In one nonlimiting example, a fluid exit 30 and/or reservoir 39 having a differently radiused portion 33 is registered or associated with a sleeve exit 120 having a differently radiused portion 33.

In an embodiment, the sleeve 100 has a thickness, T, of greater than about 1.5 mm, or between about 1.5 mm or about 10 mm, and a sleeve exit 120 has an aspect ratio of greater than about 10. In another embodiment, the sleeve 100 has a thickness, T, of less than about 4 mm, or less than about 2 mm, or less than about 1.5 mm, or less than about 0.5 mm. The cross-sectional area of meeting point 124 of the sleeve exit 120 may be less than about 0.5, or less than about 0.3 or less than about 0.15 times the cross-sectional area of the fluid exit point 32 or reservoir opening 46.

The sleeve exits 120 may be arranged in any desired manner, with the only constraint being the physical space. If desired, the sleeve exits 120 may be placed as close as the physical space allows. In an alternative embodiment, the fluid exits 30 collectively may form a pattern 52 to be deposited on a substrate 50, such as a line or plurality of lines, aesthetic design and/or letters (not shown).

The sleeve 100 may be fitted onto the rotating roll 10 by any suitable means, including but not limited to, compression or shrink fit.

Optimizing Design of the Vascular Network

It is believed that the design of the vascular network 18 permits optimal control of fluid deposition in multiple ways. First, the ability to separately customize various components of the system (e.g., the diameter of the roll 10, diameters of the channels 20, route and length of the fluid paths 48) allows for various objectives to be achieved with just one roll 10. Essentially, as discussed more completely in the method section below, the designer determines where and at what rate fluid is to be deposited, selects fluid(s) having desirable properties, designs the network 18 to achieve the determined output and objectives (e.g., arranging the trees, designing tree size, etc.) and selects a fluid delivery system (e.g., the channel 20 sizes, junctions 21, feed systems such as pumps at inlet 28, rotary union 230 etc.). Objectives include, but are not limited to, uniformity in fluid deposition levels or rates despite different exits 30, 120, uniformity in volumetric flow rates despite different channels 20, minimal flow rate and/or pressure fluctuations throughout the network 18, uniformity in pressure drops despite different trees 23, and the capability to apply very precise, small flows of fluid to a substrate 50. Various other objectives could be met as well. Second, the sleeve 100 may be used in conjunction with the vascular network 18 and roll 10 to overcome physical constraints (e.g., available space in the interior region 16). Third, the substantially radial design of the vascular network 18 overcomes challenges associated with rotating rolls 10 used for fluid deposition.

Customization

The following nonlimiting examples highlight the capabilities of the vascular network 18 through customizing various factors:

Minimal flow rate and/or pressure fluctuations may be achieved by, for example, minimizing the differential between the cross-sectional areas of associated channels. For example, the cross-sectional area decreases at each junction 21. In one embodiment, fluid is provided at the inlet 28 at a pressure of less than 10 psi, or less than 5 psi. In a further embodiment, the pressure decreases at each junction 21 by less than 2 psi. Minimizing flow rate and pressure fluctuations also prevents air penetration of the interior region 15 of the roll 10 which could cause fluid flow disruption or even starvation.

Figure 30:
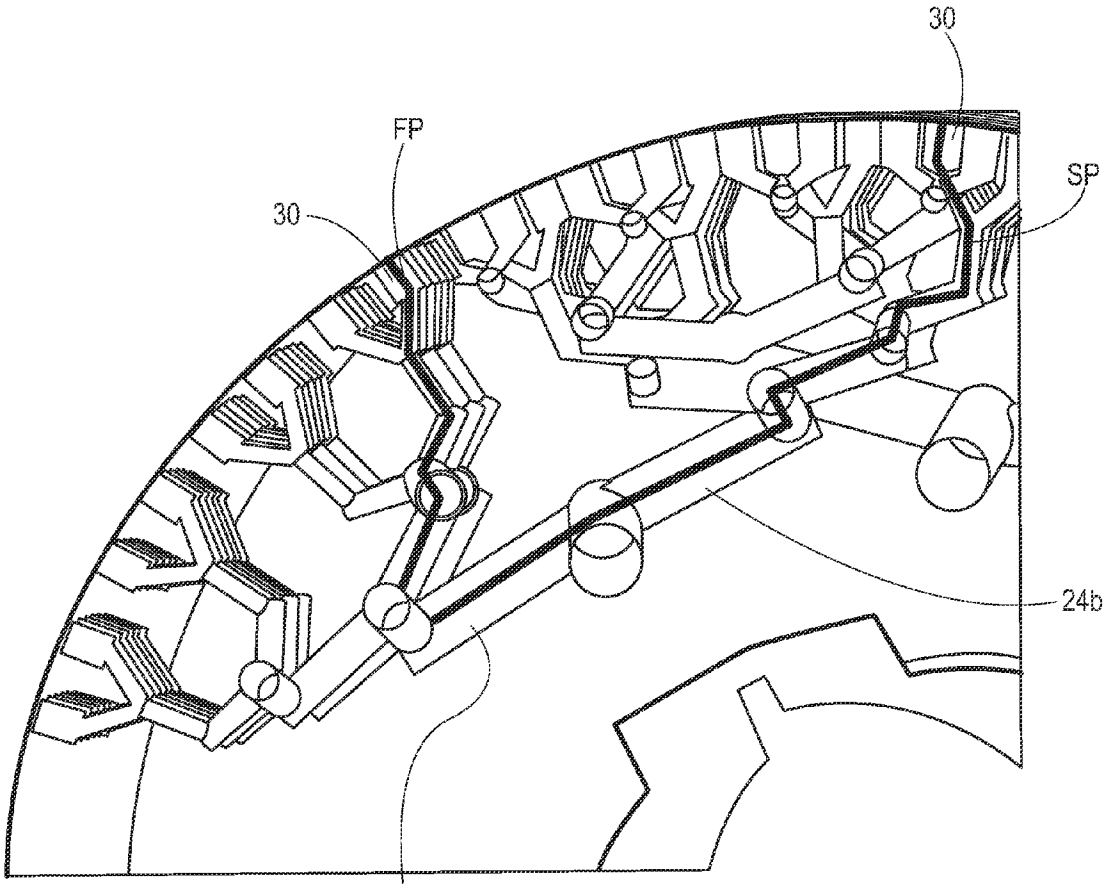
FIG. 30 is a partial, perspective view of a rotating roll in accordance with an embodiment of the present invention.

To achieve uniform fluid deposition, the fluid paths 48 may also be directed (by use of baffles to slow or direct fluid flow, for example) or configured to have equal path lengths. FIG. 30 depicts one embodiment in which the vascular network 18 has a first path length, FP, and a second path length, SP. The first path length, FP, is the length between the first capillary 24*a* and a fluid exits 30 with which the first capillary 24*a* is in fluid communication. The second path length, SP, is the length between the second capillary 24*b* and a fluid exits 30 with which the second capillary 24*b* is in fluid communication. In one nonlimiting example, the first path length, FP, is substantially equal to the second path length, SP. Without being bound by theory, having substantially equal path lengths permits substantially equal distribution of the fluid notwithstanding the different paths 48 through which the fluid travels. Essentially, fluid enters the inlet 28 at the same velocity and/or pressure, and then travels the same distance to its respective fluid exit 30. As such, the fluid is more likely to be deposited in a similar manner despite the distinct path 48. In addition, the radial nature of the paths 48 more easily permits having equal path lengths within the confines of the rotating roll's 10 exterior surface 14.

Likewise, it is believed the same uniform deposition of fluid can be achieved by having substantially equal area change from the main artery 22 to each fluid exit 30 with which it is in fluid communication. In one nonlimiting example, each capillary 24 or sub-capillary 26 on a given level has substantially the same area, such that the change in area between the main artery 22 and each of the fluid exits 30 is substantially the same despite distinct fluid paths 48.

Figure 31A:
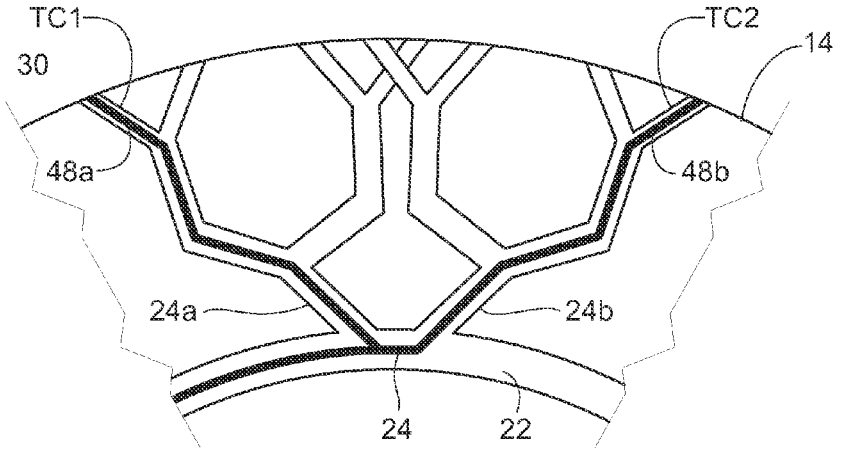
FIGS. 31A-31B are schematic representations of exemplary trees in accordance with nonlimiting examples of the present invention.
Figure 31B:
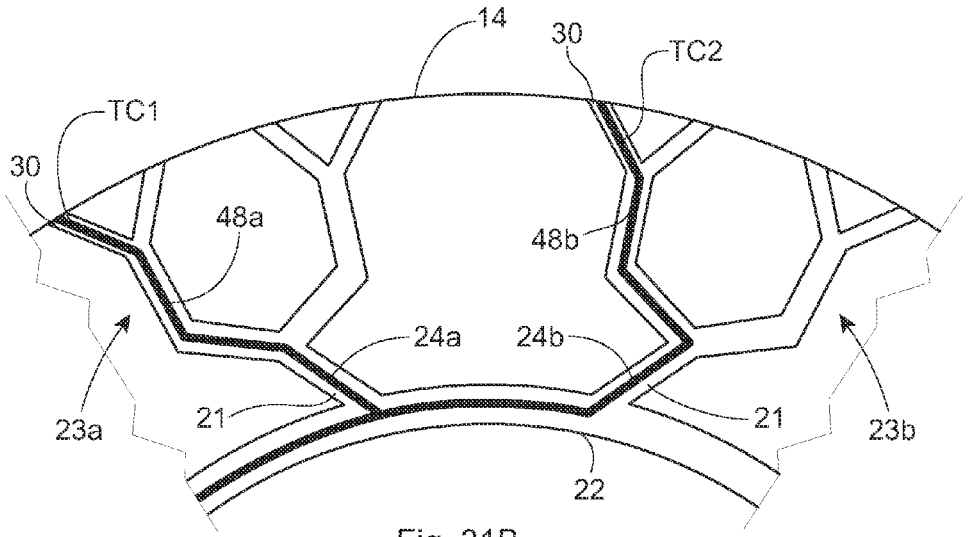

In another embodiment, substantially the same diameter change can be achieved in two different fluid paths, which would also result in uniform fluid deposition despite the different paths. As shown in FIGS. 31A and 31, the different paths may be in different trees 23 extending from the same main artery 22, or in trees 23 that extend from different main arteries 22. By way of illustration, the network 18 may comprise a first capillary 24*a* in fluid communication with one or more fluid exits 30 through a first fluid path 48*a* and a second capillary 24*b* in fluid communication with one or more fluid exits 30 through a second fluid path 48*b*. The first capillary 24*a* and the second capillary 24*b* which may extend from the same main artery 22 through the same junction 21 and thereby form a part of the same tree 23. Alternatively, the first capillary 24*a* and the second capillary 24*b* which may extend from the same main artery 22 through separate junctions 21 and thereby form separate trees 23*a*, 23*b*. The network 18 may further comprise a first diameter change along the first fluid path 48*a* and a second diameter change along a second fluid path 48*b*. The first diameter change is the difference between $\text{Diameter}_{Start1}$ and $\text{Diameter}_{End1}$, where:

$\text{Diameter}_{Start1}$ is the average diameter of the first capillary 24*a*; and $\text{Diameter}_{End1}$ is the average diameter of a first terminating channel $TC_1$, wherein the first terminating channel $TC_1$ is associated with a fluid exit 30 with which the first capillary 24*a* is in fluid communication.

The second diameter change is the difference between $\text{Diameter}_{Start2}$ and $\text{Diameter}_{End2}$, where:

$\text{Diameter}_{Start2}$ is the average diameter of the second capillary 24*b*; and $\text{Diameter}_{End2}$ is the average diameter of a second terminating channel $TC_2$, wherein the second terminating channel $TC_2$ is associated with a fluid exit 30 with which the second capillary 24*b* is in fluid communication.

The first diameter change may be substantially equivalent to the second diameter change, resulting in similar deposition of fluid at the end of each fluid path 48*a*, 48*b*.

Figure 32:
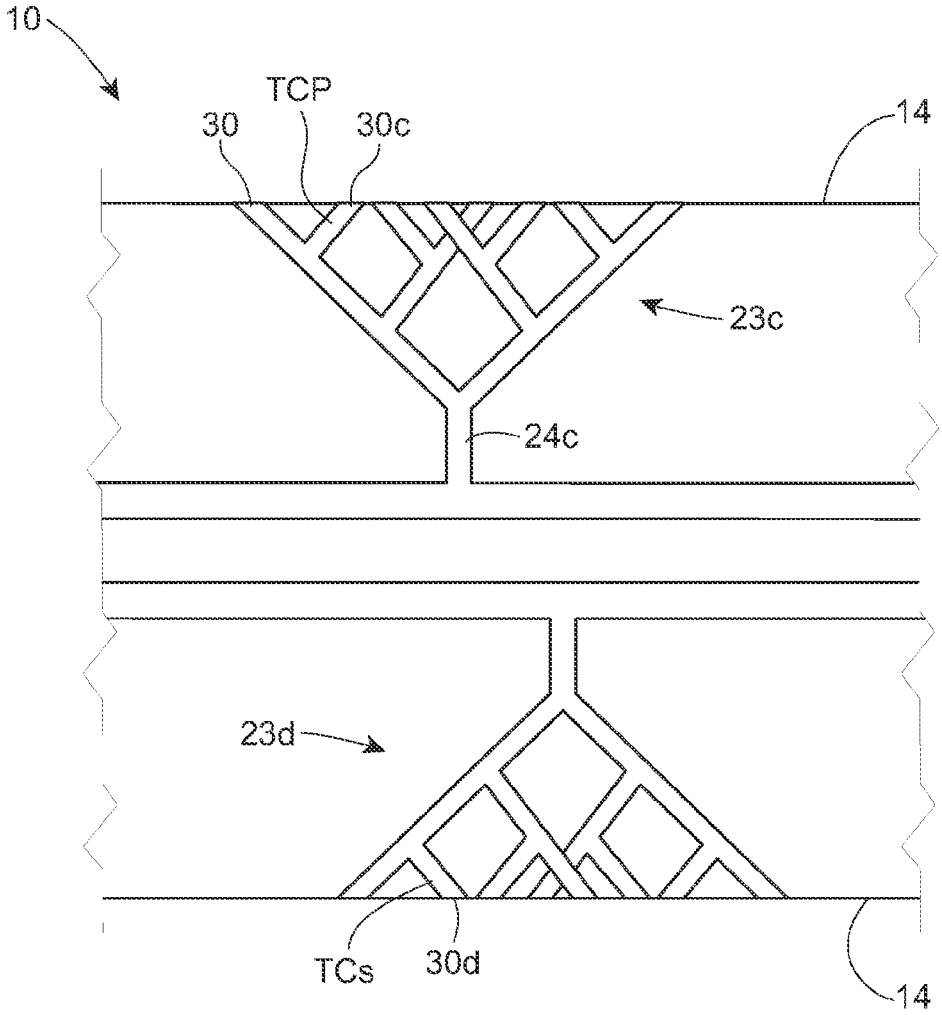
FIG. 32 is a schematic representation of trees in accordance with one nonlimiting example of the present invention.
Figure 33A:
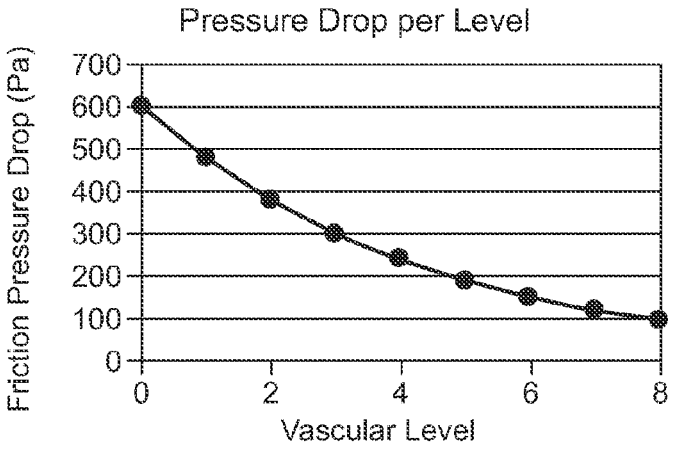
FIGS. 33A-33E are charts depicting phenomena resulting from a vascular network designed in accordance with one nonlimiting example of the present invention.
Figure 33B:
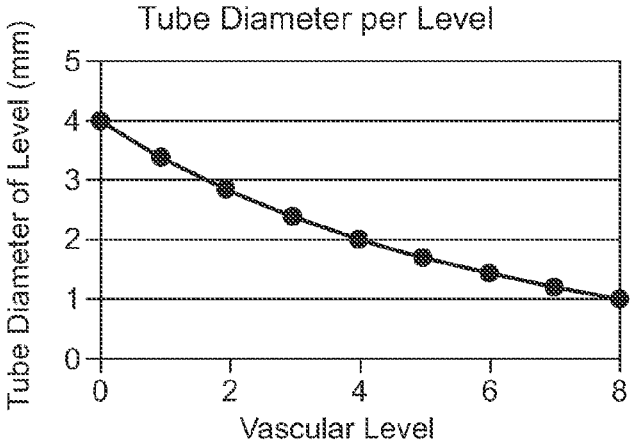
Figure 33C:
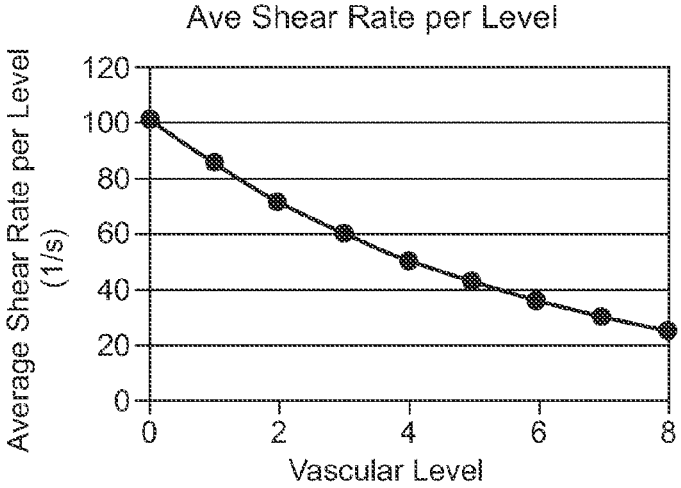
Figure 33D:
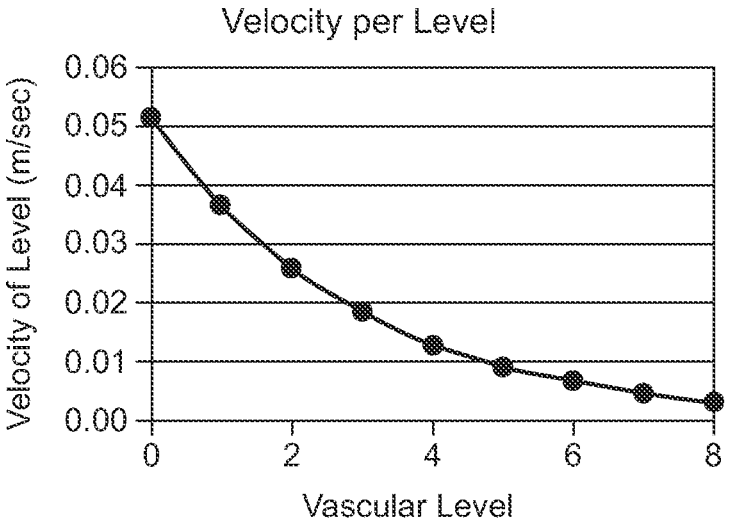
Figure 33E:
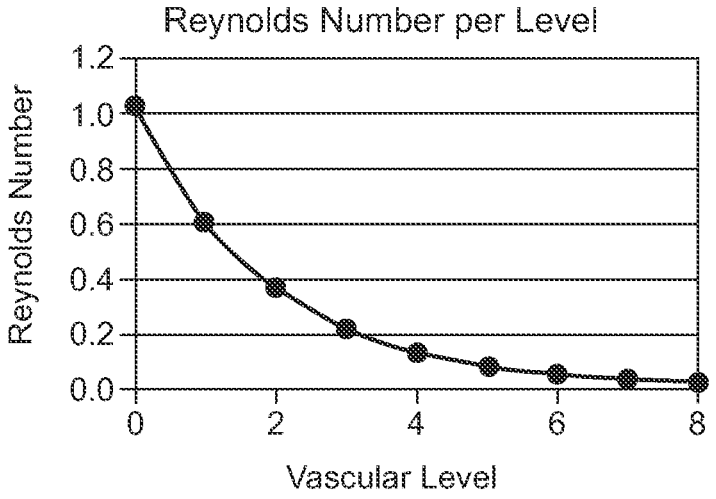
Figure 34A:
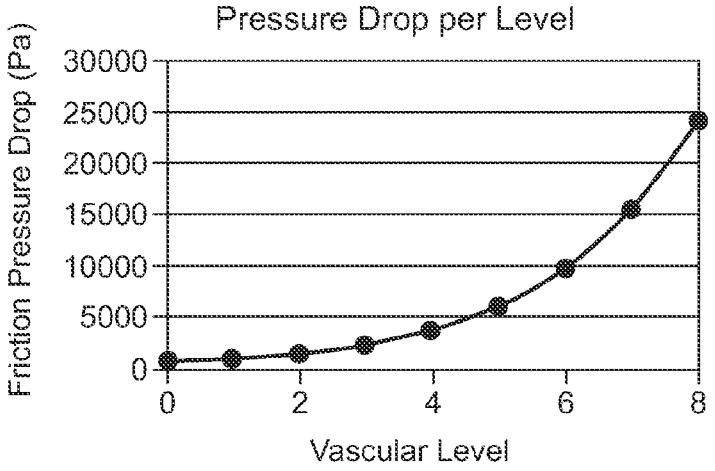
FIGS. 34A-34E are charts depicting phenomena resulting from a vascular network designed in accordance with one nonlimiting example of the present invention.
Figure 34B:
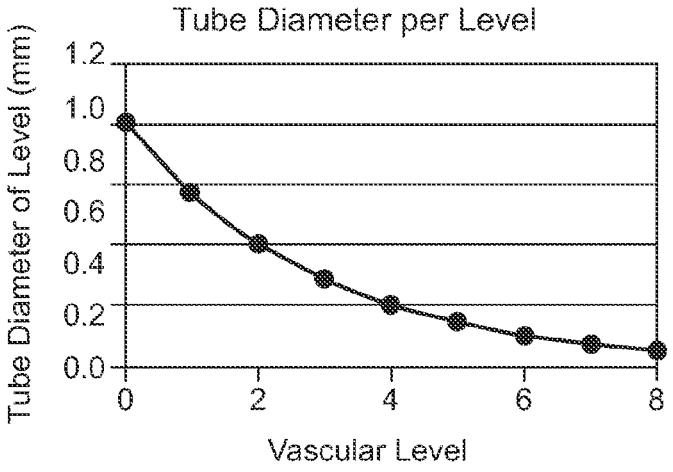
Figure 34C:
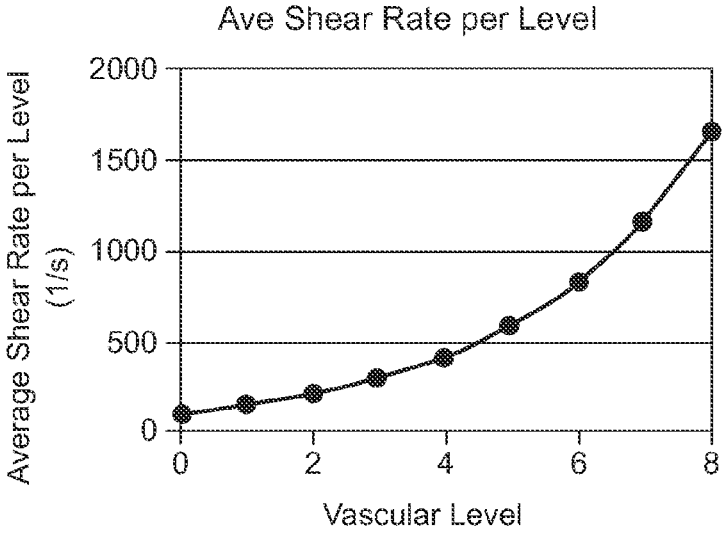
Figure 34D:
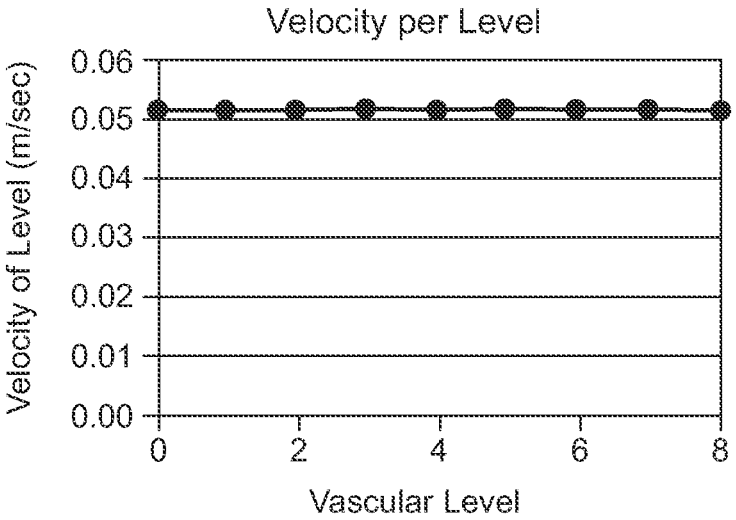
Figure 34E:
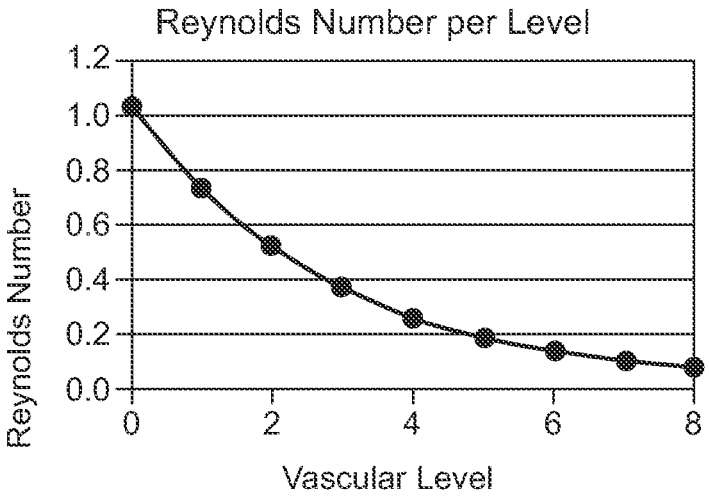

FIG. 32 illustrates another embodiment where the network 18 may comprise two main arteries 22, a primary main artery 22*c* and a secondary artery 22*d*. A primary first capillary 24*c* may extend from the primary main artery 22*c* and a secondary capillary 24*d* may extend from the secondary main artery 22*c*. Each capillary 24*c*, 24*d* may be in fluid communication with one or more fluid exits 30. For clarity, the primary first capillary 24*c* may be in fluid communication with the primary main artery 22*c* and with one or more primary fluid exits 30*c* to form a primary tree 23*c*, and the secondary capillary 24*d* may be in fluid communication with the secondary main artery 22*d* and with one or more secondary fluid exits 30*d* to form a secondary tree 23*d*. The network 18 can further comprise a primary diameter change and a secondary diameter change, where:

the primary diameter change comprises the difference between $Diameter_{StartP}$ and $Diameter_{EndP}$, where:

$Diameter_{StartP}$ is the average diameter of a primary first capillary 24*c*; and $Diameter_{EndP}$ is the average diameter of a primary terminating channel $TC_p$, wherein the primary terminating channel $TC_P$ is associated with the primary fluid exit 30*c*; and the secondary diameter change comprises the difference between $Diameter_{StartS}$ and $Diameter_{EndS}$, wherein:

$Diameter_{StartS}$ is the average diameter of the secondary capillary; and $Diameter_{EndS}$ is the average diameter of a secondary terminating channel $TC_S$, wherein the secondary terminating channel $TC_S$ is associated with the secondary fluid exit 30*d*; and The primary diameter change may be substantially equal to the secondary diameter change.

One nonlimiting example of customization of the network 18 involves the use of the following formula when designing each tree 23:

$$Diameter_{Level}=Diameter_{Start}*BR\hat{}(-Level/(2+epsilon))$$

Where:

$Diameter_{Start}$ is the average diameter of an initial capillary $\mathbf{24}_i$ that is associated with the main artery, disposed on Level 0. For example, the initial capillary $\mathbf{24}_i$ may be the first capillary 24*a* or it may be the second capillary 24*b;*

$Diameter_{Level}$ is the average diameter of a channel 20 at given tree level other than Level 0;

BR is the branching ratio of the tree 23 in vascular network 18. In one nonlimiting example, the branching ratio is 2, meaning that the tree 23 divides into two branches at each junction 21. The branching ratio may be a number greater than 1. In another nonlimiting example, the network 18 may comprise different branching at each junction 21. For example, one junction may divide into 3 branches and another may divide into 2 branches. In one such example, the branching ratio may be the average of number branch divisions at each junction 21;

Level is an integer representing the tree 23 level, where 0 represents the tree level where the initial capillary $\mathbf{24}_i$ is associated with the main artery 22, 1 represents the tree level where one or more sub-capillaries 26 are associated with the initial capillary $\mathbf{24}_i$, and so on; and Epsilon is a real number that is not equal to −2 and is used to represent the conditions below:

where Epsilon <−2, the diameters of the channels 20 progressively increase as the level increases where Epsilon >−2, the diameters of the channels 20 progressively decrease as the level increases. The rate of decrease differs depending on how large the epsilon value is. The larger the epsilon value, the smaller the decrease in diameters.

Further to the above, epsilon can be any real number other than −2. The epsilon value may be selected based on sheer sensitivity of the fluid, the desired level of uniformity in the fluid flow (i.e., the uniformity between fluid to separate exits), the desired pressure as the fluid exits the network 18 and/or the desired fluid drop or fluctuation within the network 18, the smallest possible orifice that can be formed for the fluid to exit, and physical constraints of the roll 10 such as how large the $Diameter_{start}$ can be. In one nonlimiting example, epsilon is a real number between 1 and 2. In another nonlimiting example, epsilon is about 1.5 or about 1.6.

By way of example, and as shown in FIGS. 33A-33E, epsilon may be 2. In such nonlimiting example, the channel diameters more steadily decrease with each increased level as compared to lower epsilon values. It is believed that pressure drop throughout the network 18 may be relatively low with this epsilon value while working within the limited space within the roll 10.

As another example, as shown in FIGS. 34A-34E, epsilon can be 0. In such nonlimiting example, the velocity of the fluid is held constant as the fluid travels from the inlet 28 to the fluid exit 30. The shear rate and pressure drop increase as the fluid leaves the network as shown in FIGS. 34A-34E but not as sharply as they would if epsilon were lower, such as −1. In other words, the diameter decreases as the level increases, but at a slower pace than when epsilon is −1.

The skilled person will recognize that there are numerous options available for use in the disclosed formula depending on the desired results. Moreover, each tree 23 can be designed in the same manner (i.e., same values used for each variable) or differently, or each tree 23 can be designed to achieve the same effect despite different values or to achieve different effects. Further, the trees 23 and network 18 can be designed without the use of the formula.

In addition, the design of the fluid exits 30 (including the micro-reservoirs 39) can also contribute to optimization of the vascular network 18. In one embodiment, the area of micro-reservoirs 39 on the exterior surface 14 may vary. The exit length (i.e., the distance from the entry point 31 to the exit point 32) of each micro-reservoir 39 can be adjusted such that the pressure drop of each micro-reservoir is the same. This will result in uniform velocity from the various micro-reservoirs 39 despite their varied areas. Uniform velocity results in the same thickness of fluid being deposited by each exit 30 on each roll 10 rotation.

In another embodiment, for example when the fluid is an ink, the area of each fluid exit 30 in a vascular network 18 may be adjusted for AM tone control (i.e., control of the amplitude modulation of printed fluid). The area of one fluid exit 30 may be larger than that of another fluid exit 30 in order to achieve a darker deposit. In other words, smaller exit areas tend to result in lighter deposits.

In yet another embodiment, one or more of the fluid exits 30 are designed to serve as limiting orifices. That is, there is a significantly higher pressure drop through the exits 30 than the pressure drop throughout the rest of the vascular network 18. This design can be achieved, for example, using the above formula where epsilon is −1. The design may resolve or cover imperfections or slight imbalances that exist in the network 18. Essentially, the fluid will still be deposited as desired despite imperfections because of the force with which the fluid is pushed out of the exits 30. This objective may also be achieved by designing one or more of the sleeve exits 120 to serve as limiting orifices (discussed in more detail below).

In yet another embodiment, the velocity at different exits 30 could be different in order to lay down different amounts of fluid. In one such example, the different exits 30 may be the same size or different sizes. The velocity may be varied by lowering the pressure drop at one of the exits 30 (as compared to the pressure drop at another exit 30). Fluid leaving the exit 30 that has the lower pressure drop will have higher velocity and therefore more fluid will be deposited.

Where multiple main arteries are employed as shown for example in FIG. 32, each main artery 22 has one or more trees 23, each having one or more levels of capillaries 24 and, possibly, sub-capillaries 26 as discussed above. Using the formulas and teachings above, the network 18 may be designed such that the pressure drop along a primary tree 23*c* extending from one main artery 22*c* can be substantially equal to the pressure drop along a secondary tree 24*d* extending from another main artery 22*d*. Likewise, the network 18 may be designed such that the change in diameter along the primary tree 23*c* may be substantially equal to the change in diameter along the secondary tree 24*d* extending from a different main artery 22*d*.

Sleeve as Additional Customization Tool

Figure 35:
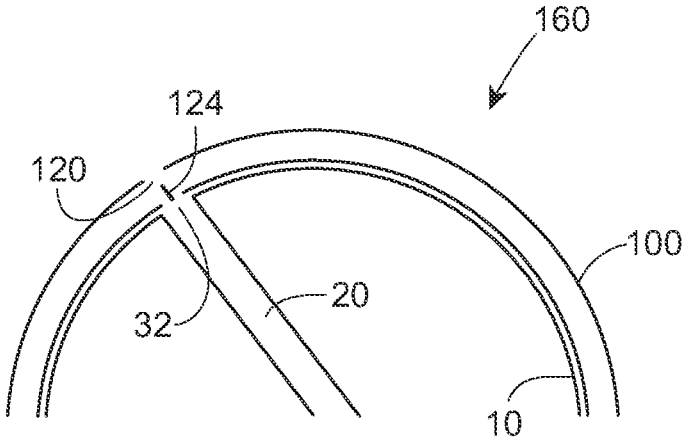
FIG. 35 is a schematic representation of a sleeve and roll system in accordance with one embodiment of the present invention.

The sleeve 100 may work in conjunction with the roll 10 and its network 18 to achieve desired effects. Indeed, the sleeve 100 and roll 10 may comprise a sleeve and roll system 160 incorporating any of their respective components as described herein. For instance, the sleeve exits 120 may provide the same optimization as discussed above with respect to the design of fluid exits 30 (e.g., velocity of exiting fluid along different paths, AM tone control). In one nonlimiting example, a sleeve exit 120 may operate as a limiting orifice. In one such example, the sleeve exit 120 is registered or otherwise associated with a fluid exit point 32 at a meeting point 124. As shown in FIG. 35, the cross-sectional area of the meeting point 124 may be less than the cross-sectional area of the exit point 32, causing the sleeve exit 120 to serve as a limiting orifice. For example, where the diameter of a channel 20 at the end of a fluid path 48 or the diameter or area of fluid exit 30 cannot be reduced (due to integrity of the structure), the sleeve exit 120 can still operate to provide a smaller exit.

Figure 36:
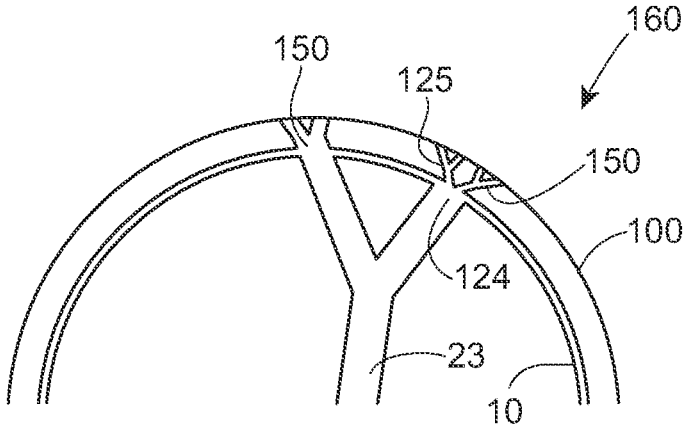
FIG. 36 is a schematic representation of a sleeve and roll system in accordance with an alternative embodiment of the present invention.

Turning to FIG. 36, the sleeve exits 120 (not shown) can operate to supplement the equations above such that physical limitations of the vascular network 18 and/or roll 10 can be overcome. In other words, where the vascular network 18 or a tree 23 within the network 18 is designed according the formula in the previous section, the sleeve exit 120 can be an additional component of such formula. Essentially, the sleeve exit 120 can provide a supplementary tree 150. The supplementary tree 150 can be associated with a channel 20 in the underlying network tree 23. The supplementary tree could provide a number of supplementary levels, x. Thus, if a tree 23 associated with the supplementary tree 23 had n levels, the total aggregate design would comprise n+x levels. Such supplementary tree levels could affect the fluid application by, for example, acting as a limiting orifice and/or changing application pressure. The supplementary tree 150 could also eliminate the need for a reservoir 39 in the underlying network 18.

Overcoming Issues

The design of the network 18 compensates for the centripetal/centrifugal forces resulting from the rotation of the roll 10. In networks without substantially radial fluid paths 48, centripetal/centrifugal force can impede the flow of fluids to the desired outlets. Deviation from radial paths can increase negative effects of centripetal/centrifugal force. Here, however, the substantially radial paths minimize deviation from radial flow more than fluid paths that are substantially axial or substantially circumferential. Essentially, the present invention enables operating with high centripetal forces.

It is also believed the radial design permits fluid to flow to exits 30, 120 in a more uniform manner. Contrarily, circumferential design may result in certain areas of the network being starved or void of fluid while other areas would have too much fluid. In other words, necessary differences in path lengths from a main artery 22 to a fluid exit 30 in a circumferential design would allow fluid to quickly travel to certain locations within the vascular network 18 while not adequately reaching other locations. The same may be true in an axial design.

Making the Roll

The rotating roll 10 and/or the vascular network 18 may be made through the use of stereo lithographic printing (SLA) or other forms of what is commonly known as 3D printing or Additive Manufacturing. In another nonlimiting example, the vascular network 18 is created by casting, such as a process analogous to lost wax printing, or any other means known in the art to create a network of channels 20 with predetermined paths 48. The roll 10 may be comprised of one unitary piece of material. In an alternative nonlimiting example, the roll 10 may be comprised of segments of material joined together. This would allow replacement of just a section of the roll 10 if there was localized damage to the roll 10 and enables fabrication of the roll 10 over a much wider range of machines.

Optional/Ancillary Parts

Figure 37:
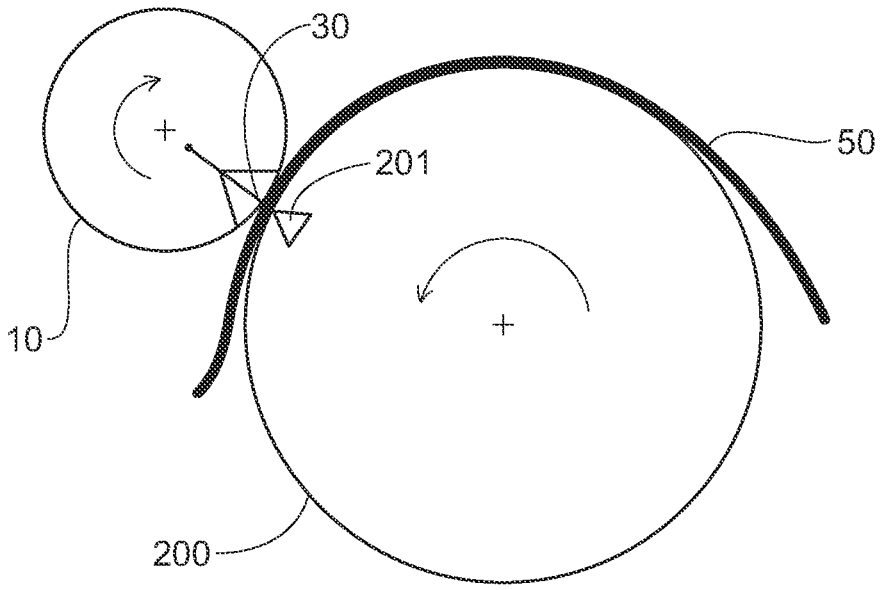
FIG. 37 is a schematic representation of a rotating roll and backing surface in accordance with one embodiment of the present invention.
Figure 38:
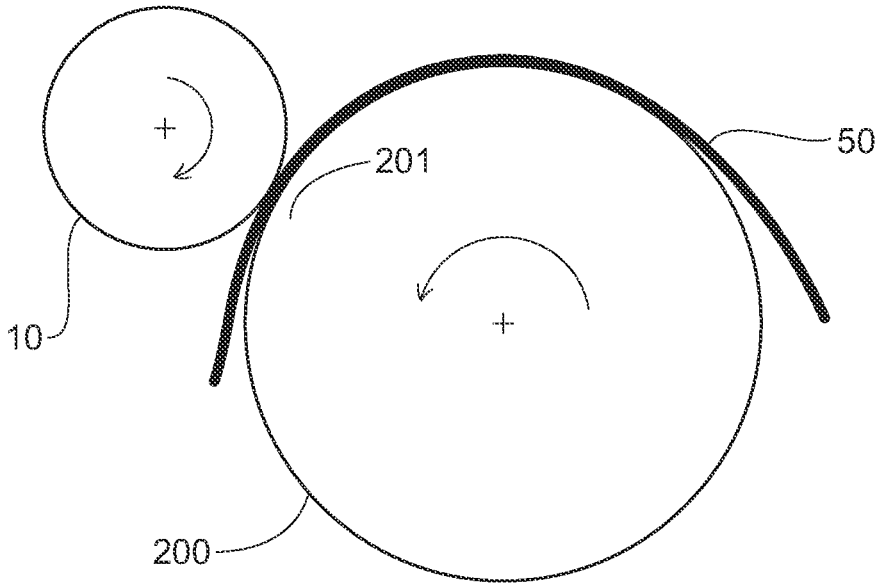
FIG. 38 is a schematic representation of a rotating roll and backing surface in accordance with another embodiment of the present invention.

In an embodiment, the rotating roll 10 may be used in conjunction with a backing surface 200 as depicted in FIGS. 37 and 38. The substrate 50 may be driven over the backing surface 200. In one nonlimiting example (see FIG. 37), the backing surface 200 and rotating roll 10 may be positioned at a distance away from each other. In such case, the distance between the backing surface 200 and rotating roll 10 may be substantially equal to or smaller than the caliper of the substrate 50. Alternatively, the rotating roll 10 may form a nip 205 with the backing surface 200 as shown in FIG. 38. The substrate 50 may contact the rotating roll 10 at the nip 205. The backing surface 200 may be made of any material suitable for providing a surface for the substrate 50 and/or providing pressure to facilitate printing, such as providing compression and/or pressure at the nip 205. In one nonlimiting example, the backing surface 200 has a urethane surface. Alternatively, the backing surface 200 may have a steel surface or any suitable surface having a hardness value between 60 on the Rockwell C scale and 150 on the P&J Plastometer. In another nonlimiting example, the backing surface 200 may be used with a plurality of rotating rolls 10. The backing surface 200 may comprise vacuum regions 201 providing suction. The vacuum regions 201 may be registered or otherwise associated with fluid exits 30, micro-reservoirs 39 and/or sleeve exits 120 to facilitate transfer of fluid onto the substrate 50. Separately, the amount of substrate 50 that is wrapped about the backing surface 200 may be purposefully controlled and even changed dynamically. Controlling the amount of wrap on the backing surface 200 may be controlled by changing the position of a first web path roller (not shown) just upstream of the backing surface 200 and/or changing the position of a second web path roller (not shown) just downstream of the backing surface 200. These web path changes and related changes to the web wrap on backing surface 200 may be made when the system is not operating (i.e. statically) or when the system is operating (i.e. dynamically) by means known in the art. The substrate 50 may be controlled to maintain a target tension during the printing process. The substrate 50 tension setpoint may be determined to optimize registration between a first printed fluid and a second printed fluid, or between a first printed fluid and a product feature such as an embossment, perforation, and the like. The tension of the substrate 50 may be measured by a load cell or load cells. The difference between the measured tension and the tension setpoint may then be calculated by means known in the art and used to control a speed change in the rotating roll 10 and/or the speed of rollers upstream or downstream of the rotating roll 10. The resulting speed change between rolls adjusts the substrate 50 tension closer to the setpoint. The sequence is repeated to maintain the target substrate 50 tension throughout normal variation in substrate 50 properties, operating speeds, environmental conditions, and the like. In another nonlimiting example, the surface speed of the rotating roll may be controlled to match the surface speed of the backing surface 200. This matched speed configuration may be particularly useful for printing multiple, registered fluids. In an alternative embodiment, the surface speed of the rotating roll 10 may be controlled to a setpoint different than the backing surface 200. In a nonlimiting example, the surface speed of the rotating roll may be 50% less than the surface speed of the backing surface 200. This speed mismatch may create smearing of a printed fluid, a preferred means for a more uniform application of a fluid such as a surface softener. The aforementioned control methods provide the flexibility to print a variety of fluids and create many product improvements while using the same equipment.

Figure 39:
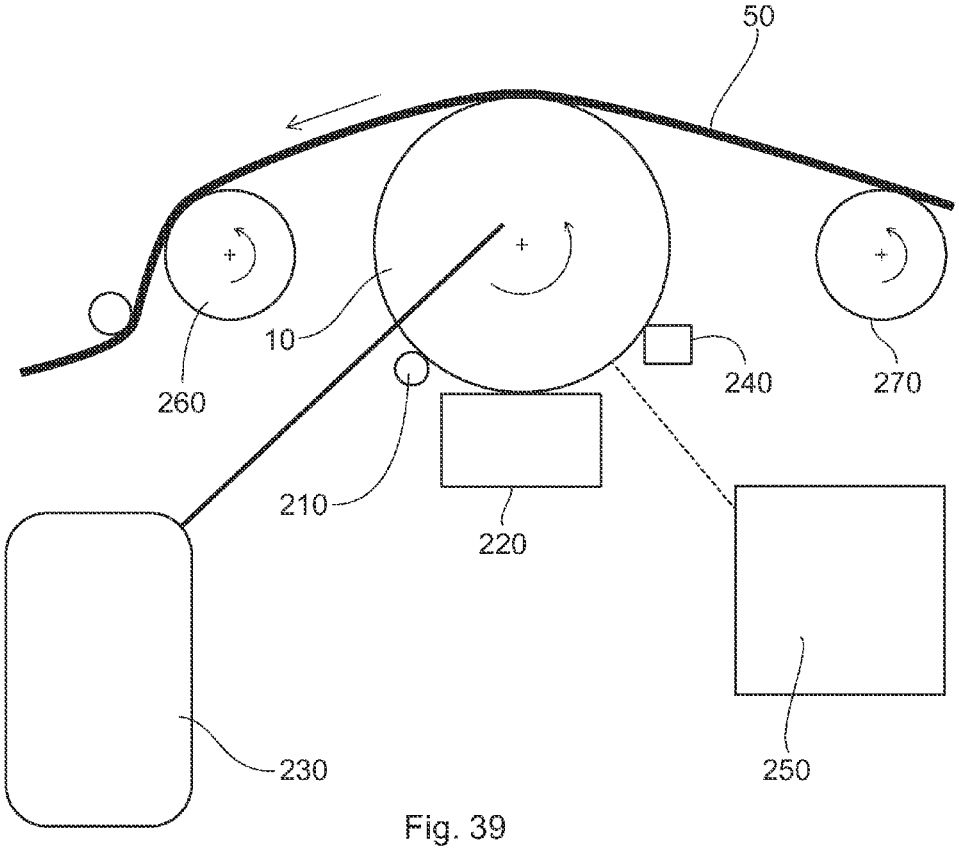
FIG. 39 is a schematic representation of a rotating roll used in conjunction with ancillary parts in accordance with one embodiment of the present invention.

Turning to FIG. 39, the rotating roll 10 may be associated with a drive motor 210 to adjust the speed of the rotating roll 10. The drive motor 210 may be any suitable motor or mechanism known in the art. In addition, the drive motor 210 and/or rotating roll 10 may be controlled by any method or mechanism known in the art. In one nonlimiting example, the drive motor 210 is MPL-B4540F-MJ72AA, commercially available from Rockwell Automation.

In a further embodiment, the rotating roll 10 may be associated with a hygiene system 220. The hygiene system 220 may be any known system or mechanism suitable for the removal of debris and dust. Nonlimiting examples of hygiene systems 220 include vacuums, sprayers, doctor blade, brushes and blowers.

In still another embodiment, the rotating roll 10 may be associated with a rotary union 230. The rotary union 230 may have multiple ports and may supply one or more fluids to the vascular network 18 of a rotary roll 10. By way of nonlimiting example, up to eight individual fluids can be provided to a rotating roll 10. In another nonlimiting example, the rotary union 230 may supply one or more fluids to the vascular networks 18 of a plurality of rolls 10. From the rotary union 230, each fluid can be piped into the interior region 16 of the roll 10, specifically to the inlet 28. One of skill in the art will understand that a conventional multi-port rotary union 230 suitable for use with the present invention can typically be provided with up to forty-four passages and are suitable for use up to 7,500 lbs. per square inch of fluid pressure. A nonlimiting example of a suitable rotary union is described in U.S. patent application Ser. No. 14/038,957 to Conroy.

Other design features can be incorporated into the design of the rotating roll 10 and related apparatuses as well to aid in fluid control, roll assembly, roll maintenance, and cost optimization. By way of non-limiting example, check valves, static mixers, sensors, or gates or other such devices can be provided integral within the rotating roll 10 to control the flow and pressure of fluids being routed throughout the roll 10. In another example, the roll 10 may contain a closed loop fluid recirculation system where a fluid could be routed back to any point inside the roll 10 or to any point external to the roll 10 as a fluid feed tank or an incoming feed line to the roll 10. In another example, as mentioned above, the roll 10 can be fabricated so that the surface 14 of the roll 10 and/or the outer surface 130 of the sleeve 100 is multi-radiused (i.e., has different elevations) surface. In addition to the above disclosure, multi-radiused surface may facilitate cleaning of the roll 10 or sleeve 100, transferring fluid from the surface 14, 130 to a substrate 50, moving the substrate 50 out of plane as in an embossing, activation transformation and the like, and/or achieving different fluid transfer rates and/or different deformation (e.g., embossment) depths. Multi-radiused surfaces may be designed in accordance with teachings provided in U.S. Pat. No. 7,611,582 to McNeil which is incorporated by reference herein. In yet another nonlimiting example, the addition of a light source within or proximate to the rotating roll 10 can be provided to increase visibility of the rotating roll 10 or into the interior region 16 of the rotating roll 10.

Indeed, the rotating roll 10 may be used to perform multiple operations simultaneously and/or in precise registration. For example, a multi-radiused exterior surface 14 in combination with the vascular network 18 permits both embossing and distribution of fluid on a substrate 50 through the same apparatus, namely the rotating roll 10. One of skill in the art will appreciate that various combinations can result, including but not limited to, simultaneous print and emboss patterns and multiple structural transformations (e.g., embossing and chemical processing).

The rotating roll 10 may also be used in combination with a feedback system 240 such as sensors and computers or other components known in the art. The feedback system 240 can send current state information (e.g., flow rate, fluid amount, add-on rate and location, pressures, fluid or roll velocity, location of product features 51 and/or temperature) so that changes can be made dynamically.

The rotating roll 10 may also be associated with a control mechanism 250 such as a computer or other components known in the art, such that fluid pressure, volume, velocity, add-on rates and locations, fluid or roll temperature, rotational speed, fluid application level, roll surface speed, fluid flow rate, pressure, substrate speed, degree of circumferential roll contact by the substrate, distance between the exterior surface 14, 130 and a backing surface 200, pressure between the rotating roll 10 and the backing surface 200 and combinations thereof, and other operational features discussed herein may be controlled and/or adjusted dynamically. In one embodiment, the control mechanism 250 can separately control features associated with a given tree 23, main artery 22 or section of the roll, including but not limited to fluid application level, fluid application rate, fluid flow rate, pressure, temperature and combinations thereof. In one nonlimiting example, the fluid application rate of each main artery 22 is at least 10% different.

In a further embodiment, the roll 10 can be used in conjunction with a pretreat station 260. The pretreat station 260 may be positioned upstream from the roll 10. Where a plurality of rolls 10 are used, the pretreat station 260 may be positioned upstream from at least one roll 10 and/or downstream from other rolls 10. The pretreat station 260 may comprise a spraying, extruding, printing or other process and/or may be used to treat a substrate 50 with chemicals, fluids, heaters/coolers and/or other treatment processes in preparation for or as a supplement to the fluid deposition provided by the roll 10. In one nonlimiting example, the pretreat station 260 is used to provide water on the substrate 50.

In yet another embodiment, the roll 10 may be used in conjunction with overcoat station 270. The overcoat station 270 may be positioned downstream from the roll 10. Where a plurality of rolls 10 are used, the overcoat station 270 may be positioned downstream from at least one roll 10 and/or upstream from other rolls 10. The overcoat station 270 may comprise a spraying, extruding, printing or other process and/or may be used to treat or coat a substrate 50 with chemicals, fluids, heaters/coolers and/or other treatment processes after fluid deposition is provided by the roll 10. In one nonlimiting example, the overcoat station 270 is used to provide a varnish on the substrate 50.

Method for Creating a Vascular Network

Figure 40:
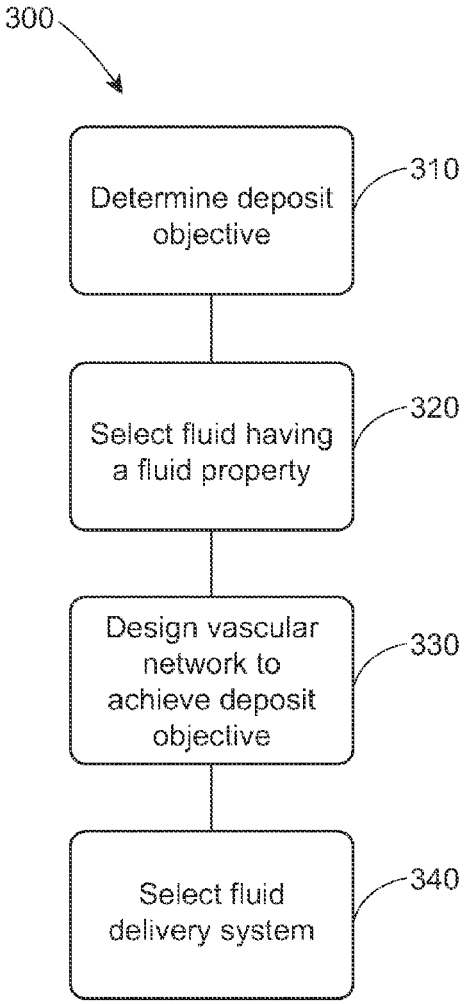
FIG. 40 is a schematic representation of a method in accordance with one embodiment of the present invention.

In an embodiment shown in FIG. 40, a method 300 for creating a vascular network 18 includes the steps of determining a deposit objective 310, selecting a fluid having at least one fluid property 320, designing a vascular network 18 to achieve the deposit objective 330 and selecting a fluid delivery system 340. The deposit objective 310 may include a desired deposit location of the fluid on the substrate 50, a desired deposit add-on amount, a desired volumetric flow rate, a desired application rate (i.e., the add-on amount in combination with the volumetric flow rate), the size of the desired deposit, how the fluid is to be applied (e.g., smearing, dot application, lines, etc.), and combinations thereof.

The vascular network 18 may be built using stereo lithographic printing as discussed above. The network 18 may be disposed in the rotating roll 10. The rotating roll 10, or a portion of the rotating roll 10, may be substantially surrounded by a sleeve 100. Designing the network 18 may include designing a main artery 22 (having any of the features described herein in relation to main arteries 22) associated with one or more trees 23 (having any of the features described herein in relation to trees 23). Further, designing the network 18 may include selecting the location and/or size of the trees 23 and associating at least one of the trees 23 with a fluid exit 30. One or more of the trees may comprise branching levels as discussed above. In one nonlimiting example, a tree 23 has n levels. The pressure drop in the channels 20 may increase as the branch level increases. In other words, the pressure drop in between channels on level n and level n−1 may be greater than the pressure drop between levels n−1 and n−2. In another nonlimiting example, a tree 23 is designed such that shear rates are maintained at each branch level (i.e., the shear rates are consistent despite the branch level). In one embodiment, a tree 23 is designed using the formula: $\text{Diameter}_{Level}=\text{Diameter}_{Start}*\text{BR}\hat{}(-\text{Level}/(2+\text{Epsilon}))$ (discussed in detail above).

Further still, designing the network 18 may comprise designing and/or fluid exits 30. Fluid exits 30 may comprise any of the features described herein in relation to fluid exits 30. Designing the vascular network 18 may also comprise analyzing the deposit objective, one or more fluid properties, desired pressure and/or diameter changes, shear rates and combinations of these factors.

Selecting the fluid delivery system may comprise selecting or designing channels 20, locations and/or sizes of channels 20, junctions 21, locations and/or sizes of junctions 21, a fluid source (such as a rotary union 230), and/or a pumping mechanism or other means to provide fluid at a desired rate. Further, selecting a fluid delivery system may include selecting desired fluid pressure and/or velocity, which may vary or remain constant during the fluid's travel through the roll 10. The method 300 may also include selecting combinations of these factors.

Figure 41:
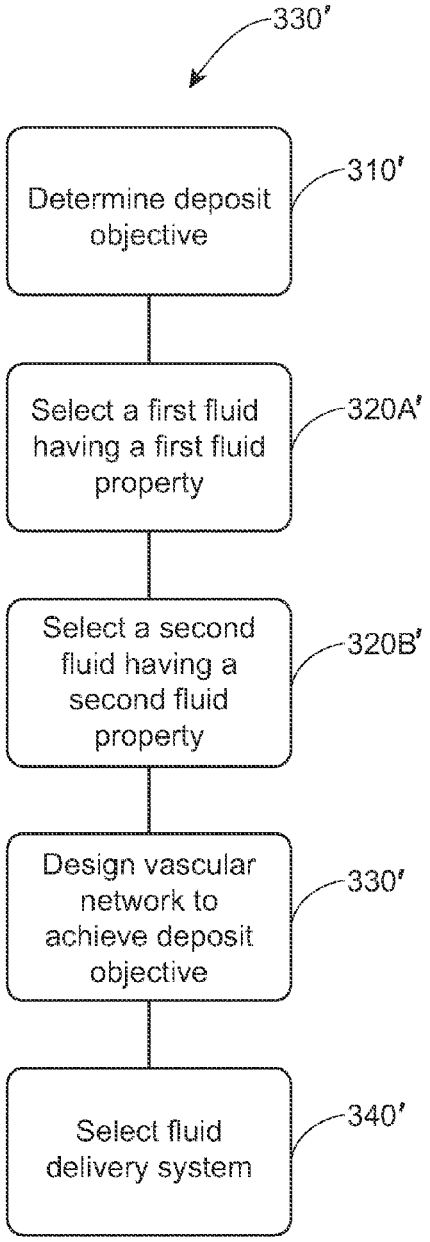
FIG. 41 is a schematic representation of a method in accordance with one embodiment of the present invention.

In another embodiment shown in FIG. 41, the method 300' comprises determining a deposit objective 310', selecting a first fluid having a first fluid property 320A, selecting a second fluid having a second fluid 320B, designing a vascular network to achieve the deposit objective 330' and selecting a fluid delivery system 340'. In one nonlimiting example, the first fluid and second fluid are different. In another nonlimiting example, the first fluid property is different than the second fluid property. The deposit objective may comprise any of the above deposit objectives as well as a first desired deposit location correlating to the desired deposit location of the first fluid, a second desired deposition location correlating to the desired deposit location of the second fluid, a first desired deposit rate (i.e., the desired deposit rate of the first fluid), the second desired deposit rate (i.e., the desired deposit rate of the second fluid) and combinations thereof.

The designing step 320' may comprise any of the aforementioned principles with respect to step 320. Further, step 320' may comprise designing at least two main arteries 22, each of which being associated with one or more trees 23 and at least one of the trees 23 being associated with a fluid exit 30. Again, the network 18 may be formed using stereo lithographic printing. In addition, the network 18 may be disposed within a rotating roll 10, and the roll 10 may be disposed within or partially within a sleeve 100.

Selecting a fluid delivery system 340' may comprise the same considerations and steps as indicated above with respect to step 340.

Methods for Depositing a Fluid onto a Substrate

Figure 42:
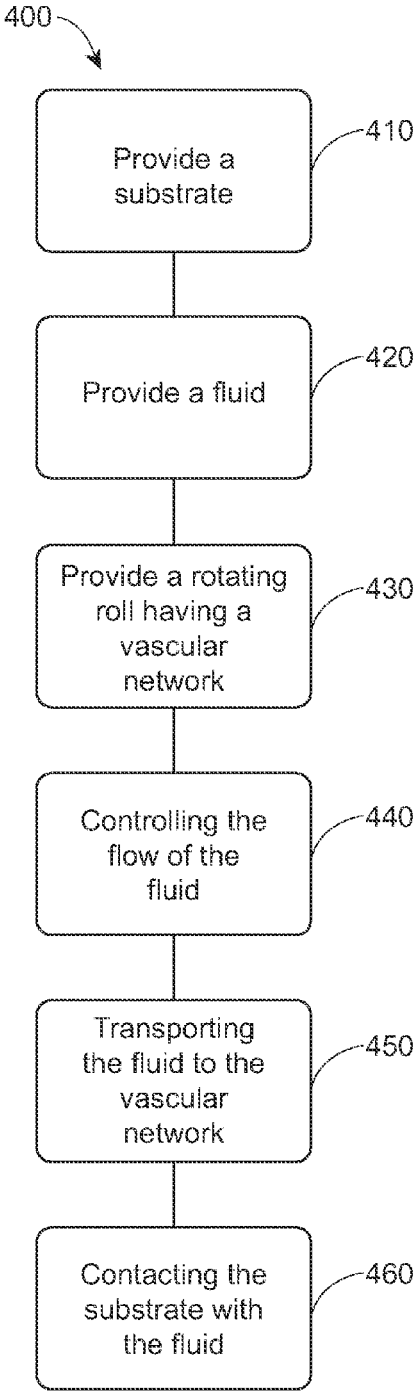
FIG. 42 is a schematic representation of a method in accordance with one embodiment of the present invention.
Figure 43:
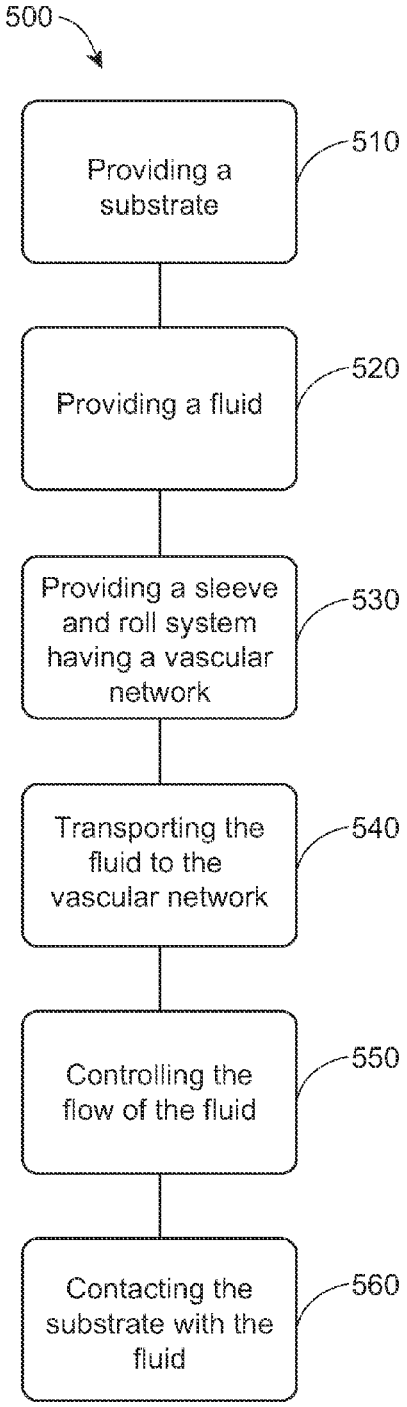
FIG. 43 is a schematic representation of a method in accordance with one embodiment of the present invention.

Turning to FIG. 42, a method 400 for printing a fluid onto a substrate 50 generally includes the steps of providing a substrate 410, providing a fluid 420, providing a rotating roll 10 having a vascular network 18 in accordance with the teachings herein 430, transporting the fluid 440 to the vascular network 18, controlling the flow of the fluid such that the fluid moves to the fluid exit 30 at a predetermined flow rate 450 and contacting the substrate 50 with the fluid 460.

In particular, the method 400 may include the steps 410, 420 of providing a fluid and providing a substrate 50. The fluid may be provided from a rotary union 230. The method 400 may further include the step 430 of providing a rotating roll 10 having any of the features described herein with relation to rotating rolls 10 of the present invention. For example, the rotating roll 10 may comprise a central longitudinal axis 12 and an exterior surface 14 that substantially surrounds the central longitudinal axis 12 and defines an interior region 16. The roll 10 may rotate about the central longitudinal axis 12. In one nonlimiting example, the rotating roll 10 may rotate at a surface speed of greater than about 10 ft/minute, or from about 100 ft/minute to about 3000 ft/minute, or about 1800 ft/minute.

The method 400 may also include the step of providing vascular network 18, having any of the features described herein in relation to a vascular network 18. In one nonlimiting example, the vascular network 18 may be provided separately from the rotating roll 10. The vascular network 18 may be provided to supply the fluid from the interior region 16 to the exterior surface 14 in a predetermined fluid path 48. As described above, the vascular network 18 may comprise a main artery 22, which may have an inlet 28 and be substantially parallel to the central longitudinal axis 12 of the roll 10. In one nonlimiting example, the main artery 22 is spaced at a radial distance, r, from the central longitudinal axis 12. The radial distance, r, is greater than 0. Further, the vascular network 18 may a capillary 24 and a plurality of fluid exits 30. The fluid may enter the vascular network 18 through the inlet 28 and exit the vascular network 18 through the fluid exits 30.

Further still, the vascular network 18 may comprise a first capillary 24*a* which may be associated with the main artery 22. The cross-sectional area of the main artery 22 may be greater than the cross-sectional area of the first capillary 24*a*. In an embodiment, the vascular network 18 may comprise a second capillary 24*b*, which may be associated with the main artery 22. The cross-sectional area of the main artery 22 may be greater than the cross-sectional area of the second capillary 24*b*. The first capillary 24*a* and/or the second capillary 24*b* may be in fluid communication with the main artery 22 and with a fluid exit 30 through a substantially radial fluid path 48 to form a tree 23. In one nonlimiting example, the first capillary 24*a* and/or the second capillary 24*b* may be in fluid communication with the main artery 22 and with at least two fluid exits 30 through substantially radial paths 48, forming one or more trees 23. As explained above, the capillary 24 may be associated with and in fluid communication with one or more sub-capillaries 26 disposed between the capillary 24 and a fluid exit 30. Further, any tree 23 within the vascular network 18, may be designed in accordance to the formula: $Diameter_{Level}=Diameter_{Start}*BR\hat{}(-Level/(2+epsilon))$, which is explained in more detail above.

In one embodiment, the vascular network 18 comprises both a first capillary 24*a* and a second capillary 24*b* and each are in fluid communication with one or more fluid exits 30. As discussed above, a first path length, FP, may comprise the distance between the first capillary 24*a* and a fluid exit 30 with which it is in fluid communication, and a second path length, SP, may comprise the distance between the second capillary 24*b* and a fluid exit 30 with which the second capillary 24*b* is in fluid communication. The method 400 may include equalizing the first and second path lengths, FP, SP. As used herein, "equalizing" means making two values (e.g., distances) substantially equal or within 5% of each other.

In another embodiment, the method may include equalizing diameter changes along different trees 23, such as equalizing a first diameter change with a second diameter change as discussed in detail in previous sections.

Again, the roll 10 and vascular network 18 may include or be associated with any of the features described in the above sections. In one nonlimiting example, the exterior surface 14 of the roll 10, or a portion of the exterior surface 14 of the roll 10, is substantially surrounded by a sleeve 100 having any of the features described herein related to sleeves 100. The sleeve 100 may comprise a sleeve exit 120, which may be registered or otherwise associated with at least one fluid exit 30.

The method 400 may also comprise the step 440 of transporting the fluid to the vascular network 18. In addition, the method 400 may comprise the step 450 of controlling the flow of the fluid to move the fluid at a predetermined flow rate to the fluid exits 30. The fluid flow may be controlled by selecting a particular fluid pressure, a particular fluid volume, a particular fluid viscosity, a particular fluid surface tension, the length of one or more channels 20, the diameter of one or more channels 20, the relative diameters and/or lengths of the channels 20, the roll 10 diameter, temperature of the vascular network 18 or portions of the vascular network 18, temperature of the roll 10 or portions of the roll 10, temperature of a particular fluid and/or combinations thereof. One of skill in the art will recognize that a wide range of predetermined flow rates may be selected and suitable for the present invention. In one nonlimiting example, the fluid may be provided at a pressure of less than 15 psi, or less than 10 psi.

The method 400 may further comprise the step 460 of contacting a substrate 50 with the fluid. In an embodiment, the substrate 50 and fluid exit 30 are in operative relationship. The substrate 50 may contact the fluid at the fluid exit 30. In one nonlimiting example, one or more of the fluid exits 30 may comprise micro-reservoir 39. In one such example, the substrate 50 may contact the fluid at the micro-reservoir 39 or at an opening 46 in the micro-reservoir 39. In another nonlimiting example, a backing surface 200 is provided. The roll 10 may form a nip 205 with a backing surface 200, and the substrate 50 may contact the fluid at the nip 205. In yet another nonlimiting example, the rotating roll 10 comprises a sleeve 100 which substantially surrounds a portion of the exterior surface 14. The sleeve 100 may have a sleeve exit 120 as described above. One or more sleeve exits 120 may be registered or otherwise associated with a fluid exit 30 or with a fluid micro-reservoir 39. The substrate 50 may contact the fluid at the sleeve exit(s) 120 or otherwise be in operative relationship with the sleeve exit(s) 120. Further, the fluid may be registered with a product feature 51 on the substrate.

In another embodiment, the method 400 may comprise the step of moving the substrate 50 (not shown). The substrate 50 may be moved about the rotating roll 10, or about a portion of the rotating roll 10. The substrate 50 may be driven by any suitable means, including but not limited to a drive motor 210. In one nonlimiting example, the substrate 50 moves at rate of about 10 ft/minute or from about 100 ft/minute to about 3000 ft/minute or at about 2000 ft/minute. In another nonlimiting example, the substrate 50 and the rotating roll 10 move at the same rate. When moved at the same rates, the fluid may be applied in a precise manner, such as in the form of a droplet. In yet another nonlimiting example, the substrate 50 and the rotating roll 10 move at different rates. When the rates of the roll 10 and the substrate 50 are unmatched, the fluid may be smeared on a surface of the substrate 50 or the area or size of a pattern 52 previously applied can be changed.

The method may also comprise providing a control mechanism 250 having any of the features described above with respect to the control mechanism 250. In one nonlimiting example, the control mechanism 250 is a computer or other programmable device. In another nonlimiting example, the control mechanism 250 is capable of controlling fluid application level, application rate, roll surface speed, fluid flow rate, pressure, temperature, substrate speed, degree of circumferential roll contact by the substrate, distance between the exterior surface and a backing surface, pressure between the rotating roll and the backing surface and combinations thereof.

In a further embodiment, the vascular network 18 may comprise a plurality of main arteries 22 and a plurality of capillaries 24, such as a plurality of first capillaries 24*a*. Each capillary 24 is in fluid communication with a main artery 22 and one or more fluid exits 30 through substantially radial fluid paths 48 to form a tree 23. A control mechanism 250 may be used to separately control properties for each tree 23 and/or each main artery 22. The control mechanism 250 can be capable of controlling properties such as fluid application level, application rate, roll surface speed, fluid flow rate, pressure, temperature, substrate speed, degree of circumferential roll contact by the substrate, distance between the exterior surface and a backing surface, pressure between the rotating roll and the backing surface and combinations thereof. In one nonlimiting example, the control mechanism 250 is used to separately control each of the main arteries 22 and their respective trees 23 with respect to fluid application level, fluid application rate, fluid flow rate, pressure, temperature and combinations thereof. In another nonlimiting example, the fluid application rate of fluids in separate main arteries 22 may differ by at least 10%.

Further, the method 400 may comprise equalizing diameter changes of trees 23 stemming from different main arteries as shown in FIG. 32. For example, the method may comprise equalizing primary diameter change and a secondary diameter change as explained in detail above.

A sleeve and roll system method 500 may also be employed. The method 500 may comprise the steps of providing a substrate 510, providing a fluid 520, providing a sleeve and roll system 160 having a vascular network 18 (step 530), transporting the fluid to the vascular network 540, controlling the flow of fluid 550, and contacting the substrate 50 with the fluid 560. The steps 510-560 may comprise any of the features in method 400. In addition, the sleeve and roll system 160 may comprise any of the features discussed herein in relation to the sleeve and roll system 160. In one embodiment, the rotating roll 10 is disposed within the inner region 130 of the sleeve 100. The sleeve 100 can have a sleeve exit 120. The vascular network 18 may comprise a tree 22 having a first capillary 24*a*. The first capillary 24*a* may be in fluid communication with a main artery 22 and the sleeve exit 120 through a substantially radial path 48. The substantially radial path 48 may end at an exit point 32 of a fluid exit 30. The exit point 32 may be associated with the sleeve exit 120. The tree 23 may be designed by any suitable means, including but not limited to the equation $Diameter_{Level}=Diameter_{Start}*BR\hat{}(-Level/(2+Epsilon))$ discussed in detail above. Separately, the tree 23 may further comprise a series of sub-capillaries 26, and the first capillary 24*a* may be in fluid communication with the sleeve exit 120 through the series of sub-capillaries 26.

In one nonlimiting example, the sleeve 100 has a thickness, T, of greater than about 1.5 mm, or between about 1.5 mm or about 10 mm, and a sleeve exit 120 has an aspect ratio of greater than about 10. In another embodiment, the sleeve 100 has a thickness, T, of less than about 4 mm, or less than about 2 mm, or less than about 1.5 mm, or less than about 0.5 mm. The cross-sectional area of meeting point 124 of the sleeve exit 120 may be less than about 0.5, or less than about 0.3 or less than about 0.15 times the cross-sectional area of the fluid exit point 32 or reservoir opening 46.

Further, the sleeve exit 120 may comprise a supplementary tree 150 as shown in FIG. 36 and discussed in detail above.

As with method 400, a backing surface may be provided and used in any of the aforementioned ways. Likewise, as with method 400, method 500 may comprise moving the substrate 50 at speeds matching the surface speed of the roll 10 or at speeds unmatched to the surface speed of the roll 10. Further, a control mechanism 250 may be employed in the same manner as in method 400.

In another embodiment, the step 530 of providing the sleeve and roll system 160 comprises a sleeve substantially surrounding only a portion of the exterior surface 14 of the roll 10 to form a sleeve coverage area 105. The vascular network 18 may comprise a main artery 22, a plurality of capillaries 24 and a plurality of fluid exits 30. Each capillary 24 can be associated with the main artery and in fluid communication with the main artery 22 and one or more fluid exits through substantially radial paths to form a tree 23. An exit point 32 of at least one of the fluid exits 30 is registered or otherwise associated with a sleeve exit 120, and at least one of the fluid exits is disposed outside of the sleeve coverage area 105. The fluid exit 30 disposed outside of the sleeve coverage area 105 is not registered or associated with a sleeve exit 120.

In yet another embodiment, a plurality of rolls 10 may be provided, each roll 10 having a vascular network 18 that operates as described above. One or more of the rolls 10 may be used in conjunction with a sleeve 100. One or more fluids may be provided to each roll 10. One or more main arteries 22 may be provided in each vascular network 18 and/or one or more trees 23 may be provided for each main artery 22. If desired, a control mechanism 250 capable of separately controlling properties associated with each roll 10, each main artery 22 in a roll 10, and/or each tree 23 in a roll 10. The control mechanism 250 can be capable of controlling properties such as fluid application level, application rate, roll surface speed, fluid flow rate, pressure, temperature, substrate speed, degree of circumferential roll contact by the substrate, distance between the exterior surface and a backing surface, pressure between the rotating roll and the backing surface and combinations thereof.

In one nonlimiting example, a backing surface 200 is provided. The backing surface 200 may be used to create a nip 205 or nips 205 with one or more of the rolls 10, and the fluids 13 may contact the substrate 50 at the nip(s) 205. Alternatively, the backing surface 200 does not create a nip 205 but rather is a distance from one or more of the rotating rolls 10. The distance may be substantially equivalent or less than the caliper of the substrate 50. In another alternative embodiment, a plurality of rolls 10 is provided without a backing surface 200. The backing surface 200 may comprise vacuum regions 201.

Using a plurality of rolls 10 allows for a plurality of fluids 13 to be deposited onto a substrate 50. It is believed that the vascular network 18 of the rolls 10 permit better registration, overlaying and blending of fluids than known systems because more than one fluid can be applied using a single roll 10 in an intricate and precisely registered relationship to each other. Each roll 10 is capable of being controlled (due to the design of the vascular network 18) such that a more precise amount of fluid can be more precisely applied at a desired location in a repeatable manner. The plurality of rolls, each having this level of precision, allows for more precise registration, overlaying and blending of the various fluids applied.

Figure 22:
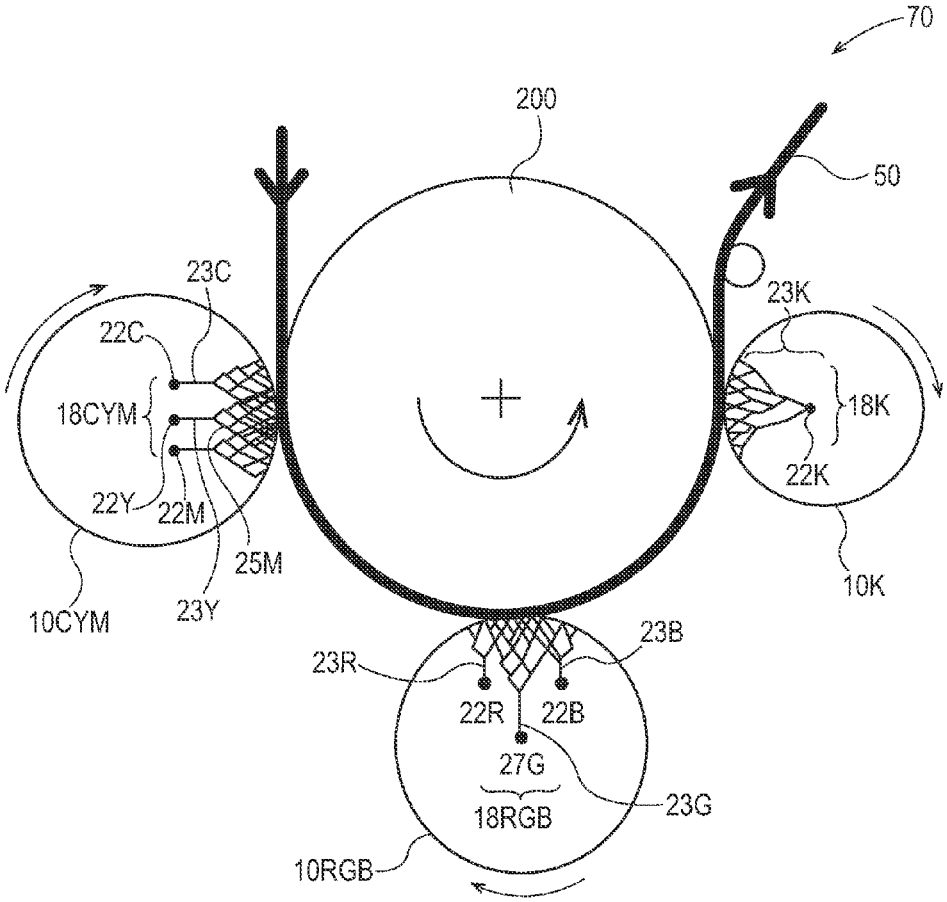
FIG. 22 is a schematic representation of a print system in accordance with one embodiment of the present invention.
Figure 44:
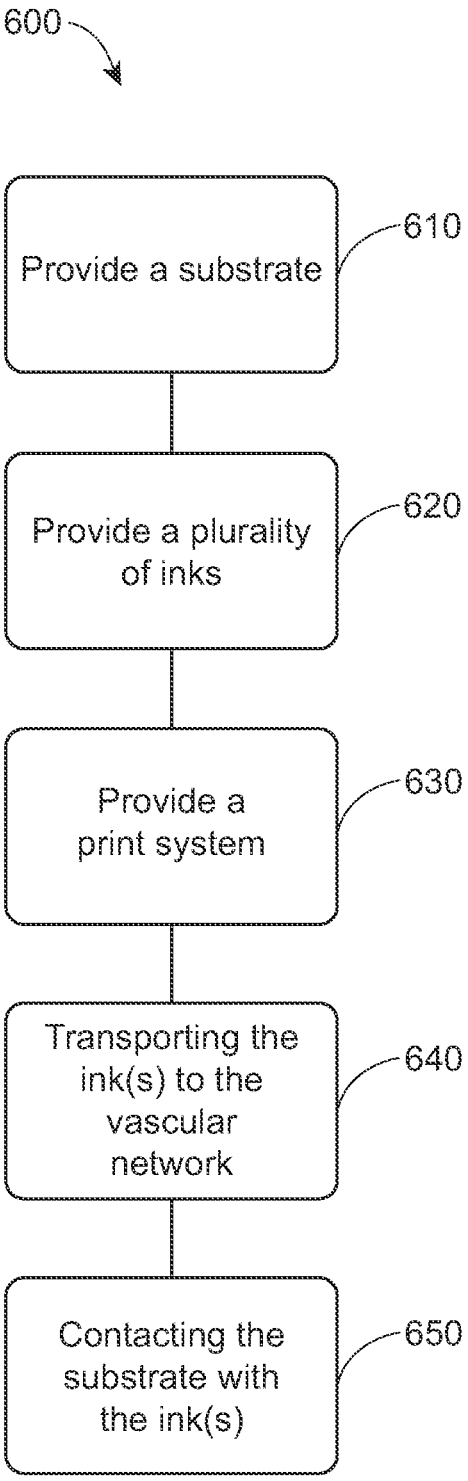
FIG. 44 is a schematic representation of a method in accordance with one embodiment of the present invention.

Along these lines, a printing method 600 is also provided and depicted in FIG. 44. In general, the method 600 allows for printing X number of inks with fewer than X printing apparatuses as illustrated in FIGS. 22-24. The method 600 generally comprises providing a substrate 610, providing a plurality of inks 620, providing a print system 70 comprising at least one rotating roll 10 and vascular network 18 (step 630), transporting at least one of the inks to the vascular network 18 (Step 640), and contacting the substrate 50 with the plurality of inks 650.

In an embodiment, the method 600 includes providing 7 or more inks and contacting the substrate 50 with 7 or more inks. The print system 70 comprises 6 or fewer rotating rolls 10. The rotating rolls 10 may have any of the features any of the features described above or illustrated in FIGS. 22-24. The rotating rolls 10 may be used with or without sleeves 100. In one nonlimiting example, each of the 6 or less rotating rolls 10 comprises a vascular network 18 having at least one main artery 22, at least one capillary 24 and a plurality of fluid exits 30. At least one of the 7 or more inks is transported to each of the rotating rolls 10. Two or more inks may be transported to one roll 10. In one nonlimiting example (illustrated in FIG. 22), the print system can comprise a first roll 10 CYM comprising cyan, yellow and magenta, a second roll 10 RGB comprising red, green and blue and a third roll 10K comprising black. The method 600 may further comprise positioning the rolls 10 such that the first roll 10CYM is upstream of the second roll 10RGB and/or upstream of the third roll 10K. The method 600 may additionally comprise positioning the second roll 10RGB upstream of the third roll 10K. Further, the method 600 can include registering one or more of the inks with another ink. In one nonlimiting example, one or more of the inks from the first roll 10CYM (i.e., cyan, yellow, magenta) is registered with one or more of the inks from the second roll 10RGB (i.e., red, green, blue) and or the ink from the third roll 10K (i.e., black). Likewise, inks from the second roll 10 RGB can be registered with the ink from the third roll 10K and so on. Similarly, the method 600 may include overlaying inks and/or blending inks from the separate rolls 10CYM, 10RGB, 10K. Further, inks within one roll 10CYM may be mixed, by for example an internal mixer 72. Such mixed colors may then be registered, overlaid or blended with inks from a different roll 10RGB, 10K. Any combination of inks in any combination of mixing, registering, blending and/or overlaying may be used.

In another embodiment, the method 600 includes providing 3 or more inks in step 620 and contacting the substrate 50 with 3 or more inks in step 650. The print system 70 can comprise one rotating roll 10 having a plurality of inks disposed therein as shown in FIG. 23. The rotating roll 10 may comprise any of the features any of the features described above and can be used with or without a sleeve 100. In one nonlimiting example, the vascular network 18 of the rotating roll 10 comprises a plurality of main arteries 22, a plurality of capillaries 24 and a plurality of fluid exits 30. Each of the 3 or more inks may be disposed with the vascular network 18 and each may be fed through a separate main artery. In a further nonlimiting example, a network 18CYMK comprises a first main artery 22C comprising cyan, a second main artery 22Y comprising yellow, a third main artery 22M comprising magenta and a fourth main artery 22K comprising black. At least two of the inks may be mixed within the roll 10CYMK, by for example, use of an internal mixer 72.

In yet another embodiment, the print system 70 includes a rotating roll 10 and a conventional printing apparatus 68. The method 600 includes the additional step of transporting at least one of the plurality of inks to the conventional printing apparatus 68. In one nonlimiting example, at least 2 inks are transported to the vascular network 18 of the roll 10 and one or more inks are transported to the conventional printing apparatus 68. The conventional printing apparatus 68 may comprise any of the features disclosed above in relation to conventional printing apparatuses 68, including comprising a deposit orifice 69. The step of contacting the substrate with the inks 650 may be achieved by placing both the deposit orifice 69 and a fluid exit 30 in operative relationship with the substrate 50. The deposit orifice 69 may be positioned upstream or downstream of the fluid exit 30. The inks(s) exiting the deposit orifice 69 may be registered, blended and/or overlaid with inks exiting the fluid exit 30.

The method 600 may further comprise the step of controlling the flow of the fluid to move the fluid at a predetermined flow rate to the fluid exits 30. The fluid flow may be controlled by selecting a particular fluid pressure, a particular fluid volume, a particular fluid viscosity, a particular fluid surface tension, the length of one or more channels 20, the diameter of one or more channels 20, the relative diameters and/or lengths of the channels 20, the roll 10 diameter, temperature of the vascular network 18 or portions of the vascular network 18, temperature of the roll 10 or portions of the roll 10, temperature of a particular fluid and/or combinations thereof. In addition, the method 600 may comprise registering one or more inks with a product feature 51. Further, the method 600 may comprise providing an overcoat station 270 positioned downstream of at least one roll 10 and/or providing a pretreat station 260 positioned upstream of at least one roll 10.

One of skill in the art will recognize that any number of rolls 10 and any combination and/or order of inks and other fluids may be used to create desired fluid applications. Internal mixers 72 may also be used within a given rotating roll 10 to produce combinations of the inks or combinations of inks and other fluids within said roll 10.

In embodiments, the above methods 300, 400, 500, 600 may include providing a rotary union 230, such as the rotary union 230 described above, and supplying the fluid(s) from the rotary union 230 to the rotating roll(s) 10.

In other embodiments, the methods 300, 400, 500, 600 may include registering the fluid with a product feature 51.

In a further nonlimiting example, the rotating roll 10 is part of the converting process of fibrous structures. The roll 10 and additional features described herein may be used in between a winder and unwinds.

One of skill in the art will recognize that the invention may include the negative or reverse of what is shown in the present figures. In other words, the interior region 16 of the rotating roll 10 may be generally solid with the channels 20 of the vascular network 18 being defined by the surfaces of the interior region 16. Alternatively, the interior region 16 could be generally hollow and the channels 20 could be tubular components built within the hollow interior 16 as depicted in the figures.

One of skill in the art will recognize that a wide range of fluids can be utilized with the apparatus and method of the disclosed invention. From relatively low viscosity fluids such as water and inks, to higher viscosity fluids such as high internal phase emulsion (HIPE) foams, the various features of the apparatus can be modified as necessary for the desired flow rate, for example. In an example, a HIPE foam suitable for use in the present invention can be an aqueous phase and an oil phase combined in a ratio between about 8:1 and 140:1. In certain embodiments, the aqueous phase to oil phase ratio is between about 10:1 and about 75:1, and in certain other embodiments the aqueous phase to oil phase ratio is between about 13:1 and about 65:1. This is termed the "water-to-oil" or W:O ratio and can be used to determine the density of the resulting polyHIPE foam. The oil phase may contain one or more of monomers, comonomers, photoinitiators, crosslinkers, and emulsifiers, as well as optional components. The water phase will contain water and in certain embodiments one or more components such as electrolyte, initiator, or optional components.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A system for depositing a fluid on a substrate, the system comprising:

a rotating roll having an exterior surface and a sleeve substantially surrounding a portion of the exterior surface to form a sleeve coverage area and having a sleeve exit, wherein:

the rotating roll comprises a central longitudinal axis and rotates about the central longitudinal axis;

the exterior surface substantially surrounds the central longitudinal axis and defines an interior region;

a vascular network is disposed within the interior region, the vascular network being configured for transporting the fluid in a predetermined path from the interior region to the exterior surface and comprising a main artery, a plurality of capillaries and a plurality of fluid exits disposed on the exterior surface, wherein:

the main artery comprises an inlet and is substantially parallel to the central longitudinal axis of the rotating roll, wherein the fluid enters the vascular network at the inlet;

each capillary is associated with the main artery and in fluid communication with the main artery and at least two fluid exits through substantially radial paths to form a tree;

the sleeve exit is associated with an exit point of at least one of the fluid exits; and one of the fluid exits is disposed outside of the sleeve coverage area.

2. The system of claim 1 wherein the sleeve comprises a thickness of greater than 1.5 mm and the sleeve exit comprises an aspect ratio of greater than about 10.

3. The system of claim 1 wherein the sleeve comprises a thickness of less than 1.5 mm and the sleeve exit comprises a cross-sectional area less than 0.5 times the cross-sectional area of the exit point with which the sleeve exit is associated.

4. The system of claim 1 wherein at least one of the fluid exits comprises a micro-reservoir.

5. The system of claim 1 further comprising a backing surface.

6. The system of claim 5 wherein the backing surface further comprises vacuum regions, wherein said vacuum regions are registered to one of the group consisting of sleeve exits, fluid exits and combinations thereof.

7. The system of claim 5 wherein the backing surface further comprises vacuum regions, wherein said vacuum regions are registered to the sleeve exit.

8. The system of claim 1 further comprising a control mechanism capable of controlling one of the group consisting of: fluid application levels, fluid application rates, roll surface speed, fluid flow rate, pressure, temperature, substrate speed, degree of circumferential roll contact by the substrate, distance between a surface of the rotating roll and a backing surface, pressure between the rotating roll and the backing surface and combinations thereof.

9. The system of claim 1 wherein the sleeve comprises a thickness of less than about 4 mm and the sleeve exit comprises a cross-sectional area less than 0.5 times the cross-sectional area of the exit point.

10. The system of claim 1 wherein the tree further comprises a series of sub-capillaries and the first capillary is in fluid communication with the sleeve exit through the series of sub-capillaries.

11. The system of claim 1 wherein the tree comprises a formulaic design in accordance with the following formula:

$$\text{Diameter}_{Level}=\text{Diameter}_{Start}*BR\hat{}(-\text{Level}/(2+\text{Epsilon}))$$

where:

$\text{Diameter}_{Start}$ is the average diameter of the first capillary;

$\text{Diameter}_{Level}$ is the average diameter of at least one channel on the tree disposed on a tree level other than Level 0;

BR is a branching ratio of the tree;

Level is an integer representing the tree level; and

Epsilon is a real number that is not equal to −2.

12. The system of claim 1 wherein the sleeve exit comprises a supplementary tree.

13. The system of claim 1 wherein the sleeve exit is a limiting orifice.

14. The system of claim 1 wherein the sleeve comprises an outer surface having a taber abrasion testing factor greater than the taber abrasion testing factor of the exterior surface of the roll.

15. The system of claim 1 wherein the sleeve comprises a metal material having a Rockwell hardness value of about B79.

* * * * *